US011413858B2

(12) United States Patent
Tozuka

(10) Patent No.: US 11,413,858 B2
(45) Date of Patent: Aug. 16, 2022

(54) PRIN UNG MACHINE

(71) Applicant: KABUSHIKI KAISHA ISOWA, Nagoya (JP)

(72) Inventor: Yusuke Tozuka, Nagoya (JP)

(73) Assignee: KABUSHIKI KAISHA ISOWA, Nagoya (JP)

( * ) Notice: Subject to any disclaimer, the term of this patent is extended or adjusted under 35 U.S.C. 154(b) by 37 days.

(21) Appl. No.: 17/197,321

(22) Filed: Mar. 10, 2021

(65) Prior Publication Data

US 2021/0316547 A1 Oct. 14, 2021

(30) Foreign Application Priority Data

Apr. 8, 2020 (JP) ..... JP2020-069511

(51) Int. Cl.

| | |
|---|---|
| ***B41F 35/04*** | (2006.01) |
| ***B41F 31/20*** | (2006.01) |
| ***B41F 31/10*** | (2006.01) |
| *B41F 5/24* | (2006.01) |

(52) U.S. Cl.

CPC ..... *B41F 31/10* (2013.01); *B41F 31/20* (2013.01); *B41F 35/04* (2013.01); *B41F 5/24* (2013.01)

(58) Field of Classification Search

CPC .. B41F 5/24; B41F 31/10; B41F 31/20; B41F 35/04

See application file for complete search history.

(56) References Cited

U.S. PATENT DOCUMENTS

| | | | | |
|---|---|---|---|---|
| 2006/0032387 | A1* | 2/2006 | Watanabe | B41F 31/08 101/367 |
| 2012/0167791 | A1 | 7/2012 | Nadachi et al. | |
| 2015/0174893 | A1* | 6/2015 | Telljohann | B41F 35/00 101/423 |
| 2016/0185104 | A1 | 6/2016 | Nadachi et al. | |

FOREIGN PATENT DOCUMENTS

| | | | |
|---|---|---|---|
| JP | H 09-123427 | A | 5/1997 |
| JP | H 10-296961 | A | 11/1998 |
| JP | H 10-296962 | A | 11/1998 |
| JP | 2007-118262 | A | 5/2007 |
| JP | 4671801 | B2 | 4/2011 |
| JP | 2011-098478 | A | 5/2011 |
| JP | 2015-089620 | A | 5/2015 |

* cited by examiner

*Primary Examiner* — Leslie J Evanisko
*Assistant Examiner* — Leo T Hinze
(74) *Attorney, Agent, or Firm* — Crowell & Moring LLP

(57) ABSTRACT

An ink recovery pipe comprises: an inflow port for receiving ink from an ink reservoir, and disposed at a position close to a first machine frame; and an outflow port for discharging ink into an ink container, and disposed at a position close to a second machine frame. A first restriction device is disposed at a position downstream of the inflow por. A first coupling part is configured to couple a high-pressure air generation part with the ink recovery pipe at a position downstream of the first restriction device. A first high-pressure air control device is configured to stop supply of high-pressure air to the ink recovery pipe, while ink is supplied to the ink reservoir, and supply the high-pressure air to the ink recovery pipe, after start of an ink recovery operation of recovering ink from the ink reservoir after completion of supply of ink.

11 Claims, 6 Drawing Sheets

PRIN UNG MACHINE

RELATED APPLICATIONS

This application claims priority to Japanese Patent Application No. 2020-069511, filed on Apr. 8, 2020, the entire content of which is incorporated herein by reference.

BACKGROUND OF THE INVENTION

1. Field of the Invention

The present invention relates to a printing machine comprising: an ink reservoir for reserving ink to be applied onto an ink transfer roll; an ink supply pipe for supplying ink from an ink container to the ink reservoir; and an ink recovery pipe for recovering ink from the ink reservoir to the ink container, wherein the printing machine is configured to sequentially carry out a printing step, and an ink recovery step of recovering ink from the ink reservoir after completion of the printing step.

2. Description of the Related Art

Heretofore, there has been proposed a printing machine equipped with an air ejector, in order to recover ink remaining in an ink recovery pipe, after completion of an ink recovery step of recovering ink in an ink reservoir. For example, an air injector disclosed in Patent Document 1 (JP-B 4671801) is disposed at a position close to an ink container, i.e., at a downstream-side position of an ink recovery pipe in an ink recovery direction. Typically, the air injector comprises a nozzle for supplying high-pressure air, an expansion chamber for suctioning residual ink and air from the ink recovery pipe, and a diffuser.

High-pressure air is supplied from the nozzle into the expansion chamber, and mixed with the residual ink and air in the expansion chamber. The residual ink and air mixed in the expansion chamber are compressed through an orifice portion of the diffuser, and thereby ejected toward an outlet side of the diffuser at high speed. The high-speed ejection of the residual ink-air mixture causes a reduction in an internal pressure of the expansion chamber surrounding the nozzle. As a result of the reduction in the internal pressure of the expansion chamber, residual ink and air in the ink recovery pipe are continuously suctioned into the expansion chamber, and returned from the diffuser to the ink recovery pipe, whereby the residual ink and air are sent toward the ink container.

SUMMARY OF THE INVENTION

Technical Problem

In the air injector disclosed in the Patent Document 1, the inner diameter of the orifice portion of the diffuser is set to a small value to allow the residual ink-air mixture to be ejected at high speed. However, the small inner diameter of the orifice portion imposes a restriction on the amount of the residual ink-air mixture to be suctioned from the expansion chamber, thereby leading to a problem that a relatively long time period is required for recovering residual ink from the ink recovery pipe.

The present invention has been made in view of the above problem, and an object thereof is to provide a printing machine capable of quickly and reliably recovering residual ink in an ink recovery pipe.

Solution to Problem

According to a first aspect of the present invention as set forth in the appended claim 1, there is provided a printing machine which comprises: a printing plate; an ink transfer roll rotatable to transfer ink to the printing plate; a pair of machine frames arranged in spaced-apart relation in a rotational axis direction of the ink transfer roll, wherein the ink transfer roll is disposed in an interspace region between the machine frames; an ink reservoir for reserving ink, wherein the ink reservoir is formed along the ink transfer roll so as to apply ink onto the ink transfer roll; an ink supply pipe for supplying ink from an ink container to the ink reservoir; and an ink recovery pipe for recovering ink from the ink reservoir, or from an ink pool for temporarily pooling ink received from the ink reservoir, in an ink recovery direction directed toward the ink container. This printing machine further comprises: a first restriction device for restricting a fluid communication state of the ink recovery pipe; a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply. In this printing machine, the ink recovery pipe comprises: an inflow port for allowing ink from the ink reservoir or the ink pool to flow in the ink recovery pipe therethrough, wherein the inflow port is disposed at a position closer to one, first, machine frame of the pair of machine frames than a roll middle position in the rotational axis direction of the ink transfer roll; and an outflow port for allowing ink in the ink recovery pipe to flow out toward the ink container therethrough, wherein the outflow port is disposed at a position closer to the other, second, machine frame of the pair of machine frames than the roll middle position in the rotational axis direction of the ink transfer roll. The first restriction device is disposed at a disposition position of the inflow port of the ink recovery pipe, or a position downstream of the inflow port in the ink recovery direction. The first coupling part is coupled to the ink recovery pipe at a position downstream of the first restriction device in the ink recovery direction. Further, the first high-pressure air control device is configured to stop the supply of the high-pressure air to the ink recovery pipe through the first coupling part, during a period during which ink is supplied to the ink reservoir via the ink supply pipe, and supply the high-pressure air to the ink recovery pipe through the first coupling part, after start of an ink recovery operation of recovering, via the ink recovery pipe, ink from the ink reservoir after completion of the supply of ink thereto, or an ink recovery operation of recovering, via the ink recovery pipe, ink from the ink reservoir after completion of the supply of ink thereto and the ink pool.

In the first aspect of the present invention, the ink reservoir may be configured to be defined by a rubber roll and an anilox roll equivalent to the ink transfer roll, or may be configured to be defined by the anilox roll, an elongate member extending along the anilox roll, and a doctor blade.

In the first aspect of the present invention, the ink supply pipe may be used only for supplying ink from the ink container to the ink reservoir, or may be used both for supplying ink from the ink container to the ink reservoir and for recovering ink from the ink reservoir to the ink container.

In the first aspect of the present invention, the ink recovery pipe having the inflow port disposed at a position closer to the first machine frame than the roll middle position in the rotational axis direction of the ink transfer roll and the outflow port disposed at a position closer to the second machine frame than the roll middle position in the rotational axis direction of the ink transfer roll may be provided by a number of at least one, i.e., the number of the ink recovery pipes may be one, or maybe two or more.

In the first aspect of the present invention, as long as the inflow port of the ink recovery pipe is disposed at a position closer to the first machine frame than the roll middle position in the rotational axis direction of the ink transfer roll, the inflow port may be disposed inside the interspace region between the pair of machine frames, or may be disposed outside the interspace region between the pair of machine frames. In the first aspect of the present invention, as long as the outflow port of the ink recovery pipe is disposed at a position closer to the second machine frame than the roll middle position in the rotational axis direction of the ink transfer roll, the outflow port may be disposed inside the interspace region between the pair of machine frames, or may be disposed outside the interspace region between the pair of machine frames.

In the first aspect of the present invention, the first restriction device may be embodied in any of various configurations, as long as they have a function of restricting or shutting off the flow of ink or air in the ink recovery pipe. For example, the first restriction device may be embodied as an opening-closing device such as an opening-closing valve configured to selectively open and close the ink recovery pipe, or may be embodied as an ink transport device such as a tubing pump configured to repeatedly open and close the ink recovery pipe.

In the first aspect of the present invention, the printing machine may be configured to comprise the ink container as its component, or may be configured not to comprise the ink container as its component.

In the first aspect of the present invention, the printing machine may be configured to comprise the high-pressure air generation part coupled to the first coupling part, as its component, or may be configured not to comprise the high-pressure air generation part as its component.

In the first aspect of the present invention, with regard to the operation of supplying the high-pressure air to the ink recovery pipe through the first coupling part, after start of the ink recovery operation of recovering, via the ink recovery pipe, ink from the ink reservoir after completion of the supply of ink thereto, or the ink recovery operation of recovering, via the ink recovery pipe, ink from the ink reservoir after completion of the supply of ink thereto and the ink pool, the first high-pressure air control device may be configured to perform the above operation, continuously, until recovery of residual ink in the ink recovery pipe is completed, or may be configured to perform the above operation, intermittently at time intervals, until recovery of residual ink in the ink recovery pipe is completed.

In the first aspect of the present invention, with regard to the operation of supplying the high-pressure air to the ink recovery pipe through the first coupling part, after start of the ink recovery operation of recovering, via the ink recovery pipe, ink from the ink reservoir after completion of the supply of ink thereto, or the ink recovery operation of recovering, via the ink recovery pipe, ink from the ink reservoir after completion of the supply of ink thereto and the ink pool, the first high-pressure air control device may be configured to perform the above operation, in parallel with performing a cleaning step of cleaning the ink reservoir, or may be configured to perform the above operation, before the cleaning step.

In the first aspect of the present invention, as long as the first high-pressure air control device is configured to stop the supply of the high-pressure air to the ink recovery pipe through the first coupling part, during at least the period during which ink is supplied to the ink reservoir via the ink supply pipe, the first high-pressure air control device may be configured to stop the supply of the high-pressure air to the ink recovery pipe through the first coupling part, even after start of the ink recovery operation of recovering ink from the ink reservoir or the like via the ink recovery pipe, or even in a state in which the inside of the ink recovery pipe is filled with ink. Further, as long as the first high-pressure air control device is configured to supply the high-pressure air to the ink recovery pipe through the first coupling part, after start of the ink recovery operation of recovering, via the ink recovery pipe, ink from the ink reservoir after completion of the supply of ink thereto, or the like, the first high-pressure air control device may be configured to supply the high-pressure air to the ink recovery pipe through the first coupling part, so as to recover ink remaining only inside the ink recovery pipe, after ink in the inside of the ink reservoir, or ink in the inside of the ink reservoir and the ink pool is fully recovered, and no ink flows into the ink recovery pipe from the ink reservoir.

In a specific embodiment of the first aspect of the present invention as set forth in the appended claim 2, the first high-pressure air control device is configured to supply the high-pressure air to the ink recovery pipe through the first coupling part, after an inside of the ink recovery pipe is changed from an ink filled state to an ink-air mixed state, in a process after the start of the ink recovery operation of recovering, via the ink recovery pipe, ink from the ink reservoir after completion of the supply of ink thereto, or the ink recovery operation of recovering, via the ink recovery pipe, ink from the ink reservoir after completion of the supply of ink thereto and the ink pool.

In this specific embodiment, when the inside of the ink recovery pipe is changed to the ink-air mixed state, ink in the inside of the ink reservoir or ink in the inside of the ink reservoir and the ink pool has been almost recovered, and ink and air flow into the ink recovery pipe from the ink reservoir or the like in a mixed state.

In a specific embodiment of the first aspect of the present invention as set forth in the appended claim 3, the first restriction device comprises a first tubing pump coupled to the ink recovery pipe and configured to transport ink in the ink recovery pipe, wherein the first tubing pump comprises a flexible tube coupled to the ink recovery pipe, and a rotor rotatable to compress the tube, wherein the fluid communication of the ink recovery pipe is shut off in a portion of the tube compressed by the rotor.

In this specific embodiment, in order to restrict the fluid communication state of the ink recovery pipe, the rotor of the first tubing pump may be configured such that the rotation thereof is stopped to continuously compress the tube, or may be configured to be continuously rotated so as to repeatedly a cycle of compression of the tube and release from the compression.

In a specific embodiment of the first aspect of the present invention as set forth in the appended claim 4, the first tubing pump is disposed on the first machine frame, and the outflow port of the ink recovery pipe is disposed in a region adjacent to the second machine frame and outside the interspace region between the pair of machine frames. Further, the ink recovery pipe has a pipe portion extending from the first tubing pump to the outflow port, and the first coupling part is coupled to the ink recovery pipe at a position downstream of the first tubing pump in the ink recovery direction and closer to the first machine frame than the roll middle position in the rotational axis direction of the ink transfer roll.

In a specific embodiment of the first aspect of the present invention as set forth in the appended claim 5, the first coupling part comprises an opening-closing device, and the first high-pressure air control device comprises an opening-closing control part to control an opening-closing operation of the opening-closing device, wherein the opening-closing control part is configured to control the opening-closing device to be placed in a closed state, thereby stopping the supply of the high-pressure air to the ink recovery pipe through the first coupling part, and to control the opening-closing device to be placed in an open state, thereby supplying the high-pressure air to the ink recovery pipe through the first coupling part.

In a specific embodiment of the first aspect of the present invention as set forth in the appended claim 6, the printing machine further comprises: a second restriction device for restricting a fluid communication state of the ink supply pipe; a second coupling part for coupling a high-pressure air generation part for generating high-pressure air, with the ink supply pipe; and a second high-pressure air control device for controlling supply of the high-pressure air to the ink supply pipe through the second coupling part, and stop of the supply. In this specific embodiment, the ink supply pipe is configured to be used for recovering ink from the ink reservoir toward the ink container, and the second high-pressure air control device is configured to stop the supply of the high-pressure air to the ink supply pipe through the second coupling part, during a period during which ink is recovered from the ink reservoir via the ink supply pipe, and supply the high-pressure air to the ink supply pipe through the second coupling part, after completion of an operation of recovering ink from the ink reservoir via the ink supply pipe.

In this specific embodiment, a time point when the supply of the high-pressure air is started after completion of the operation of recovering ink from the ink reservoir via the ink supply pipe is determined while taking into account whether or not inflow of ink from the ink reservoir into the ink supply pipe is largely hindered by the supply of the high-pressure air. Preferably, the time point of start of the supply of the high-pressure air is set to a time point when almost no ink flows into the ink supply pipe from the ink reservoir.

In this specific embodiment, the printing machine may be configured to comprise the high-pressure air generation part coupled to the second coupling part, as its component, or may be configured not to comprise the high-pressure air generation part as its component.

In this specific embodiment, with regard to the operation of supplying the high-pressure air to the ink supply pipe through the second coupling part, after completion of the ink recovery, the second high-pressure air control device may be configured to perform the above operation, continuously, until recovery of residual ink in the ink recovery pipe is completed, or may be configured to perform the above operation, intermittently at time intervals, until recovery of residual ink in the ink recovery pipe is completed.

In this specific embodiment, with regard to the operation of supplying the high-pressure air to the ink supply pipe through the second coupling part, after completion of the ink recovery, the second high-pressure air control device may be configured to perform the above operation, in parallel with performing a cleaning step of cleaning the ink reservoir, or may be configured to perform the above operation, before the cleaning step.

In a specific embodiment of the first aspect of the present invention as set forth in the appended claim 7, the second restriction device comprises a path switching device coupled to the ink supply pipe, wherein the path switching device is operable to switch a path between a first path providing fluid communication between the ink reservoir and the ink supply pipe, and a second path providing fluid communication between the second coupling part and the ink supply pipe; and the second high-pressure air control device comprises a switching control part to control a state of the path switching device between a first state in which the second path is closed, and the first path is opened, and a second state in which the first path is closed, and the second path is opened, wherein the switching control part is configured to control the state of the path switching device to be switched to the first state, thereby stopping the supply of the high-pressure air to the ink supply pipe through the second coupling part, and to control the state of the path switching device to be switched to the second state, thereby supplying the high-pressure air to the ink supply pipe through the second coupling part.

In this specific embodiment, the path switching device may be embodied in any of various configurations, as long as they have a function of switching a path between the first path and the second path. For example, the path switching device may be configured to comprise an opening-closing device such as two valves each coupled to a respective one of the first path and the second path, or may be configured to comprise a heretofore-known three-way valve having a plurality of branched paths.

In a specific embodiment of the first aspect of the present invention as set forth in the appended claim 8, the ink supply pipe has a supply port for supplying ink to the ink reservoir therethrough, wherein the supply port is disposed at the roll middle position in the rotational axis direction of the ink transfer roll, or a position adjacent to the roll middle position. In this specific embodiment, the printing machine further comprises: a second tubing pump disposed at a position closer to the second machine frame than the supply port of the ink supply pipe, wherein the second tubing pump is configured to be selectively rotatable in normal and reverse directions and coupled to the ink supply pipe to transport ink in the ink supply pipe; a bypass path coupled to the ink supply pipe while bypassing the second tubing pump; and a bypass opening-closing device configured to selectively open and close the bypass path. The second coupling part is coupled to the ink supply pipe at a position between the supply port of the ink supply pipe and the second tubing pump, and the second high-pressure air control device is configured to, during the period during which ink is recovered from the ink reservoir via the ink supply pipe, stop the supply of the high-pressure air to the ink supply pipe through the second coupling part, while controlling rotation of the second tubing pump to be set to a rotational direction for recovering ink, and controlling the bypass opening-closing device to close the bypass path, and, after completion of the operation of recovering ink from the ink reservoir via the ink supply pipe, supply the high-pressure air to the ink supply pipe through the second coupling part, while stopping the rotation of the second tubing pump, and controlling the bypass opening-closing device to open the bypass path.

In this specific embodiment, as long as the second tubing pump is disposed at a position closer to the second machine frame than the supply port of the ink supply pipe, the second tubing pump may be disposed on the second machine frame, or may be disposed inside the interspace region between the pair of machine frames.

According to a second aspect of the present invention as set forth in the appended claim 9, there is provided a printing machine which comprises: a printing plate; an ink transfer roll rotatable to transfer ink to the printing plate; a pair of machine frames arranged in spaced-apart relation in a rotational axis direction of the ink transfer roll, wherein the ink transfer roll is disposed in an interspace region between the machine frames; an ink reservoir for reserving ink, wherein the ink reservoir is formed along the ink transfer roll so as to apply ink onto the ink transfer roll; an ink supply pipe for supplying ink from an ink container to the ink reservoir; an ink recovery pipe for recovering ink from the ink reservoir, or from an ink pool for temporarily pooling ink received from the ink reservoir, in an ink recovery direction directed toward the ink container; a cleaning water supply unit for supplying cleaning water to the ink reservoir; and a drain pipe for draining the cleaning water in the ink reservoir. The printing machine is configured to sequentially carry out a printing step of supplying ink to the ink reservoir to perform printing, an ink recovery step of, after completion of the printing step, recovering ink from the ink reservoir or from the ink reservoir and the ink pool, and a cleaning step of cleaning the ink reservoir by supplying cleaning water to the ink reservoir and draining the cleaning water via the drain pipe. In the second aspect of the present invention, the printing machine further comprises: a first restriction device for restricting a fluid communication state of the ink recovery pipe; a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply. The ink recovery pipe comprises: an inflow port for allowing ink from the ink reservoir or the ink pool to flow in the ink recovery pipe therethrough, wherein the inflow port is disposed at a position closer to one, first, machine frame of the pair of machine frames than a roll middle position in the rotational axis direction of the ink transfer roll; and an outflow port for allowing ink in the ink recovery pipe to flow out toward the ink container therethrough, wherein the outflow port is disposed at a position closer to the other, second, machine frame of the pair of machine frames than the roll middle position in the rotational axis direction of the ink transfer roll. The first restriction device is disposed at a disposition position of the inflow port of the ink recovery pipe, or a position downstream of the inflow port in the ink recovery direction. The first coupling part is coupled to the ink recovery pipe at a position downstream of the first restriction device in the ink recovery direction. Further, the first high-pressure air control device is configured to, in the printing step, stop the supply of the high-pressure air to the ink recovery pipe through the first coupling part, and, during a period during which at least the cleaning step is carried out after completion of the printing step, supply the high-pressure air to the ink recovery pipe through the first coupling part, so as to recover ink in the ink recovery pipe.

The printing machine according to the second aspect of the present invention can be embodied in any of various configurations, in the same manner as the first aspect of the present invention and the specific embodiments thereof.

In a specific embodiment of the second aspect of the present invention as set forth in the appended claim 10, the printing machine further comprises: a second restriction device for restricting a fluid communication state of the ink supply pipe; a second coupling part for coupling a high-pressure air generation part for generating high-pressure air, with the ink supply pipe; and a second high-pressure air control device for controlling supply of the high-pressure air to the ink supply pipe through the second coupling part, and stop of the supply. In this specific embodiment, the ink supply pipe is configured to be used for recovering ink from the ink reservoir toward the ink container, and the second high-pressure air control device is configured to, in the printing step, stop the supply of the high-pressure air to the ink supply pipe through the second coupling part, and, during a period during which at least the cleaning step is carried out after completion of the printing step, supply the high-pressure air to the ink supply pipe through the second coupling part, so as to recover ink in the ink supply pipe.

According to a third aspect of the present invention as set forth in the appended claim 11, there is provided a printing machine which comprises: a printing plate; an ink transfer roll rotatable to transfer ink to the printing plate; a pair of machine frames arranged in spaced-apart relation in a rotational axis direction of the ink transfer roll, wherein the ink transfer roll is disposed in an interspace region between the machine frames; an ink reservoir for reserving ink, wherein the ink reservoir is formed along the ink transfer roll so as to apply ink onto the ink transfer roll; an ink supply pipe for supplying ink from an ink container to the ink reservoir; an ink recovery pipe for recovering ink from the ink reservoir, or from an ink pool for temporarily pooling ink received from the ink reservoir, in an ink recovery direction directed toward the ink container; a cleaning water supply unit for supplying cleaning water to the ink reservoir; and a drain pipe for draining the cleaning water in the ink reservoir. The printing machine is configured to sequentially carry out a printing step of supplying ink to the ink reservoir to perform printing, an ink recovery step of, after completion of the printing step, recovering ink from the ink reservoir or from the ink reservoir and the ink pool, a first cleaning step of cleaning the ink reservoir by supplying cleaning water to the ink reservoir and draining the cleaning water from the ink reservoir via the drain pipe, and a second cleaning step of cleaning the ink supply pipe and the ink recovery pipe by supplying cleaning water to the ink supply pipe and the ink recovery pipe and draining the cleaning water from the ink supply pipe and the ink recovery pipe. In the third aspect of the present invention, the printing machine further comprises: a first restriction device for restricting a fluid communication state of the ink recovery pipe; a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply. The ink recovery pipe comprises: an inflow port for allowing ink from the ink reservoir or the ink pool to flow in the ink recovery pipe therethrough, wherein the inflow port is disposed at a position closer to one, first, machine frame of the pair of machine frames than a roll middle position in the rotational axis direction of the ink transfer roll; and an outflow port for allowing ink in the ink recovery pipe to flow out toward the ink container therethrough, wherein the outflow port is disposed at a position closer to the other, second, machine frame of the pair of machine frames than the roll middle position in the rotational axis direction of the ink transfer roll. The first restriction device is disposed at a disposition position of the inflow port of the ink recovery pipe, or a position downstream of the inflow port in the ink recovery direction. The first coupling part is coupled to the ink recovery pipe at a position downstream of the first restriction device in the ink recovery direction. Further, the first high-pressure air control device is configured to, in the printing step, stop the supply of the high-pressure air to the ink recovery pipe through the first coupling part, and, during a period during which at least the first cleaning step and the second cleaning step are carried out in a process from completion of the printing step to completion of the second cleaning step, supply the high-pressure air to the ink recovery pipe through the first coupling part, so as to recover ink in the ink recovery pipe and drain cleaning water in the ink recovery pipe.

In the third aspect of the present invention, the supply of cleaning water to the ink supply pipe and the ink recovery pipe may be attained by a configuration in which, when cleaning water is supplied to the ink reservoir by the cleaning water supply unit, the cleaning water flows from the ink reservoir into the ink supply pipe and the ink recovery pipe, or by a configuration in which a supply unit provided separately from the cleaning water supply unit supplies cleaning water the ink supply pipe and the ink recovery pipe.

The printing machine according to the third aspect of the present invention can be embodied in any of various configurations, in the same manner as the first aspect of the present invention and the specific embodiments thereof.

In the first aspect of the present invention as set forth in the appended claim 1, the ink recovery pipe comprises: an inflow port for allowing ink from the ink reservoir or the ink pool to flow in the ink recovery pipe therethrough, wherein the inflow port is disposed at a position closer to one, first, machine frame of the pair of machine frames than a roll middle position in the rotational axis direction of the ink transfer roll; and an outflow port for allowing ink in the ink recovery pipe to flow out toward the ink container therethrough, wherein the outflow port is disposed at a position closer to the other, second, machine frame of the pair of machine frames than the roll middle position in the rotational axis direction of the ink transfer roll. The first restriction device for restricting a fluid communication state of the ink recovery pipe is disposed at a disposition position of the inflow port of the ink recovery pipe, or a position downstream of the inflow port in the ink recovery direction. The first coupling part is coupled to the ink recovery pipe at a position downstream of the first restriction device in the ink recovery direction. The first high-pressure air control device is configured to stop the supply of the high-pressure air to the ink recovery pipe through the first coupling part, during a period during which ink is supplied to the ink reservoir via the ink supply pipe, and supply the high-pressure air to the ink recovery pipe through the first coupling part, after start of an ink recovery operation of recovering, via the ink recovery pipe, ink from the ink reservoir after completion of the supply of ink thereto, or an ink recovery operation of recovering, via the ink recovery pipe, ink from the ink reservoir after completion of the supply of ink thereto and the ink pool. Therefore, a large volume of high-pressure air can be supplied to the ink recovery pipe through the first coupling part. This makes it possible to recover residual ink in the ink recovery pipe quickly and reliably, even in a situation where the tank recovery pipe has a long length extending from a position close to the first machine frame to a position close to the second machine frame.

In the specific embodiment as set forth in the appended claim 2, the first high-pressure air control device is configured to supply the high-pressure air to the ink recovery pipe through the first coupling part, after an inside of the ink recovery pipe is changed from an ink filled state to an ink-air mixed state, in a process after the start of the ink recovery operation. Therefore, it possible to reduce an undesirable phenomenon that, when the high-pressure air is supplied to the ink recovery pipe in a situation where the inside of the ink recovery pipe is in the ink filled state, the supplied high-pressure air causes ink filled inside the ink recovery pipe to flow back toward the ink reservoir.

In the specific embodiment as set forth in the appended claim 3, the first tubing pump comprises a flexible tube coupled to the ink recovery pipe, and a rotor rotatable to compress the tube, wherein the fluid communication of the ink recovery pipe is shut off in a portion of the tube compressed by the rotor. Therefore, the fluid communication of the ink recovery pipe can be restricted or shut off by operating the rotor to compress the tube. This makes it possible to reduce an undesirable phenomenon that unnecessary atmospheric air flow in when the high-pressure air is supplied to the ink recovery pipe, and thus maintain the inside of the ink recovery pipe at high pressure.

In the specific embodiment as set forth in the appended claim 4, the first tubing pump is disposed on the first machine frame. The outflow port of the ink recovery pipe is disposed in a region adjacent to the second machine frame and outside the interspace region between the pair of machine frames. The ink recovery pipe has a pipe portion extending from the first tubing pump to the outflow port. The first coupling part is coupled to the ink recovery pipe at a position downstream of the first tubing pump in the ink recovery direction and closer to the first machine frame than the roll middle position in the rotational axis direction of the ink transfer roll. Therefore, the first coupling part through which the high-pressure air is supplied is disposed at a position close to the first machine frame on which the first tubing pump is disposed. This makes it possible to fully and reliably recover ink remaining inside a portion of the ink recovery pipe having a long length extending from the first tubing pump to the outflow port.

In the specific embodiment as set forth in the appended claim 5, the first coupling part comprises an opening-closing device, wherein the opening-closing control part is configured to control the opening-closing device to be placed in a closed state, thereby stopping the supply of the high-pressure air to the ink recovery pipe through the first coupling part, and to control the opening-closing device to be placed in an open state, thereby supplying the high-pressure air to the ink recovery pipe through the first coupling part. Therefore, it is possible to supply a large volume of high-pressure air to the ink recovery pipe in conjunction with open of the opening-closing device, as compared with a configuration for controlling drive and stop of the high-pressure air generation part.

In the specific embodiment as set forth in the appended claim 6, the ink supply pipe is configured to be used for recovering ink from the ink reservoir toward the ink container. The second restriction device is configured to restrict a fluid communication state of the ink supply pipe. The second high-pressure air control device is configured to stop the supply of the high-pressure air to the ink supply pipe through the second coupling part, during a period during which ink is recovered from the ink reservoir via the ink supply pipe, and supply the high-pressure air to the ink supply pipe through the second coupling part, after completion of an operation of recovering ink from the ink reservoir via the ink supply pipe. Therefore, it is possible to supply a large volume of high-pressure air to the ink supply pipe through the second coupling part. This makes it possible to quickly and reliably recover residual ink in the ink supply pipe.

In the specific embodiment as set forth in the appended claim 7, the path switching device coupled to the ink supply pipe is operable to switch a path between a first path providing fluid communication between the ink reservoir and the ink supply pipe, and a second path providing fluid communication between the second coupling part and the ink supply pipe. The switching control part is operable to control a state of the path switching device between a first state in which the second path is closed, and the first path is opened, and a second state in which the first path is closed, and the second path is opened. The switching control part is configured to control the state of the path switching device to be switched to the first state, thereby stopping the supply of the high-pressure air to the ink supply pipe through the second coupling part, and to control the state of the path switching device to be switched to the second state, thereby supplying the high-pressure air to the ink supply pipe through the second coupling part. Therefore, the state of the path switching device can be controllably switched to the second state in which the first path is closed, and the second path is opened, to shut off the fluid communication state of the ink supply pipe. This makes it possible to reduce an undesirable phenomenon that unnecessary atmospheric air flow in when the high-pressure air is supplied to the ink supply pipe, and thus maintain the inside of the ink supply pipe at high pressure.

In the specific embodiment as set forth in the appended claim 8, the ink supply pipe has a supply port for supplying ink to the ink reservoir therethrough, wherein the supply port is disposed at the roll middle position in the rotational axis direction of the ink transfer roll, or a position adjacent to the roll middle position. The second tubing pump is disposed at a position closer to the second machine frame than the supply port of the ink supply pipe, and configured to be selectively rotatable in normal and reverse directions and coupled to the ink supply pipe. The bypass path is coupled to the ink supply pipe while bypassing the second tubing pump. The bypass opening-closing device is configured to selectively open and close the bypass path. The second coupling part is coupled to the ink supply pipe at a position between the supply port of the ink supply pipe and the second tubing pump. The second high-pressure air control device is configured to, during the period during which ink is recovered from the ink reservoir via the ink supply pipe, stop the supply of the high-pressure air to the ink supply pipe through the second coupling part, while controlling rotation of the second tubing pump to be set to a rotational direction for recovering ink, and controlling the bypass opening-closing device to close the bypass path, and, after completion of the operation of recovering ink from the ink reservoir via the ink supply pipe, supply the high-pressure air to the ink supply pipe through the second coupling part, while stopping the rotation of the second tubing pump, and controlling the bypass opening-closing device to open the bypass path. Therefore, the bypass opening-closing device is controlled to open the bypass path when the high-pressure air is supplied to the ink supply pipe through the second coupling part. This makes it possible to allow the high-pressure air flowing in the ink supply pipe to smoothly flow through the ink supply pipe via the bypass path without being dammed by the second tubing pump.

In the second aspect of the present invention as set forth in the appended claim 9, the printing machine is configured to sequentially carry out a printing step of supplying ink to the ink reservoir to perform printing, an ink recovery step of, after completion of the printing step, recovering ink from the ink reservoir or from the ink reservoir and the ink pool, and a cleaning step of cleaning the ink reservoir by supplying cleaning water to the ink reservoir and draining the cleaning water via the drain pipe. The ink recovery pipe comprises: an inflow port disposed at a position closer to one, first, machine frame of the pair of machine frames than a roll middle position in the rotational axis direction of the ink transfer roll; and an outflow port disposed at a position closer to the other, second, machine frame of the pair of machine frames than the roll middle position in the rotational axis direction of the ink transfer roll. The first restriction device for restricting a fluid communication state of the ink recovery pipe is disposed at a disposition position of the inflow port of the ink recovery pipe, or a position downstream of the inflow port in the ink recovery direction. The first coupling part is coupled to the ink recovery pipe at a position downstream of the first restriction device in the ink recovery direction. The first high-pressure air control device is configured to, in the printing step, stop the supply of the high-pressure air to the ink recovery pipe through the first coupling part, and, during a period during which at least the cleaning step is carried out after completion of the printing step, supply the high-pressure air to the ink recovery pipe through the first coupling part, so as to recover ink in the ink recovery pipe. Therefore, a large volume of high-pressure air can be supplied to the ink recovery pipe through the first coupling part. This makes it possible to recover residual ink in the ink recovery pipe quickly and reliably, even in a situation where the tank recovery pipe has a long length extending from a position close to the first machine frame to a position close to the second machine frame. Further, the high-pressure air is supplied to the ink recovery pipe through the first coupling part, during the period during which at least the cleaning step is carried out. This makes it possible to set a duration of the cleaning step to a relatively long time period enough to reliably recover residual ink in the ink recovery pipe, without retarding a start time point of the cleaning step.

In the specific embodiment as set forth in the appended claim 10, the ink supply pipe is configured to be used for recovering ink from the ink reservoir toward the ink container. The second restriction device is configured to restrict a fluid communication state of the ink supply pipe. The second high-pressure air control device is configured to, in the printing step, stop the supply of the high-pressure air to the ink supply pipe through the second coupling part, and, during a period during which at least the cleaning step is carried out after completion of the printing step, supply the high-pressure air to the ink supply pipe through the second coupling part, so as to recover ink in the ink supply pipe. Therefore, a large volume of high-pressure air can be supplied to the ink supply pipe through the second coupling part. This makes it possible to recover residual ink in the ink supply pipe quickly and reliably. Further, the high-pressure air is supplied to the ink supply pipe through the second coupling part, during the period during which at least the cleaning step is carried out. This makes it possible to set the duration of the cleaning step to a relatively long time period enough to reliably recover residual ink in the ink supply pipe, without retarding the start time point of the cleaning step.

In the third aspect of the present invention as set forth in the appended claim 11, the printing machine is configured to sequentially carry out a printing step of supplying ink to the ink reservoir to perform printing, an ink recovery step of, after completion of the printing step, recovering ink from the ink reservoir or from the ink reservoir and the ink pool, a first cleaning step of cleaning the ink reservoir by supplying cleaning water to the ink reservoir and draining the cleaning water from the ink reservoir via the drain pipe, and a second cleaning step of cleaning the ink supply pipe and the ink recovery pipe by supplying cleaning water to the ink supply pipe and the ink recovery pipe and draining the cleaning water from the ink supply pipe and the ink recovery pipe. The ink recovery pipe comprises: an inflow port disposed at a position closer to one, first, machine frame of the pair of machine frames than a roll middle position in the rotational axis direction of the ink transfer roll; and an outflow port disposed at a position closer to the other, second, machine frame of the pair of machine frames than the roll middle position in the rotational axis direction of the ink transfer roll. The first coupling part is coupled to the ink recovery pipe at a position downstream of the first restriction device in the ink recovery direction. The first high-pressure air control device is configured to, in the printing step, stop the supply of the high-pressure air to the ink recovery pipe through the first coupling part, and, during a period during which at least the first cleaning step and the second cleaning step are carried out in a process from completion of the printing step to completion of the second cleaning step, supply the high-pressure air to the ink recovery pipe through the first coupling part, so as to recover ink in the ink recovery pipe and drain cleaning water in the ink recovery pipe. Therefore, a large volume of high-pressure air can be supplied to the ink recovery pipe through the first coupling part during a period during which at least the first cleaning step is carried out. This makes it possible to recover residual ink in the ink recovery pipe quickly and reliably, even in a situation where the tank recovery pipe has a long length extending from a position close to the first machine frame to a position close to the second machine frame. Further, a large volume of high-pressure air can be supplied to the ink recovery pipe through the first coupling part during a period during which at least the second cleaning step is carried out. This makes it possible to recover residual ink in the ink recovery pipe quickly and reliably, even in the situation where the tank recovery pipe has a long length extending from a position close to the first machine frame to a position close to the second machine frame.

DETAILED DESCRIPTION OF THE PREFERRED EMBODIMENTS

<Embodiment>

Figure 1:
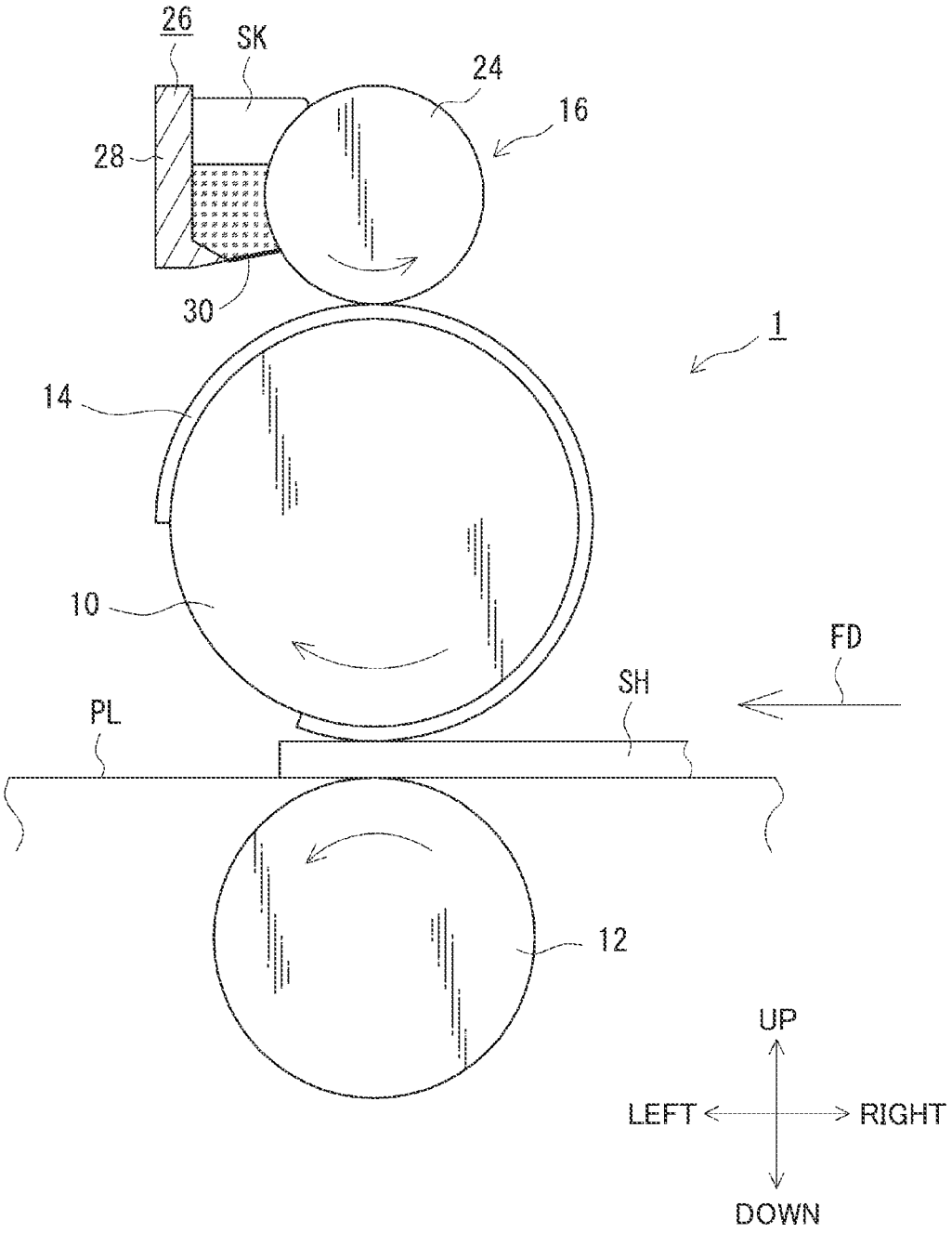
FIG. 1 is a front view showing a corrugated paperboard sheet printing machine 1 according to one embodiment of the present invention.
Figure 2:
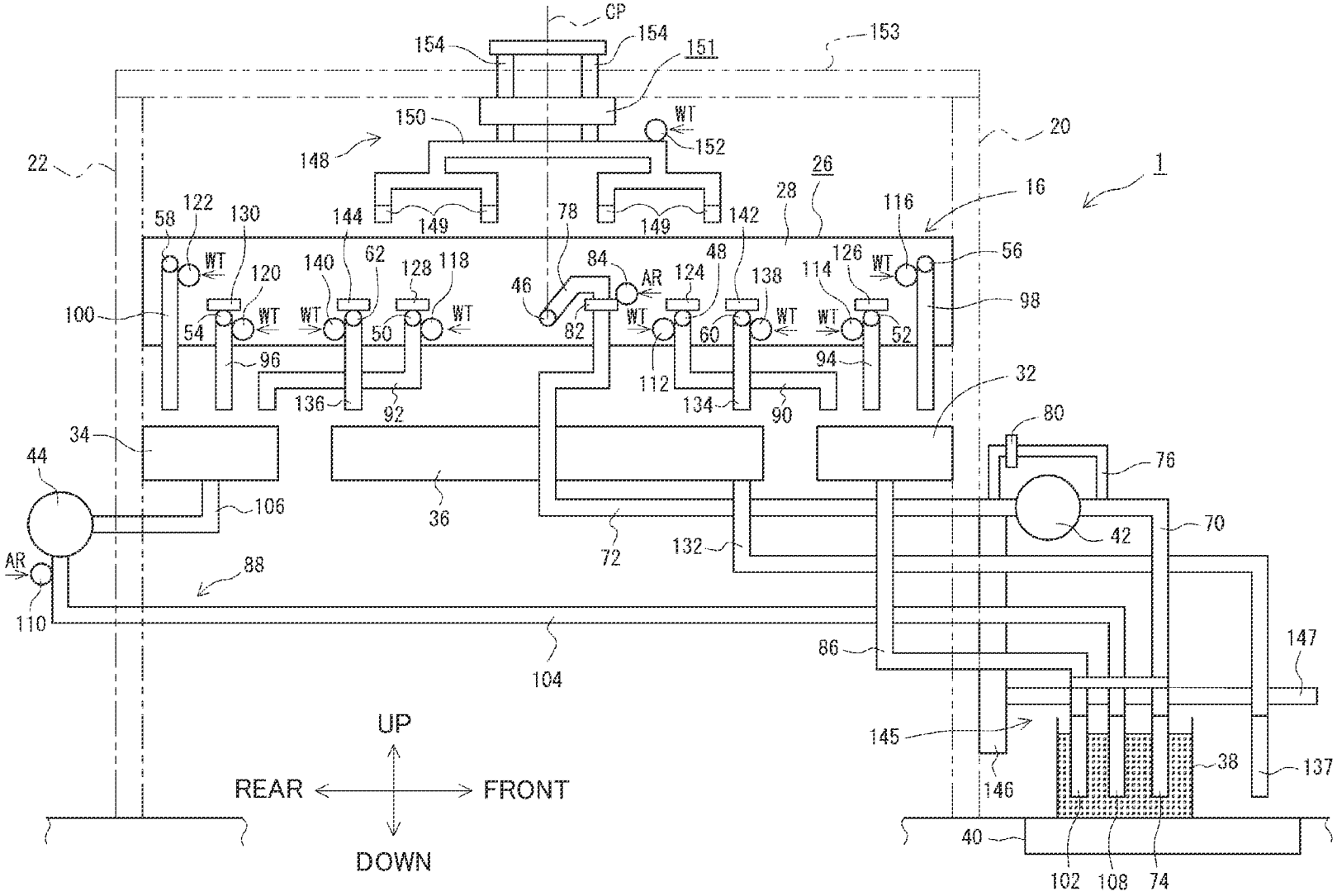
FIG. 2 is a schematic configuration diagram showing an ink and cleaning water piping configuration in the corrugated paperboard sheet printing machine 1, when viewed from the left side thereof.
Figure 4:
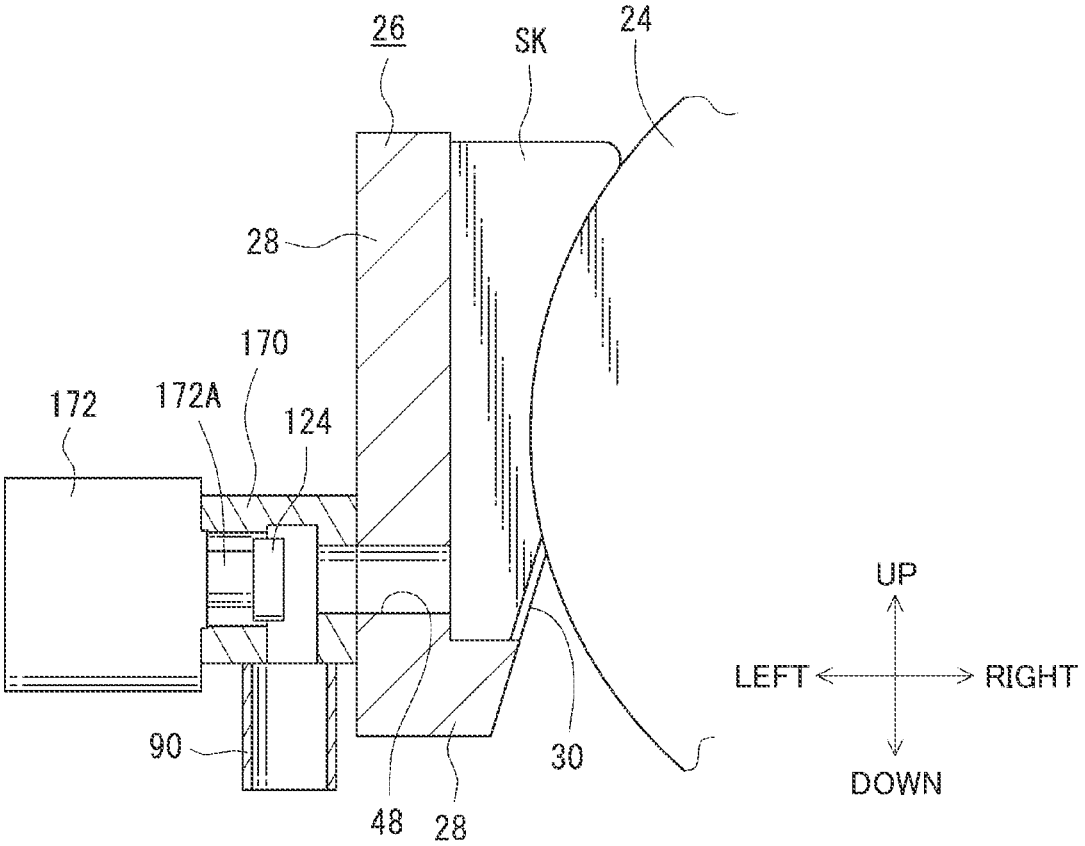
FIG. 4 is a sectional view showing the configuration of a coupling port value 124 and surrounding members.

With reference to the drawings, a corrugated paperboard sheet printing machine according to one embodiment of the present invention will now be described. A corrugated paperboard sheet printing machine is generally known as a printing machine for use in a corrugated paperboard box making machine. The corrugated paperboard box making machine comprises: a sheet feeding apparatus for feeding corrugated paperboard sheets toward a conveyance path one-by-one; a conveyance apparatus for conveying each corrugated paperboard sheet fed from the sheet feeding apparatus, along the conveyance path; and a plurality of processing units arranged along the conveyance path to sequentially process each corrugated paperboard sheet being conveyed. The corrugated paperboard box making machine is equipped with a corrugated paperboard sheet printing machine, as one processing unit among the processing units. A basic configuration of such a corrugated paperboard sheet printing machine has heretofore been known as disclosed in, e.g., JP-A 2014-030950. FIG. 1 is a front view showing a corrugated paperboard sheet printing machine 1 according to one embodiment of the present invention, when viewed from the front side thereof. In FIG. 1, directions indicated by the double arrowed lines are, respectively, an up-down direction and a right-left direction, and a direction orthogonal to the two directions is a front-rear direction. The right-left direction corresponds to a conveyance direction FD along which a corrugated paperboard sheet SH is conveyed in FIG. 1. In FIGS. 2 and 4, directions will be indicated in accordance with those indicated in FIG. 1.

[Mechanical Configuration of Corrugated Paperboard Sheet Printing Machine 1]

Mainly with reference to FIGS. 1 and 2, a mechanical configuration of the corrugated paperboard sheet printing machine 1 will be described. FIG. 2 is a schematic configuration diagram showing an ink and cleaning water piping configuration in the corrugated paperboard sheet printing machine 1, when viewed from the left side thereof. In FIG. 1, in order to subject the corrugated paperboard sheet SH being conveyed to printing, the corrugated paperboard sheet printing machine 1 mainly comprises a printing cylinder 10, a press roll 12, a printing plate 14, and an ink application device 16. The printing cylinder 10 is disposed at a position opposed to the press roll 12 across a conveyance path PL. The printing plate 14 is windingly attached to an outer peripheral surface of the printing cylinder 10. The ink application device 16 is configured to apply ink onto the printing plate 14 windingly attached to the printing cylinder 10. In FIG. 2, the corrugated paperboard sheet printing machine 1 comprises a front machine frame 20 and a rear machine frame 22. Each of the printing cylinder 10 and the press roll 12 are rotatably supported by the front machine frame 20 and the rear machine frame 22. The ink application device 16 is supported by a heretofore-known support mechanism in a contactable and separable manner with respect to the printing cylinder 10.

The ink application device 16 mainly comprises an anilox roll 24 serving as an ink transfer roll, and an ink reservoir 26. The anilox roll 24 is rotatably supported by the front machine frame 20 and the rear machine frame 22, such that it extends therebetween in the front-rear direction. That is, a rotational axis direction of the anilox roll 24 extends in the front-rear direction. The ink reservoir 26 comprises a chamber frame 28, a doctor blade 30, and a pair of ink damming plates. The chamber frame 28 is supported between the front machine frame 20 and the rear machine frame 22, such that it extends therebetween in the front-rear direction. The doctor blade 30 is fixed to the chamber frame 28, such that a distal end thereof is kept in contact with an outer peripheral surface of the anilox roll 24. The pair of ink damming plates are fixed to the chamber frame 28, such that they are kept in contact, respectively, with front-rear directional opposite edges of each of the anilox roll 24 and the doctor blade 30. A space SK for reserving ink is a space defined by the outer peripheral surface of the anilox roll 24, the chamber frame 28, the doctor blade 30, and the pair of ink damming plates, to elongatedly extend in the front-rear direction.

<Ink and Cleaning Water Piping Configuration in Corrugated Paperboard Sheet Printing Machine 1>

With reference to FIG. 2, an ink and cleaning water piping configuration in the corrugated paperboard sheet printing machine 1 will be described. The ink reservoir 26 is disposed between the front machine frame 20 and the rear machine frame 22, to elongatedly extend in the front-rear direction. A pair of ink pans 32, 34 and a cleaning water pan 36 are disposed beneath the ink reservoir 26. The ink pan 32 is located adjacent to the front machine frame 20, and fixed to the front machine frame 20. The ink pan 34 is located adjacent to the front machine frame 22, and fixed to the rear machine frame 22. The cleaning water pan 36 is fixed to a non-illustrated beam member bridged between the two ink pans 32, 34, and disposed between the two ink pans 32, 34.

An ink can 38 serving as an ink container is disposed on the front side of the front machine frame 20 at a position adjacent to the front machine frame 20. In order to drain cleaning water, a drain channel 40 is buried under a floor on which the corrugated paperboard sheet printing machine 1 is installed, in a region on the front side of the front machine frame 20. An ink supply pump 42 is fixed to a front surface of the front machine frame 20. An ink recovery pump 44 is fixed to a rear surface of the rear machine frame 22. The ink supply pump 42 is configured to be rotated in a normal direction (normally rotated) to supply ink, and rotated in a reverse direction (reversely rotated) to recover ink. The ink recovery pump 44 is configured to be constantly rotated in a reverse direction for recovering ink.

The chamber frame 28 has nine coupling ports 46, 48, 50, 52, 54, 56, 58, 60, 62. The coupling port 46 for supplying ink is formed in a lower portion of the chamber frame 28 at a front-rear directional middle position CP of the chamber frame 28. The coupling port 46 is disposed at a position very close to the bottom of the ink reservoir 26 to allow ink to flow out through the coupling port 46 as much as possible during recovery of ink from the ink reservoir 26. The four coupling ports 48, 60, 52, 56 are formed in the chamber frame 28 at respective positions between the middle position CP and the front machine frame 20, and the four coupling orts 50, 62, 54, 58 are formed in the chamber frame 28 at respective positions between the middle position CP and the rear machine frame 22. Each of the coupling ports 48, 60, 52, 50, 62, 54 is disposed at the same height position (up-down directional position) as that of the coupling port 46. Each of the coupling ports 48, 50 is disposed at a position closer to the coupling port 46 than each of the coupling ports 52, 54. The coupling port 60 is disposed between the coupling ports 48, 52, and the coupling port 62 is disposed between the coupling ports 50, 54. The coupling port 56 is disposed in an upper portion of the chamber frame 28 at a position adjacent to the front machine frame 20 and at a given height position. The coupling port 58 is disposed in the upper portion of the chamber frame 28 at a position adjacent to the rear machine frame 22 and at the same height position as that of the coupling port 56.

(Ink Supply Piping Configuration)

In order to supply ink from the ink can 38 to the ink reservoir 26, ink supply pipes 70, 72 are prepared. The ink supply pipe 70 is provided between the ink can 38 and the ink supply pump 42, and the ink supply pipe 72 is provided between the ink supply pump 42 and the coupling port 46. One end of the ink supply pipe 70 is coupled to the ink supply pump 42, and the other end of the ink supply pipe 70 is coupled to an opening nozzle 74. One end of the ink supply pipe 72 is coupled to the ink supply pump 42, and the other end of the ink supply pipe 72 is coupled to the coupling port 46. A bypass pipe 76 is coupled to each of the two ink supply pipes 70, 72 to bypass the ink supply pump 42.

The ink supply pipe 72 has a rising slope portion 78 at a position adjacent to the end coupled to the coupling port 46. The rising slope portion 78 extends obliquely upwardly from the height position of the coupling port 46 up to a position higher than the coupling port 46. A bypass solenoid valve 80 is coupled to the bypass valve 76, and configured to selectively opened and closed so as to switch between communication and shutoff of the bypass pipe 76 with respect to the two ink supply pipes 70, 72. A three-way switching solenoid valve 82 is coupled to the ink supply pipe 72 at a position between the rising slope portion 78 and the ink supply pump 42 and adjacent to the top of the rising slope portion 78. Further, the three-way switching solenoid valve 82 is coupled to a high-pressure air supply solenoid valve 84. The three-way switching solenoid valve 82 is configured to switch between a flow path providing fluid communication between the connection port 46 and the ink supply pump 42 and a flow path providing fluid communication between the high-pressure air supply solenoid valve 84 and the ink supply pump 42. The high-pressure air supply solenoid valve 84 is configured to selectively opened and closed so as to switch between supply and stop of high-pressure air AR with respect to the ink supply pipe 72.

(Ink Recovery Piping Configuration)

In order to recover ink into the ink can 38, a front ink recovery pipe 86, a rear ink recovery pipe 88, a pair of long auxiliary ink recovery pipes 90, 92, a pair of short auxiliary ink recovery pipes 94, 96, and a pair of surplus ink recovery pipes 98, 100, are prepared. The front ink recovery pipe 86 is provided between the ink pan 32 and the ink can 38. One end of the front ink recovery pipe 86 is coupled to the ink pan 32, and the other end of the front ink recovery pipe 86 is coupled to an opening nozzle 102.

The rear ink recovery pipe 88 comprises a main ink recovery pipe 104 and a coupling recovery pipe 106. The main ink recovery pipe 104 is provided between the ink recovery pump 44 and the ink can 38. One end of the main ink recovery pipe 104 is coupled to the ink recovery pump 44, and the other end of the main ink recovery pipe 104 is coupled to an opening nozzle 108. A high-pressure air supply solenoid valve 110 is coupled to the main ink recovery pipe 104 at a position adjacent to the ink recovery pump 44. The high-pressure air supply solenoid valve 110 is configured to be selectively opened and closed so as to switch between supply and stop of high-pressure air AR with respect to the main ink recovery pipe 104. One end of the coupling recovery pipe 106 is coupled to the ink pan 34, and the other end of the coupling recovery pipe 106 is coupled to the ink recovery pump 44.

The long auxiliary ink recovery pipe 90 is provided between the coupling port 48 and the ink pan 32. One end of the long auxiliary ink recovery pipe 90 is coupled to the coupling port 48, and the other end of the long auxiliary ink recovery pipe 90 is disposed to face an upper opening of the ink pan 32. The short auxiliary ink recovery pipe 94 is provided between the coupling port 52 and the ink pan 32. One end of the short auxiliary ink recovery pipe 94 is coupled to the coupling port 52, and the other end of the short auxiliary ink recovery pipe 94 is disposed to face the upper opening of the ink pan 32. The surplus ink recovery pipe 98 is provided between the coupling port 56 and the ink pan 32. One end of the surplus ink recovery pipe 98 is coupled to the coupling port 56, and the other end of the surplus ink recovery pipe 98 is disposed to face the upper opening of the ink pan 32.

The long auxiliary ink recovery pipe 92 is provided between the coupling port 50 and the ink pan 34. One end of the long auxiliary ink recovery pipe 92 is coupled to the coupling port 50, and the other end of the long auxiliary ink recovery pipe 92 is disposed to face an upper opening of the ink pan 34. The short auxiliary ink recovery pipe 96 is provided between the coupling port 54 and the ink pan 34. One end of the short auxiliary ink recovery pipe 96 is coupled to the coupling port 54, and the other end of the short auxiliary ink recovery pipe 96 is disposed to face the upper opening of the ink pan 34. The surplus ink recovery pipe 100 is provided between the coupling port 58 and the ink pan 34. One end of the surplus ink recovery pipe 100 is coupled to the coupling port 58, and the other end of the surplus ink recovery pipe 100 is disposed to face the upper opening of the ink pan 34.

Three cleaning water supply solenoid valves 112, 114, 116 are coupled, respectively, to the long auxiliary ink recovery pipe 90, the short auxiliary ink recovery pipe 94 and the surplus ink recovery pipe 98, at respective positions adjacent to the coupling ports 48, 52, 56. Each of the cleaning water supply solenoid valves 112, 114, 116 is configured to be selectively opened and closed so as to switch between supply and stop of cleaning water WT with respect to a corresponding one of the long auxiliary ink recovery pipe 90, the short auxiliary ink recovery pipe 94 and the surplus ink recovery pipe 98.

Three cleaning water supply solenoid valves 118, 120, 122 are coupled, respectively, to the long auxiliary ink recovery pipe 92, the short auxiliary ink recovery pipe 96 and the surplus ink recovery pipe 100, at respective positions adjacent to the coupling ports 50, 54, 58. Each of the cleaning water supply solenoid valves 118, 120, 122 is configured to be selectively opened and closed so as to switch between supply and stop of cleaning water WT with respect to a corresponding one of the long auxiliary ink recovery pipe 92, the short auxiliary ink recovery pipe 96 and the surplus ink recovery pipe 100.

Two coupling port valves 124, 126 are disposed to selectively open and close the coupling ports 48, 52, respectively. Further, two coupling port valves 128, 130 are disposed to selectively open and close the coupling ports 50, 54, respectively. Each of the coupling port valves 124, 126, 128, 130 is actuated by the after-mentioned air cylinder.

(Cleaning Water Drain Piping Configuration)

In order to drain cleaning water to the drain channel 40, a main drain pipe 132 and a pair of auxiliary drain pipes 134, 136 are prepared. The main drain pipe 132 is provided between the cleaning water pan 36 and the drain channel 40. One end of the main drain pipe 132 is coupled to the cleaning water pan 36, and the other end of the main drain pipe 132 is coupled to an opening nozzle 137. A distal end of the opening nozzle 137 is disposed to face the drain channel 40.

The auxiliary drain pipe 134 is provided between the coupling port 60 and the cleaning water pan 36. One end of the auxiliary drain pipe 134 is coupled to the coupling port 60, and the other end of the auxiliary drain pipe 134 is disposed to face an upper opening of the cleaning water pan 36. The auxiliary drain pipe 136 is provided between the coupling port 62 and the cleaning water pan 36. One end of the auxiliary drain pipe 136 is coupled to the coupling port 62, and the other end of the auxiliary drain pipe 136 is disposed to face the upper opening of the cleaning water pan 36.

Two cleaning water supply solenoid valves 138, 140 are coupled, respectively, to the auxiliary drain pipes 134, 136 at respective positions adjacent to the coupling ports 60, 62. Each of the cleaning water supply solenoid valves 138, 140 is configured to be selectively opened and closed so as to switch between supply and stop of cleaning water WT with respect to a corresponding one of the auxiliary drain pipes 134, 136.

Two coupling port valves 142, 144 are disposed to selectively open and close the coupling ports 60, 62, respectively. Each of the coupling port valves 142, 144 is actuated by the after-mentioned air cylinder.

(Configuration of Movement Mechanism for Opening Nozzles 74, 102, 108)

In order to move the opening nozzles 74, 102, 108 in the up-down direction and in the front-rear direction, a movement mechanism 145 is provided on the front machine frame 20. The movement mechanism 145 has a heretofore-known configuration which comprises an up-down guide member 146 and a front-rear guide member 147, wherein it is operable to integrally move the opening nozzles 74, 102, 108 along each of the two guide members 146, 147. Based on operation of the movement mechanism 145, the opening nozzles 74, 102, 108 can be moved to any one of a lowered position where they are lowered (moved downwardly) until entering the inside of the ink can 38, a raised position where they are raised (moved upwardly) until being located above and in spaced-apart relation to the ink can 38, and a drain position where they are moved forwardly from the position above the ink can 38 to a position facing the drain channel 40.

(Configuration of Injection Unit 148)

In order to inject cleaning water into the ink reservoir 26, an injection unit 148 is disposed just above the ink reservoir 26. The injection unit 148 comprises four injection nozzles 149, a cleaning water supply pipe 150, and a movement mechanism 151. The four injection nozzles 149 are arranged in spaced-apart relation to each other in the front-rear direction. The cleaning water supply pipe 150 is coupled to the set of four injection nozzles 149 and coupled to an injection nozzle solenoid valve 152. The injection nozzle solenoid valve 152 is configured to be selectively opened and closed so as to switch between supply and stop of cleaning water WT with respect to the cleaning water supply pipe 150.

The movement mechanism 151 has a heretofore-known configuration which comprises a front-rear guide member 153 and an up-down guide member 154, wherein it is operable to integrally move the four injection nozzles 149 and the cleaning water supply pipe 150 along each of the two guide members 153, 154. The front-rear guide member 153 is bridged between the front machine frame 20 and the rear machine frame 22. Based on operation of the movement mechanism 151, the four injection nozzles 149 can be moved to one of a lowered position where they are lowered (moved downwardly) to inject the cleaning water WT toward the ink reservoir 26, and a raised position where they are raised (moved upwardly) to stand by at a position just above the ink reservoir 26. Further, after being moved to the lowered position, the four injection nozzles 149 can be moved along the ink reservoir 26 reciprocatingly in the front-rear direction, based on operation of the movement mechanism 151.

(Configuration of Each of Ink Supply Pump 42 and Ink Recovery Pump 44)

Figure 3:
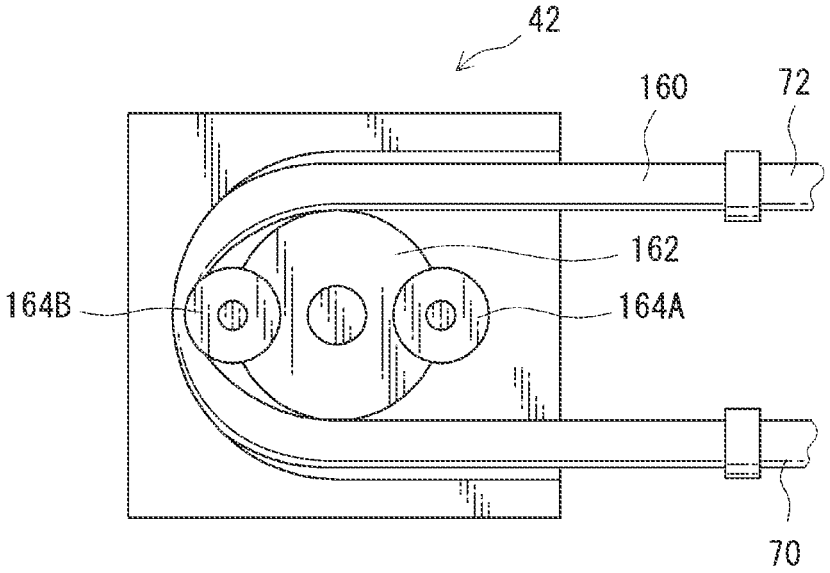
FIG. 3 is a schematic diagram showing the configuration of an ink supply pump 42.

With reference to FIG. 3, the configuration of each of the ink supply pump 42 and the ink recovery pump 44 will be described. Since the ink supply pump 42 and the ink recovery pump 44 have the same configuration, the following description will be made by taking the ink supply pump 42 as an example. The ink supply pump 42 is composed of a tubing pump which comprises a flexible pipe 160, a rotor 162, and two pressing roller 164A, 164B. The flexible pipe 160 is formed of an elastic tube such as a rubber tube, and coupled to each of the ink supply pipes 70, 72. The two pressing rollers 164A, 164B are rotatably supported by the rotor 162. The rotor 162 is rotated by a pump driving motor. Along with the rotation of the rotor 162, the two pressing rollers 164A, 164B are moved to press and compress the flexible pipe 160. Thus, the flexible pipe 160 is repeatedly compressed, so that transportation of ink or cleaning water is carried out between the ink supply pipes 70, 72. When the rotation of the rotor 162 is stopped, it is possible to keep a state in which at least one of the two pressing roller 164A, 164B compresses the flexible tube 160, and thereby attain a state in which fluid communication between the ink supply pipes 70, 72 is shut off. A basic configuration of the tubing pump has heretofore been known as disclosed in, e.g., JP-A 2007-045125. As with the ink supply pump 42, the ink recovery pump 44 is also composed of a tubing pump, wherein a flexible pipe is coupled to each of the main ink recovery pipe 104 and the coupling recovery pipe 106.

(Detailed Configuration of each of Coupling Port Valves 124, 126, 128, 130, 142, 144)

With reference to FIG. 4, the detailed configuration of each of the coupling port valves 124, 126, 128, 130, 142, 144 will be described. Since the coupling port valves 124, 126, 128, 130, 142, 144 have the same configuration, the following description will be made by taking the coupling port valve 124 as an example. A coupling block 170 is fixed to the chamber frame 28 so as to couple the coupling port 48 of the chamber frame 28 and the long auxiliary ink recovery pipe 90 together. A coupling port valve air cylinder 172 is fixed to the coupling block 170. The coupling port valve 124 is fixed to an actuating rod 172A of the coupling port valve air cylinder 172. Based on actuation of the coupling port valve air cylinder 172, the coupling port valve 124 can be moved to one of a closed position where it closes the coupling port 48, and an opened position where it opens the coupling port 48. When the coupling port valve 124 is located at the opened position, a state appears in which the coupling port 48 is communicated with the long auxiliary ink recovery pipe 90. As with the coupling port valve 124, each of the other coupling port valves 126, 128, 130, 142, 144 is also configured to selectively open and close a corresponding one of the coupling ports 50, 52, 54, 60, 62, based on actuation of a corresponding coupling port valve air cylinder.

[Electrical Configuration of Corrugated Paperboard Sheet Printing Machine 1]

Figure 5:
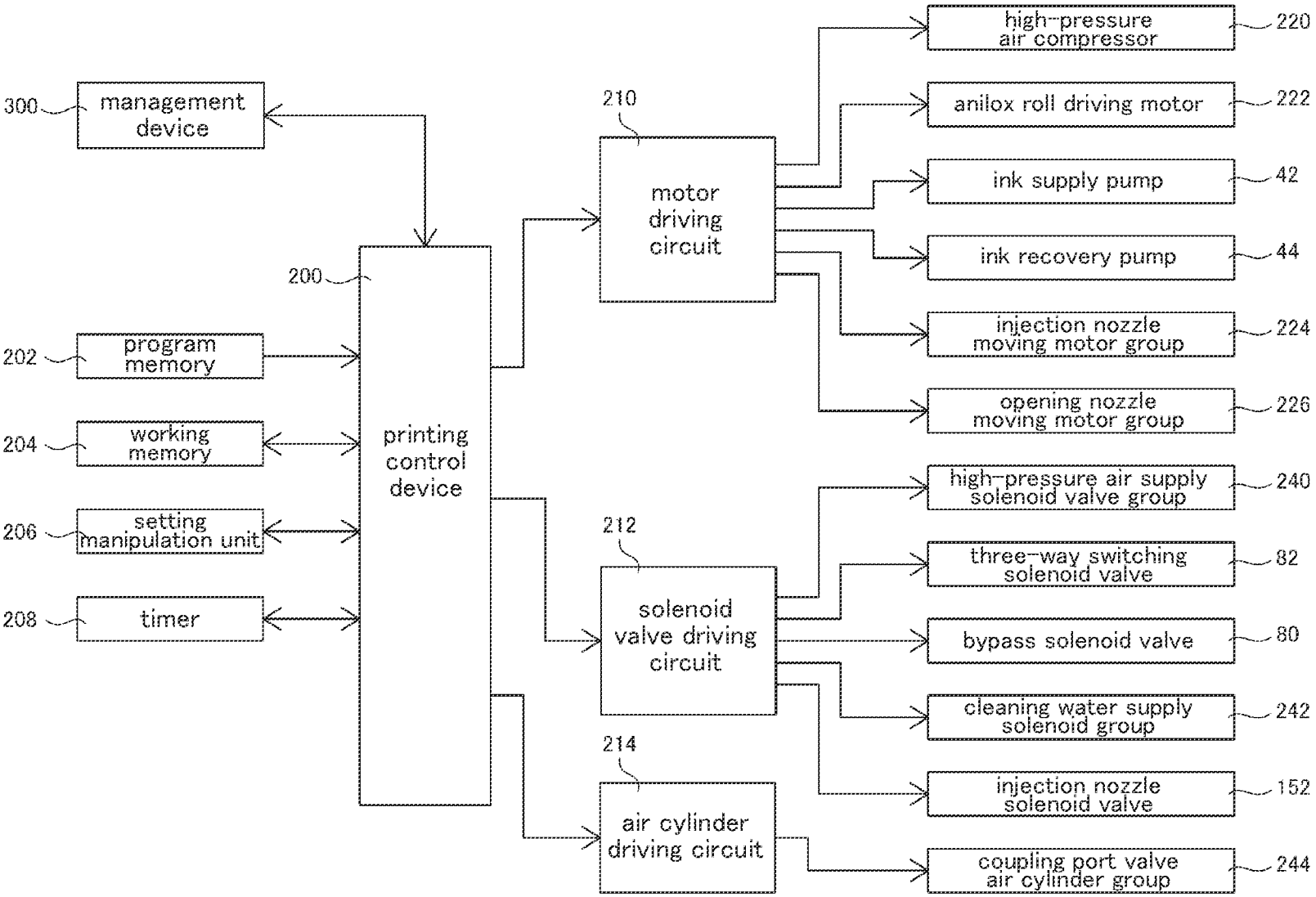
FIG. 5 is a block diagram showing an electrical configuration of the corrugated paperboard sheet printing machine 1.

With reference to FIG. 5, an electrical configuration of the corrugated paperboard sheet printing machine 1 will be described. FIG. 5 is a block diagram showing the electrical configuration of the corrugated paperboard sheet printing machine 1. In FIG. 5, the corrugated paperboard sheet printing machine 1 comprises a printing control device 200 for generally controlling printing operations. The printing control device 200 is operable to receive control information for executing each order, from a management device 300 for managing the operation of the entire corrugated paperboard box making machine, and execute a printing sequence regarding each order, according to the control information. The printing control device 200 is also operable to execute an ink recovery sequence, and a cleaning sequence, after completion of the execution of the printing sequence. The control information to be sent from the management device 300 includes the number of corrugated paperboard sheets to be processed in each order, a conveyance speed of the corrugated paperboard sheets, and information indicative of an instruction about an order change. After the instruction about an order change is issued, in the corrugated paperboard sheet printing machine 1, the type of ink such as the color of ink is changed to one for the next order.

Figure 6:
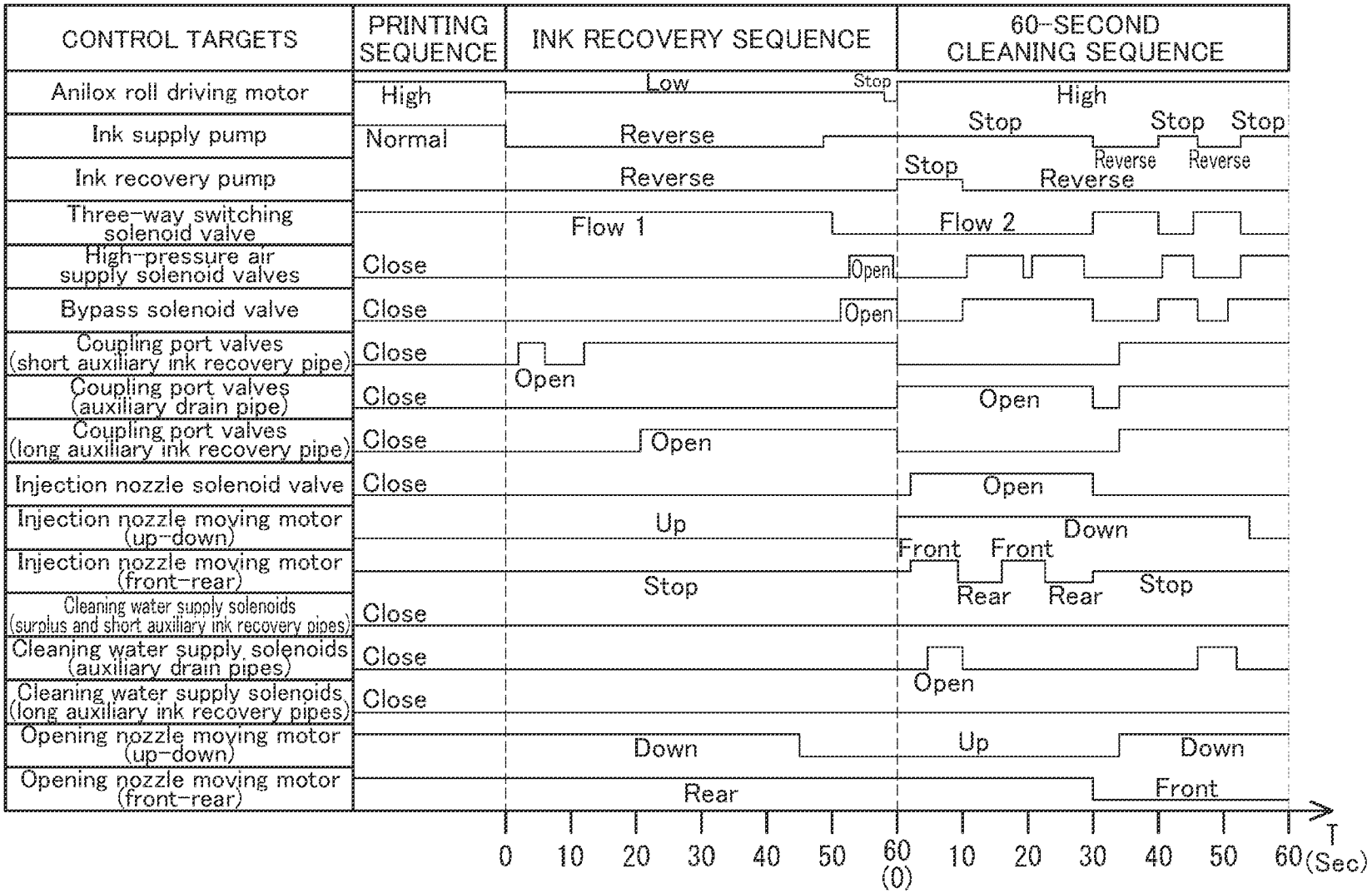
FIG. 6 is a sequence chart showing a printing sequence, an ink recovery sequence and a 60-second cleaning sequence in the corrugated paperboard sheet printing machine 1.
Figure 7:
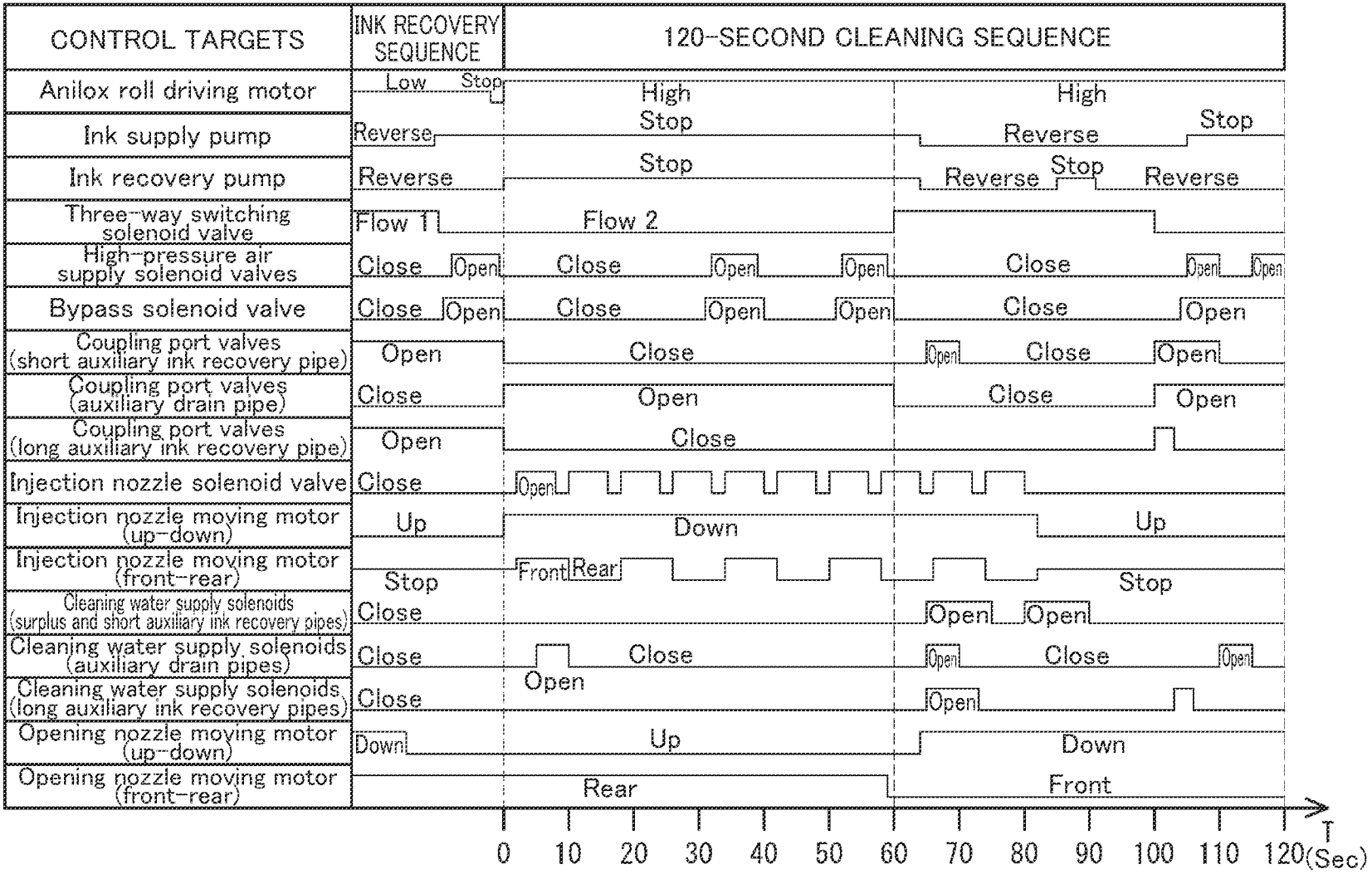
FIG. 7 is a sequence chart showing a 120-second cleaning sequence in the corrugated paperboard sheet printing machine 1.

The printing control device 200 is electrically connected to each of a program memory 202, a working memory 204, a setting manipulation unit 206, and a timer 208. The program memory 202 is a non-volatile memory storing therein various programs including: a main routine program for sequentially executing a printing sequence, an ink recovery sequence and a cleaning sequence as shown in FIGS. 6 and 7; a subroutine program for executing a 60-second cleaning sequence as shown in FIG. 6; and a subroutine program for executing a 120-second cleaning sequence as shown in FIG. 7, and further storing therein various set values. The working memory 204 is a memory for temporarily storing therein the control information from the management device 300, a result of computational processing made by the printing control device 200, information set through the setting manipulation unit 206.

The setting manipulation unit 206 has a heretofore-known configuration comprising a touch panel, a display and manipulation keys. The setting manipulation unit 206 comprises a manipulation part for allowing an operator to select and set one of the 60-second cleaning sequence and the 120-second cleaning sequence, and a manipulation part for allowing an operator to start the ink recovery sequence. The setting manipulation unit 206 also comprises a manipulation part for allowing an operator to adjust a parameter such as an operation duration of a control target in the ink recovery sequence and the cleaning sequence. Information set through manipulation of the setting manipulation unit 206 is temporarily stored in the working memory 206, whereafter it is read from the working memory 206 and used to execute each sequence.

The timer 208 is operable to measure an elapsed time from a time point when each of the ink recovery sequence and the cleaning sequence is started, and send information regarding the elapsed time to the printing control device 200. The printing control device 200 is operable to refer to the information sent from the timer 208 to read, from a running one of the programs, instructions to be executed at a time point after each elapsed time, etc., and send the read information to each driving circuit such as the after-mentioned motor driving circuit 210.

The printing control device 200 is electrically connected to each of a motor driving circuit 210, a solenoid valve driving circuit 212, and an air cylinder driving circuit 214. The motor driving circuit 210 is operable, according to a motor control instruction from the printing control device 200, to control the rotational speed, the rotational direction, and the switching between rotation and stop of each of various driving motors. The solenoid valve driving circuit 212 is operable, according to a solenoid opening-closing control instruction from the printing control device 200, to control the opening and closing of each of various solenoid valves. The air cylinder driving circuit 214 is operable, according to a coupling port valve switching control instruction from the printing control device 200, to control the switching between actuation and non-actuation of each of various air cylinders.

The motor driving circuit 210 is electrically connected to each of a high-pressure air compressor 220, an anilox roll driving motor 222, the ink supply pump 42, the ink recovery pump 44, an injection nozzle moving motor group 224, and an opening nozzle moving motor group 226. The high-pressure air compressor 220 is operable to generate high pressure AR, and supply the high pressure AR to each of the high-pressure air supply solenoid valves 84, 110. The high-pressure air AR to be generated by the high-pressure air compressor 220 has a pressure capable of pushing out ink remaining in each of the ink supply pipes 70, 72 and the main ink recovery pipe 104, toward the ink can 38, in the ink recovery sequence and the cleaning sequence. The pressure of the high-pressure air AR is set through experiments to satisfy a condition that it can push out ink or cleaning water existing in each of the ink supply pipes 70, 72 and the main ink recovery pipe 104 (it is not excessively low), and a condition that ink or cleaning water ejected from each of the opening nozzles 74, 108 does not scatter around (it is not excessively high). In this embodiment, the pressure of the high-pressure air AR is set to about 0.2 MPa (Mega-Pascal).

The anilox roll driving motor 222 is a driving motor for rotating the anilox roll 24. The anilox roll driving motor 222 is configured to be rotated at a rotational speed appropriate to an operation sequence such as the printing sequence. Each of the ink supply pump 42 and the ink recovery pump 44 comprises a driving motor for rotating a rotor, wherein the driving motor of each of the pumps 42, 44 is driven by the motor driving circuit 210. The injection nozzle moving motor group 224 comprises a front-rear movement motor for moving the injection nozzles 149 reciprocatingly in the front-rear direction, and an up-down movement motor for moving the injection nozzles 149 in the up-down direction between the lowered position and the raised position. The opening nozzle moving motor group 226 comprises a front-rear movement motor for moving the opening nozzles 74, 102, 108 in the front-rear direction, and an up-down movement motor for moving the opening nozzles 74, 102, 108 in the up-down direction between the lowered position and the raised position.

The solenoid valve driving circuit 212 is electrically connected to each of a high-pressure air supply solenoid valve group 240, the three-way switching solenoid valve 82, the bypass solenoid valve 80, a cleaning water supply solenoid group 242, and the injection nozzle solenoid valve 152. The high-pressure air supply solenoid valve group 240 comprises the two the high-pressure air supply solenoid valves 84, 110. The cleaning water supply solenoid group 242 comprises the eight cleaning water supply solenoid valves 112, 114, 116, 118, 120, 122, 138, 140.

The air cylinder driving circuit 214 is electrically connected to a coupling port valve air cylinder group 244. The coupling port valve air cylinder group 244 comprises the coupling port valve air cylinder 172 for selectively opening and closing the coupling port valve 124, as shown in FIG. 1, and five air cylinders each for selectively opening and closing a respective one of the coupling port valves 126, 128, 130, 142, 144.

[Operations and Functions of Corrugated Paperboard Sheet Printing Machine 1]

With reference to FIGS. 6 and 7, the operations and functions of the corrugated paperboard sheet printing machine 1 according to this embodiment will be described. FIG. 6 is a sequence chart showing the printing sequence, the ink recovery sequence and the 60-second cleaning sequence in the corrugated paperboard sheet printing machine 1, and FIG. 7 is a sequence chart showing the 120-second cleaning sequence in the corrugated paperboard sheet printing machine 1.

In FIGS. 6 and 7, in the column "Control Targets", an object to be controlled by the printing control device 200 is described, and an elapsed time T of the ink recovery sequence or the cleaning sequence is described in the lowermost area of each figure. An operation state of each control target described in the column "Control Targets" is shown along with the elapsed time T. With regard to the anilox roll driving motor 222, "High" and "Low" denote, respectively, a high-speed rotation state and a low-speed rotation state, and "Stop" denotes a stopped state. With regard to the ink supply pump 42 and the ink recovery pump 44, "Normal" and "Reverse" denote, respectively, a normal rotation state and a reverse rotation state, and "Stop" denotes a stopped state. With regard to the three-way switching solenoid valve 82, in each figure, a high-level line denotes a state after being switched to a flow path providing fluid communication between the coupling port 46 and the ink supply pipe 72, wherein it is partly notated as "Flow 1", and a low-level line denotes a state after being switched to a flow path providing fluid communication between the high-pressure air supply solenoid valve 84 and the ink supply pipe 72, wherein it is partly notated as "Flow 2". With regard to the high-pressure air supply solenoid valves 84, 110 and the bypass solenoid valve 80, in each figure, a low-level line denotes a closed state of each solenoid valve, wherein it is partly notated as "Close", and a high-level line denotes an open state of each solenoid valve, wherein it is partly notated as "Open". With regard to the coupling port valves 126, 130 (short auxiliary ink recovery pipes 94, 96), the coupling port valves 142, 144 (auxiliary drain pipes 134, 136) and the coupling port valves 124, 128 (long auxiliary ink recovery pipes 90, 92), in each figure, a low-level line denotes a closed state of each solenoid valve, wherein it is partly notated as "Close", and a high-level line denotes an open state of each solenoid valve, wherein it is partly notated as "Open". With regard to the injection nozzle solenoid valve 152, in each figure, a low-level line denotes a closed state of each solenoid valve, wherein it is partly notated as "Close", and a high-level line denotes an open state of each solenoid valve, wherein it is partly notated as "Open". With regard to the injection nozzle moving motor (up-down) representing the up-down movement motor in the injection nozzle moving motor group 224, in each figure, a low-level line denotes a raising state in which the up-down movement motor is driven to move the injection nozzles 149 toward the raised position, wherein it is partly notated as "Up", and a high-level line denotes a lowing state in which the up-down movement motor is driven to move the injection nozzles 149 toward the lowered position, wherein it is partly notated as "Down". With regard to the injection nozzle moving motor (front-rear) representing the front-rear movement motor in the injection nozzle moving motor group 224, in each figure, "Stop" denotes a stopped state of the front-rear movement motor, and "Front" and "Rear" denote, respectively, a forwardly moving state in which the front-rear movement motor is driven to move the injection nozzles 149 forwardly toward the front machine frame 20, and a rearwardly moving state in which the front-rear movement motor is driven to move the injection nozzles 149 rearwardly toward the rear machine frame 22. With regard to the cleaning water supply solenoids (surplus and short auxiliary ink recovery pipes 98, 100, 94, 96) representing the cleaning water supply solenoid valves 114, 120, 116, 122, the cleaning water supply solenoids (auxiliary drain pipes 134, 136) representing the cleaning water supply solenoids 138, 140, and the cleaning water supply solenoids (long auxiliary ink recovery pipes 90, 92) representing the cleaning water supply solenoid valves 112, 118, in each figure, a low-level line denotes a closed state of each solenoid valve, wherein it is partly notated as "Close", and a high-level line denotes an open state of each solenoid valve, wherein it is partly notated as "Open". With regard to the opening nozzle moving motor (up-down) representing the up-down movement motor in the opening nozzle moving motor group 226, in each figure, a high-level line denotes a lowing state in which the up-down movement motor is driven to move the opening nozzles 74, 102, 108 toward the lowered position, wherein it is partly notated as "Down", and a low-level line denotes a raising state in which the up-down movement motor is driven to move the opening nozzles 74, 102, 108 toward the raised position, wherein it is partly notated as "Up". With regard to the opening nozzle moving motor (front-rear) representing the front-rear movement motor in the opening nozzle moving motor group 226, in each figure, a high-level line denotes a rearwardly moving state in which the front-rear movement motor is driven to move the opening nozzles 74, 102, 108 to a rearward position facing the upper opening of the ink can 38, wherein it is partly notated as "Rear", and a low-level line denotes a forwardly moving state in which the front-rear movement motor is driven to move the opening nozzles 74, 102, 108 to a frontward position, i.e., drain position, facing the drain channel 40, wherein it is partly notated as "Front".

First of all, operation in the case where an operator manipulates the setting manipulation unit 206 to select the 60-second sequence will be described with reference to FIG. 6. The control information regarding an order to be executed is sent from the management device 300 to the printing control device 200, and thus the execution of the order is started. The printing control device 200 operates to send an instruction to generate a high-pressure air, to the motor driving circuit 210, thereby driving the high-pressure air compressor 220. The printing control device 200 operates to send a high-speed rotation instruction conforming to the conveyance speed included in the control information sent from the management device 300, to the motor driving circuit 210, thereby rotating the anilox roll driving motor 222 a given high speed. When the anilox roll driving motor 222 is rotated at the given high speed, the printing control device 200 operates to drive a non-illustrated driving motor for rotating the printing cylinder 10 and the press roll 12, at a rotational speed conforming to the conveyance speed. In conjunction with the start of execution of the order, corrugated paperboard sheets are fed from the sheet feeding apparatus and sequentially supplied to the corrugated paperboard sheet printing machine 1. During the execution of the printing sequence for the order, the anilox roll 24, the printing cylinder 10 and the press roll 12 are rotated in the respective rotational directions indicated by the arrowed lines as shown in FIG. 1.

(Operation of Printing Sequence)

In conjunction with the start of execution of the order, at a time point when the printing sequence illustrated in FIG. 6 is started, the printing control device 200 operates to send an instruction to close solenoid valves consisting of the high-pressure air supply solenoid valve group 240, the bypass solenoid valve 80, the cleaning water supply solenoid group 242, and the injection nozzle solenoid valve 152, to the solenoid valve driving circuit 212, thereby closing these solenoid valves. At the start time point of the printing sequence, the printing control device 200 operates to send an instruction to switch to the flow path providing fluid communication between the connection port 46 and the ink supply pipe 72 (the state notated as "Flow 1" in FIG. 6), to the solenoid valve driving circuit 212, thereby switching the three-way switching solenoid valve 82. At the start time point of the printing sequence, the printing control device 200 operates to send an instruction to close each of the coupling ports 48, 50, 52, 54, 60, 62, to the air cylinder driving circuit 214, thereby actuating the air cylinders of the coupling port valve air cylinder group 244 such that the above coupling ports are closed.

At the start time point of the printing sequence, the printing control device 200 operates to send an instruction to normally rotate the ink supply pump 42 and an instruction to reversely rotate the ink recovery pump 44, to the motor driving circuit 210, thereby normally rotating the ink supply pump 42 and reversely rotating the ink recovery pump 44. Along with the normal rotation of the ink supply pump 42, the ink supply pump 42 sends ink in the ink supply pipe 70 toward the ink supply pipe 72. Further, along with the reverse rotation of the ink recovery pump 44, the ink recovery pump 44 sends ink in the coupling recovery pipe 106 toward the main ink recovery pipe 104. At the start time point of the printing sequence, the printing control device 200 operates to send a raising instruction for the up-down movement motor in the injection nozzle moving motor group 224, and a stopping instruction for the front-rear movement motor in the injection nozzle moving motor group 224, to the motor driving circuit 210, thereby driving these movement motors. According to the raising instruction, the up-down movement motor is controlled to move the injection nozzles 149 to the raised position, and according to the stopping instruction, the front-rear movement motor is controlled to stop the injection nozzles 149 at the middle position CP illustrated in FIG. 2. At the start time point of the printing sequence, the printing control device 200 operates to send a rearward movement instruction for the front-rear movement motor in the opening nozzle moving motor group 226, and a lowering instruction for the up-down movement motor in the opening nozzle moving motor group 226, to the motor driving circuit 210, thereby driving these movement motors. According the rearward movement instruction, the front-rear movement motor is controlled to move the opening nozzles 74, 102, 108 rearwardly such that the opening nozzles 74, 102, 108 face the upper opening of the ink can 38. Subsequently, according to the lowering instruction, the up-down movement motor is controlled to move the opening nozzles 74, 102, 108 to the lowered position so as to allow the opening nozzles 74, 102, 108 to enter the inside of the ink can 38 as shown in FIG. 2.

During execution of the printing sequence, the ink supply pump 42 is normally rotated, and the ink recovery pump 44 is reversely rotated. Along with the normal rotation of the ink supply pump 42, ink from the ink can 38 is supplied to the ink reservoir 26, via the ink supply pipe 70, the ink supply pump 42, the ink supply pipe 72, the three-way switching solenoid valve 82 and the coupling port 46. When ink supplied to the ink reservoir 26 is reserved to reach an ink amount equivalent to the height position of the coupling ports 56, 58, further supplied ink flows out of the ink reservoir, as surplus ink, toward the ink pans 32, 34 via the surplus ink recovery pipes 98, 100.

Ink pooled in the ink pan 32 is recovered into the ink can 38 via the front ink recovery pipe 86 and the opening nozzle 102, under the ink's own weight. Ink pooled in the ink pan 34 is recovered into the ink can 38 via the coupling recovery pipe 106, the ink recovery pump 44, and the opening nozzle 108, along with the reverse rotation of the ink recovery pump 44.

After corrugated paperboard sheets are fed from the sheet feeding apparatus in a number set for the order, when the corrugated paperboard sheet printing machine 1 carries out printing for the last corrugated paperboard sheet, and the corrugated paperboard box making machine completes the processings for the last corrugated paperboard sheet, the management device 300 sends an order change instruction to the printing control device 200, and thus the printing control device 200 operates to terminate the printing sequence. After termination of the printing sequence, the rotation of the printing cylinder 10 and the press roll 12 are stopped in a state in which the anilox roll 24 and the printing cylinder 10 are spaced apart from each other.

(Operation of Ink Recovery Sequence)

After termination of the printing sequence, when the operator manipulates the setting manipulation unit 206 to instruct the printing control device 200 to start the ink recovery sequence, the printing control device 200 operates to start the ink recovery sequence. When starting the ink recovery sequence, the printing control device 200 operates to set the timer 208 to an initial state corresponding to the elapse of 0 second, and cause the timer 208 to start a time measurement operation.

At a start time point of the ink recovery sequence (elapsed time: 0 second), the printing control device 200 operates to send a low-speed rotation instruction, to the motor driving circuit 210, thereby rotating the anilox roll driving motor 222 at a given low speed. At the start time point of the ink recovery sequence, the printing control device 200 operates to send an instruction to reversely rotate the ink supply pump 42, and the instruction to reversely rotate the ink recovery pump 44, to the motor driving circuit 210, thereby switching the ink supply pump 42 from the normal rotation to the reverse rotation and continuing the reverse rotation of the ink recovery pump 44. Along with the reverse rotation of the ink supply pump 42, the ink supply pump 42 sends ink in the ink supply pipe 72 toward the ink supply pipe 70. During the reverse rotation of the ink supply pump 42, ink reserved in the ink reservoir 26 is recovered into the ink can 38, via the coupling port 46, the three-way switching solenoid valve 82, the ink supply pipe 72, the ink supply pump 42, the ink supply pipe 70, and the opening nozzle 74. Since the reverse rotation of the ink recovery pump 44 is continued, the ink recovery pump 44 continues the operation of sending ink in the coupling recovery pipe 106 toward the main ink recovery pipe 104.

In order to allow the coupling port valves 126, 130 to be switched from the closed state to the open state, during a period between the start time point of the ink recovery sequence and a time point corresponding to the elapse of 10 seconds, and, after continuing the open state for a given time period, switched from the open state to the closed state, the printing control device 200 operates to send an opening-closing control instruction to the air cylinder driving circuit 214, thereby actuating the air cylinders for selectively opening and closing the coupling port valves 126, 130. As above, the duration of the open state of the coupling port valves 126, 130 is limited to the given time period. Thus, it is possible to suppress a situation where a large volume of ink rapidly flows from the ink reservoir 26 into the ink pans 32, 34.

In order to allow the coupling port valves 126, 130 to be switched from the closed state to the open state, at a specific time point between the time point corresponding to the elapse of 10 seconds and a time point corresponding to the elapse of 20 seconds, and then to continue the open state, the printing control device 200 operates to send the opening-closing control instruction to the air cylinder driving circuit 214, thereby actuating the air cylinders for selectively opening and closing the coupling port valves 126, 130. Since the coupling port valves 126, 130 are maintained in the open state from the specific time point, ink reserved in the tank reservoir 26 flows out into the ink pans 32, 34, via the coupling ports 52, 54 opened, respectively, by the coupling port valves 126, 130, and the short auxiliary ink recovery pipes 94, 96.

In order to allow the coupling port valves 124, 128 to be switched from the closed state to the open state, at a specific time point just after the elapse of 20 seconds, and then to continue the open state, the printing control device 200 operates to send the opening-closing control instruction to the air cylinder driving circuit 214, thereby actuating the air cylinders for selectively opening and closing the coupling port valves 124, 128. Since the coupling port valves 124, 128 are maintained in the open state from the specific time point, ink reserved in the tank reservoir 26 flows out into the ink pans 32, 34, via the coupling ports 48, 50 opened, respectively, by the coupling port valves 124, 128, and the long auxiliary ink recovery pipes 90, 92.

From the specific time point just after the elapse of 20 seconds, ink reserved in the tank reservoir 26 flows out into the ink pan 32, via both the short auxiliary ink recovery pipe 94 and the long auxiliary ink recovery pipe 90, and flows out into the ink pan 34, via both the short auxiliary ink recovery pipe 96 and the long auxiliary ink recovery pipe 92. Ink pooled in the ink pan 32 is recovered into the ink can 38 via the front ink recovery pipe 86 and the opening nozzle 102, under the ink's own weight. Ink pooled in the ink pan 34 is recovered into the ink can 38 via the coupling recovery pipe 106, the ink recovery pump 44, and the opening nozzle 108, along with the reverse rotation of the ink recovery pump 44.

In order to allow the opening nozzles 74, 102, 108 to be moved from the lowered position to the raised position, at a specific time point between a time point corresponding to the elapse of 40 seconds and a time point corresponding to the elapse of 50 seconds, the printing control device 200 operates to send a raising control instruction to the motor driving circuit 210, thereby driving the up-down movement motor in the opening nozzle moving motor group 226. The distal ends of the opening nozzles 74, 102, 108 are moved to the given raised position spaced apart upwardly from the upper opening of the ink can 38. In this way, the opening nozzles 74, 102, 108 are moved to the raised position. This makes it possible to suppress a situation where, when high-pressure air is supplied to the ink supply pipes 72, 70, it causes scattering of ink in the ink can 38.

In order to allow the operation of the ink supply pump 42 to be stopped at a specific time point just before the elapse of 50 seconds, the printing control device 200 operates to send a stopping instruction to the motor driving circuit 210, thereby stopping the driving motor of the ink supply pump 42. Since the operation of the ink supply pump 42 is stopped, the flexible pipe 160 of the ink supply pump 42 is compressed by the pressing roll 164B as shown in FIG. 1, so that the fluid communication between the ink supply pipe 72 and the ink supply pipe 70 is shut off, and the shut-off state is continued.

In order to allow the three-way switching solenoid valve 82 to be switched to the flow path providing fluid communication between the high-pressure air supply solenoid valve 84 and the ink supply pipe 72 (to the state notated as "Flow 2" in FIG. 6), at the time point corresponding to the elapse of 50 seconds, the printing control device 200 operates to send a flow path switching instruction to the solenoid valve driving circuit 212, thereby actuating the three-way switching solenoid valve 82.

In order to allow the bypass solenoid valve 80 to be switched from the closed state to the open state, at a specific time point just after the elapse of 50 seconds, the printing control device 200 operates to send the opening-closing control instruction to the solenoid valve driving circuit 212, thereby actuating the bypass solenoid valve 80. After switching the bypass solenoid valve 80 to the open state, the open state is continued. Thus, the bypass pipe 76 allows ink from the ink supply pipe 72 to flow into the ink supply pipe 70 while bypassing the ink supply pump 42.

In order to allow the high-pressure air supply solenoid valves 84, 110 to be switched from the closed state to the open state, at a specific time point after the switching of the bypass valve 80, and kept in the open state only for a given time period just before the elapse of 60 seconds, the printing control device 200 operates to send the opening-closing control instruction to the solenoid valve driving circuit 212, thereby actuating the high-pressure air supply solenoid valves 84, 110. As a result of switching the high-pressure air supply solenoid valves 84, 110 to the open state, high-pressure air from the high-pressure air compressor 220 is supplied to the ink supply pipe 72 via the high-pressure air supply solenoid valve 84 and the three-way switching solenoid valve 82, and supplied to the main ink recovery pipe 104 via the high-pressure air supply solenoid valve 110.

At a time point corresponding to the elapse of 30 seconds, ink flowing in the front ink recovery pipe 86 and the rear ink recovery pipe 88 via the ink pans 32, 34, and ink flowing in the ink supply pipe 72 from the ink reservoir 26 via the three-way switching solenoid valve 82, are recovered toward the ink can 38 in a state in which the inside of each of the ink supply pipe 72 and the ink recovery pipes 86, 88 is completely filled with ink. During a period between the time point corresponding to the elapse of 30 seconds and a time point just before the elapse of 50 seconds, the mount of ink flowing in the ink supply pipe 72 and the ink recovery pipes 86, 88 decreases, and a state appears in which ink and air are mixed inside each of the ink supply pipe 72 and the ink recovery pipes 86, 88, i.e., an ink-air mixed state appears. At the time point just before the elapse of 50 seconds, a state appears in which almost no ink remains inside each of the ink reservoir 26 and the ink pans 32, 34. After the elapse of 50 seconds, no ink newly flows from the ink reservoir 26 and the ink pans 32, 34 into the ink supply pipe 72 and the ink recovery pipes 86, 88, and a state appears in which ink slightly remains on a bottom region of an inner surface of each of the ink supply pipe 72 and the ink recovery pipes 86, 88, or in which ink droplets adhere on the inner surface of each of the ink supply pipe 72 and the ink recovery pipes 86, 88.

The main ink recovery pipe 104 of the rear ink recovery pipe 88 elongatedly extends in the front-rear direction in the region between the front machine frame 20 and the rear machine frame 22. Thus, even if ink or ink droplets slightly remains or adhere on the inner surface of the main ink recovery pipe 104, the total amount of ink or ink droplets remaining or adhering over the overall length of the main ink recovery pipe 104 becomes a considerable or non-negligible amount. Similarly, the ink supply pipe 72 elongatedly extends forwardly from the middle position CP of the ink reservoir 26 to the front machine frame 20. Thus, even if ink or ink droplets slightly remains or adhere on the inner surface of the ink supply pipe 72, the total amount of ink or ink droplets remaining or adhering over the overall length of the ink supply pipe 72 becomes a considerable or non-negligible amount.

During a given period after the elapse of 50 seconds, high-pressure air from the high-pressure air compressor 220 is supplied to each of the ink supply pipe 72 and the main ink recovery pipe 104. Under the supply of the high-pressure air, ink or ink droplets remaining on the inner surface of the ink supply pipe 72 is/are pushed out toward the ink supply pipe 70 via the bypass pipe 76, and recovered into the ink can 38 via the ink supply pipe 70 and the opening nozzle 74. Further, under the supply of the high-pressure air, ink or ink droplets remaining on the inner surface of the main ink recovery pipe 108 is/are pushed out toward the opening nozzle 108, and recovered into the ink can 38 via the opening nozzle 108.

At a time point when the high-pressure air is supplied to the ink supply pipe 72, the state in which ink and air are mixed inside the ink supply pipe 72 appears. In this ink-air mixed state, a suctioning action of the ink supply pipe 72 being reversely rotated is almost not effective in suctioning and pushing out ink or ink droplets remaining on the inner surface of the relatively long ink supply pipe 72, into the ink supply pipe 70. For this reason, the ink supply pump 42 is stopped at a time point just before the elapse of 50 seconds, and then the stopped state is continued. Further, at the time point when the high-pressure air is supplied to the main ink recovery pipe 104, the state in which ink and air are mixed inside the coupling recovery pipe 106 appears. However, a sucking action of the ink recovery pump 44 being reversely rotated is intended to suction ink pooled in the ink pan 34 into the main ink recovery pipe 104 via the relatively short coupling recovery pipe 106. Therefore, in the ink recovery pump 44, the reversely rotated state is continued even around the time point corresponding to the elapse of 50 seconds.

In order to allow the anilox roll driving motor 222 to be stopped from a state in which it is rotated at the given low speed, at a specific time point before the elapse of 60 seconds, the printing control device 200 operates to send a stopping instruction to the motor driving circuit 210, thereby stopping the anilox roll driving motor 222, and continuing the stopped state until the elapsed time reaches 60 seconds.

(Operation of 60-Second Cleaning Sequence)

When 60 seconds have elapsed from the start time point of the ink recovery sequence, the timer 208 sends information indicative of the elapse of 60 seconds, to the printing control device 200, and thus the printing control device 200 operates to start the time measurement operation after setting the timer 208 to the initial state corresponding to the elapse of 0 second. The printing control device 200 also operates to terminate the ink recovery sequence, and start to execute the 60-second cleaning sequence as shown in FIG. 6.

In the 60-second cleaning sequence, in a first-half cleaning period between a time point corresponding to the elapse of 0 second and a time point corresponding to the elapse of 30 seconds, an operation of recovering residual ink or ink droplets from the ink supply pipes 70, 72 and the main ink recovery pipe 104 and an operation of cleaning the anilox roll 24 and the ink reservoir 26 are mainly carried out. In a second-half cleaning period between the time point corresponding to the elapse of 30 seconds and a time point corresponding to the elapse of 60 seconds, an operation of cleaning pipes such as the ink supply pipes 70, 72 and the main ink recovery pipe 104 is mainly carried out.

In order to allow the anilox roll driving motor 222 to be rotated at a given high speed from the stopped state, while allowing the ink supply pump 42 to continue the stopped state, and allowing the ink recovery pump 44 to be stopped from the reversely rotated state, at a start time point of the 60-second cleaning sequence (elapsed time: 0 second), the printing control device 200 operates to send a control instruction to the motor driving circuit 210, thereby driving the anilox roll driving motor 222 and controlling driving of driving motors of the ink supply pump 42 and the ink recovery pump 44. The anilox roll driving motor 222 is driven such that the rotation at the given high speed is continued until a termination time point of the 60-second cleaning sequence (elapsed time: 60 seconds).

At the start time point of the 60-second cleaning sequence, the printing control device 200 operates to send a lowering instruction for the up-down movement motor in the injection nozzle moving motor group 224, and a stopping instruction for the front-rear movement motor in the injection nozzle moving motor group 224, to the motor driving circuit 210, thereby driving these movement motors. According to the lowering instruction, the up-down movement motor is controlled to move the injection nozzles 149 to the lowered position, and the front-rear movement motor is controlled to cause the injection nozzles 149 to be continuously stopped at the middle position CP. At the start time point of the 60-second cleaning sequence, the printing control device 200 operates to send a rearward movement instruction for the front-rear movement motor in the opening nozzle moving motor group 226, and a raising instruction for the up-down movement motor in the opening nozzle moving motor group 226, to the motor driving circuit 210, thereby driving these movement motors. According to the rearward movement instruction, the front-rear movement motor is controlled to cause the opening nozzles 74, 102, 108 to be continuously located at a position facing the upper opening of the ink can 38, and, according to the raising instruction, the up-down movement motor is controlled to cause the opening nozzles 74, 102, 108 to be continuously located at the raised position spaced apart upwardly from the ink can 38.

At the start time point of the 60-second cleaning sequence, the printing control device 200 operates to send instructions to close solenoid valves consisting of the high-pressure air supply solenoid valve group 240, the bypass solenoid valve 80, the cleaning water supply solenoid group 242, and the injection nozzle solenoid valve 148, to the solenoid valve driving circuit 212, thereby closing a part of the solenoid valves and continuing the closed state of the remaining solenoid valves. At the start time point of the 60-second cleaning sequence, the printing control device 200 operates to send an instruction to switch to the flow path providing fluid communication between the high-pressure air supply solenoid valve 84 and the ink supply pipe 72 (the state notated as "Flow 2" in FIG. 6), to the solenoid valve driving circuit 212, thereby causing the three-way switching solenoid valve 82 to continue the switched state notated as "Flow 2". In order to allow the coupling port valves 142, 144 to be opened and allow the coupling port valves 124, 126, 128, 130 to be closed, at the start time point of the 60-second cleaning sequence, the printing control device 200 operates to send an instruction to open the coupling port valves 142, 144, and an instruction to close the coupling port valves 124, 126, 128, 130, to the air cylinder driving circuit 214, thereby controlling actuation of each air cylinder in the coupling port valve air cylinder group 244 for selectively opening and closing the coupling port valves.

In order to allow the injection nozzle solenoid valve 152 to be opened, and cause the front-rear movement motor in the injection nozzle moving motor group 224 to move the injection nozzles 149 forwardly toward the front machine frame 20, at a specific time point between the time point corresponding to the elapse of 0 second and a time point corresponding to the elapse of 10 seconds, the printing control device 200 operates to send an instruction to open the injection nozzle solenoid valve 152, to the solenoid valve driving circuit 212, and send a forward movement instruction for the front-rear movement motor in the injection nozzle moving motor group 224, to the motor driving circuit 210, thereby opening the injection nozzle solenoid valve 152 and moving the injection nozzles 149 forwardly. As a result of opening the injection nozzle solenoid valve 152, cleaning water is injected from the injection nozzles 149 being moved forwardly, toward the ink reservoir 26. In response to start of the injection of cleaning water, cleaning of the anilox roll 24 and the ink reservoir 26 is started.

In order to allow the cleaning water supply solenoid valves 138, 140 to be opened at a time point between the time point corresponding to the elapse of 0 second and the time point corresponding to the elapse of 10 seconds and after the injection nozzle solenoid valve 152 is opened, and then to continue the open state until the time point corresponding to the elapse of 10 seconds, the printing control device 200 operates to send an opening instruction to the solenoid valve driving circuit 212, thereby opening the cleaning water supply solenoid valves 138, 140. In response to opening the cleaning water supply solenoid valves 138, 140, cleaning water supplied from a non-illustrated cleaning water source is supplied to each of the auxiliary drain pipes 134, 136 through a corresponding one of the cleaning water supply solenoid valves 138, 140. In this embodiment, at a time point when the cleaning water supply solenoid valves 138, 140 are opened, cleaning water injected from the injection nozzles 149 to the ink reservoir 26 by opening the injection nozzle solenoid valve 152 is in a state in which it has not yet flowed from the coupling ports 60, 62 into the auxiliary drain pipes 134, 136. Before cleaning water mixed with ink adhering on the ink reservoir 26 flows into the auxiliary drain pipes 134, 136 through the coupling ports 60, 62, clean cleaning water is supplied to each of the auxiliary drain pipes 134, 136 in response to opening the cleaning water supply solenoid valves 138, 140. Therefore, the inner surface of each of the auxiliary drain pipes 134, 136 is coated with the clean cleaning water, so that it is possible to reduce a situation where cleaning water mixed with ink adheres onto the inner surface of each of the auxiliary drain pipes 134, 136.

In order to cause the front-rear movement motor in the injection nozzle moving motor group 224 to switch the movement of the injection nozzles 149 from the forward movement to a rearward movement toward the rear machine frame 22, at a time point just before the elapse of 10 seconds, the printing control device 200 operates to send a rearward movement instruction for the front-rear movement motor in the injection nozzle moving motor group 224, to the motor driving circuit 210, thereby moving the injection nozzles 149 rearwardly. The front-rear directional reciprocating movement of the injection nozzles 149 is repeated until the time point corresponding to the elapse of 30 seconds, and, after the elapse of 30 seconds, the injection nozzles 149 is stopped at the middle position CP.

Cleaning water injected from the injection nozzles 149 to the ink reservoir 26 during the period between the start of the injection of cleaning water from the injection nozzles 149 and the time point corresponding to the elapse of 10 seconds in the 60-second cleaning sequence flows out into the cleaning pan 36 via the coupling port 60, 62 and the auxiliary drain pipes 134, 136 in response to opening the coupling port valves 142, 144. Further, cleaning water supplied through the cleaning water supply solenoid valves 138, 140 in response to opening the cleaning water supply solenoid valves 138, 140 also flows out into the cleaning water pan 36 via the auxiliary drain pipes 134, 136. Cleaning water pooled in the cleaning water pan 36 is drained into the drain channel 40 via the main drain pipe 132 and the opening nozzle 137. During a period during which the injection nozzle solenoid valve 152 is opened, the coupling port valves 124, 126, 128, 130 are kept in the closed state, and thus the coupling ports 48, 50, 52, 54 are closed. Thus, cleaning water pooled in the ink reservoir 26 flows out only through the auxiliary drain pipes 134, 136 but does not flow out through the auxiliary ink recovery pipes 90, 92, 94, 96.

In order to allow the ink recovery pump 44 to be reversely rotated from the stopped state, at the time point corresponding to the elapse of 10 seconds, the printing control device 200 operates to send the reverse movement instruction to the motor driving circuit 210, thereby reversely rotating the ink recovery pump 44. Along with the reverse rotation of the ink recovery pump 44, ink remaining in the ink pan 34 is suctioned via the coupling recovery pipe 106, and pushed out toward the main ink recovery pipe 104. The reverse rotation state of the ink recovery pump 44 is continued until the termination time point of the 60-second cleaning sequence (elapsed time: 60 seconds).

In order to allow the bypass solenoid valve 80 to be opened at the time point corresponding to the elapse of 10 seconds, the printing control device 200 operates to send an opening instruction to the solenoid valve driving circuit 212, thereby opening the bypass solenoid valve 80. The open state of the bypass solenoid valve 80 is continued until the time point corresponding to the elapse of 30 seconds. Under the open state of the bypass solenoid valve 80, the bypass pipe 76 allows residual ink or ink droplets in the ink supply pipe 72 to flow toward the ink supply pipe 70 while bypassing the ink supply pump 42.

In order to allow the high-pressure air supply solenoid valves 84, 110 to be switched from the closed state to the open state, at a time point just after the elapse of 10 seconds, and then kept in the open state for a given time period until a time point just before the elapse of 20 seconds, the printing control device 200 operates to send an opening instruction to the solenoid valve driving circuit 212, thereby opening the high-pressure air supply solenoid valves 84, 110. In response to opening the high-pressure air supply solenoid valves 84, 110, high-pressure air from the high-pressure air compressor 220 is supplied to the ink supply pipe 72 through the high-pressure air supply solenoid valve 84 and the three-way switching solenoid valve 82, and also supplied to the main ink recovery pipe 104 through the high-pressure air supply solenoid valve 110. Under the first high-pressure air supply in the 60-second cleaning sequence, ink or ink droplets still remaining on the inner surface of the ink supply pipe 72 is/are pushed out toward the ink supply pipe 70 via the bypass pipe 76 and recovered into the ink can 38 via the ink supply passage 70 and the opening nozzle 74. Further, under the first high-pressure air supply in the 60-second cleaning sequence, ink or ink droplets still remaining on the inner surface of the main ink recovery pipe 104 is/are pushed out toward the opening nozzle 108 and recovered into the ink can 38 via the opening nozzle 108.

Although the high-pressure air supply solenoid valves 84, 110 is temporarily switched to the closed state at a time point just before the elapse of 20 seconds, it is switched from the closed state to the open state again at a time point just after the elapse of 20 seconds, and kept in the open state only for a given time period until a time point just before the elapse of 30 seconds. In response to opening the high-pressure air supply solenoid valves 84, 110 during the period between the time point just after the elapse of 20 seconds and the time point just before the elapse of 30 seconds, the high-pressure air from the high-pressure air compressor 220 is supplied to each of the ink supply pipe 72 and the main ink recovery pipe 104. Under the second high-pressure air supply in the 60-second cleaning sequence, ink or ink droplets slightly remaining on the inner surface of the ink supply pipe 72 is/are pushed out toward the ink supply pipe 70 via the bypass pipe 76 and reliably recovered into the ink can 38 via the ink supply passage 70 and the opening nozzle 74. Further, under the second high-pressure air supply in the 60-second cleaning sequence, ink or ink droplets slightly remaining on the inner surface of the main ink recovery pipe 104 is/are pushed out toward the opening nozzle 108 and reliably recovered into the ink can 38 via the opening nozzle 108.

In order to allow the ink supply pump 42 to be reversely rotated from the stopped state, and cause the front-rear movement motor in the opening nozzle moving motor group 226 to move the opening nozzles 74, 102, 108 from the rearward position to the forward position facing the drain channel 40, at the time point corresponding to the elapse of 30 seconds, the printing control device 200 operates to send a control instruction to the motor driving circuit 210, thereby reversely rotating the ink supply pump 42 and driving the front-rear movement motor in the opening nozzle moving motor group 226. The reverse rotation state of the ink supply pump 42 is continued until a time point corresponding to the elapse of 40 seconds. The opening nozzles 74, 102, 108 are kept at the forward position until the termination time point of the 60-second cleaning sequence (the elapsed time: 60 seconds).

In order to allow the bypass solenoid valve 80 and the injection nozzle solenoid valve 152 to be closed at the time point corresponding to the elapse of 30 seconds, the printing control device 200 operates to send a closing instruction to the solenoid valve driving circuit 212, thereby closing the bypass solenoid valve 80 and the injection nozzle solenoid valve 152. The closed state of the bypass solenoid valve 80 is continued until the time point corresponding to the elapse of 40 seconds. The closed state of the injection nozzle solenoid valve 152 is continued until the termination time point of the 60-second cleaning sequence (elapsed time: 60 seconds).

In order to allow the three-way switching solenoid valve 82 to be switched from the flow path providing fluid communication between the high-pressure air supply solenoid valve 84 and the ink supply pipe 72 (to the state notated as "Flow 2" in FIG. 6) to the flow path providing fluid communication between the coupling port 46 and the ink supply pipe 72 (to the state notated as "Flow 1" in FIG. 6), at the time point corresponding to the elapse of 30 seconds, the printing control device 200 operates to send a switching instruction to the solenoid valve driving circuit 212, thereby switching the three-way switching solenoid valve 82. As a result of switching the three-way switching solenoid valve 82 to the state "Flow 1", cleaning water pooled in the ink reservoir 26 is allowed to flow into the ink supply pipe 72 via the coupling port 46. Since the ink supply pump 42 is reversely rotated from the time point corresponding to the elapse of 30 seconds, cleaning water from the ink supply pipe 72 is suctioned and pushed out toward the ink supply pipe 70 by the ink supply pump 42. Cleaning water from the ink supply pipe 70 is drained into the drain channel 40 via the opening nozzle 74.

During a period between the time point corresponding to the elapse of 30 seconds and the time point corresponding to the elapse of 40 seconds, cleaning water mixed with ink adhering on the ink reservoir 26 is filled inside the ink supply pipes 72, 70. Thus, the ink supply pump 42 can push out the cleaning water from the ink supply pipe 72 to the ink supply pipe 70 without large load. Further, during the period between the time point corresponding to the elapse of 30 seconds and the time point corresponding to the elapse of 40 seconds, the ink supply pump 42 is operated to continuously suction and push out the cleaning water. This operation makes it possible to wash away ink remaining inside the flexible pipe 160 of the ink supply pump 42.

In order to allow the coupling port valve 142, 144 to be switched from open state to the closed state at the time point corresponding to the elapse of 30 seconds, the printing control device 200 operates to send a closing instruction to the air cylinder driving circuit 214, thereby actuating the air cylinders each for selectively opening and closing a respective one of the coupling port valves 142, 144.

In order to cause the up-down movement motor in the opening nozzle moving motor group to move the opening nozzles 74, 102, 108 from the raised position to the lowered position at a specific time point between the time point corresponding to the elapse of 30 seconds and the time point corresponding to the elapse of 40 seconds, the printing control device 200 operates to send a lowering instruction to the motor driving circuit 210, thereby driving the up-down movement motor in the opening nozzle moving motor group. Under the driving of the up-down movement motor, the opening nozzles 74, 102, 108 are moved down to the lowered position close to the drain channel 40. As a result of the movement of the opening nozzles 74, 102, 108 to the lowered position, it becomes possible to reliably drain cleaning water into the drain channel 40 even when a large amount of cleaning water is drained from the opening nozzles 74, 102, 108 at once. The opening nozzles 74, 102, 108 is kept at the lowered position until the termination time point of the 60-second cleaning sequence (elapsed time: 60 seconds).

In order to allow the coupling port valves 124, 126, 128, 130, 142, 144 to be switched from the closed position to the open position at the same time at a specific time point between the time point corresponding to the elapse of 30 seconds and the time point corresponding to the elapse of 40 seconds, and then to continue the open state until the termination time point of the 60-second cleaning sequence, the printing control device 200 operates to send an opening instruction to the air cylinder driving circuit 214, thereby actuating the air cylinders each for selectively opening and closing a respective one of the coupling port valves 124, 126, 128, 130, 142, 144. In response to opening the coupling port valves 124, 126, 128, 130, 142, 144, the coupling ports 46, 48, 50, 52, 54, 56, 58, 60, 62 are opened at the same time. As a result of opening the coupling ports 48, 52, cleaning water pooled in the ink reservoir 26 flows into the ink pan 32 via the auxiliary recovery pipes 90, 94, and then cleaning water pooled in the ink pan 32 is drained into the drain channel 40 via the front ink recovery pipe 86 and the opening nozzle 102, under the cleaning water's own weight. As a result of opening the coupling ports 50, 54, cleaning water pooled in the ink reservoir 26 flows into the ink pan 34 via the auxiliary recovery pipes 92, 96, and then cleaning water pooled in the ink pan 34 is suctioned via the coupling recovery pipe 106 and pushed out toward the main ink recovery pipe 104, along with the reverse rotation of the ink recovery pump 44. Cleaning water from the main ink recovery pipe 104 is drained into the drain channel 40 via the opening nozzle 108. As a result of opening the coupling ports 60, 62, cleaning water pooled in the ink reservoir 26 flows into the cleaning water pan 36 via the auxiliary drain pipes 134, 136, and then cleaning water pooled in the cleaning water pan 36 is drained into the drain channel 40 via the main drain pipe 132 and the opening nozzle 137.

In order to allow the ink supply pump 42 to be stopped from the reverse rotation state at the time point corresponding to the elapse of 40 seconds, the printing control device 200 operates to send a stopping instruction to the motor driving circuit 210, thereby stopping the ink supply pump 42. Further, in order to allow the bypass solenoid valve 80 to be switched from the closed state to the open state at the time point corresponding to the elapse of 40 seconds, and then to continue the open state only for a given time period, the printing control device 200 operates to send an opening instruction to the solenoid valve driving circuit 212, thereby opening the bypass solenoid valve 80. Furthermore, in order to allow the three-way switching solenoid valve 82 to be switched from the flow path providing fluid communication between the connection port 46 and the ink supply pipe 72 (the state notated as "Flow 1" in FIG. 6) to the flow path providing fluid communication between the high-pressure air supply solenoid valve 84 and the ink supply pipe 72 (to the state notated as "Flow 2" in FIG. 6) at the time point corresponding to the elapse of 40 seconds, and then to continue the switched state only for a given time period, the printing control device 200 operates to send a switching instruction to the solenoid valve driving circuit 212, thereby switching the three-way switching solenoid valve 82.

In order to allow the high-pressure air supply solenoid valves 84, 110 to be switched from the closed state to the open state at a time point just after the elapse of 40 seconds, and then to continue the open state only for a given time period, the printing control device 200 operates to send an opening instruction to the solenoid valve driving circuit 212, thereby opening the high-pressure air supply solenoid valves 84, 110. In response to opening the high-pressure air supply solenoid valves 84, 110 only for the given time period, high-pressure air from the high-pressure compressor 220 is supplied to each of the ink supply pipe 72 and the main ink recovery pipe 104. Under the third high-pressure air supply in the 60-second cleaning sequence, cleaning water existing inside the ink supply pipe 72 is pushed out to the ink recovery pipe 70 via the bypass pipe 76. Cleaning water from the ink recovery pipe 70 is drained into the drain channel 40 via the opening nozzle 74. Under the third high-pressure air supply in the 60-second cleaning sequence, cleaning water existing inside the main ink recovery pipe 104 is pushed out toward the opening nozzle 108, and drained into the drain channel 40 via the opening nozzle 108. During a period during which the third high-pressure air supply is performed, the ink recovery pump 44 is reversely rotated to suction cleaning water pooled in the ink pan 34 via the coupling recovery pipe 106 and push out the suctioned cleaning water to the main ink recovery pipe 104.

At a time point when the third high-pressure air supply is started in the 60-second cleaning sequence, i.e., at the time point after the elapse of 40 seconds, the inside of each of the ink supply pipe 72 and the main ink recovery pipe 104 is in a state in which cleaning water and air start to be mixed together therein. Thus, the operation of suctioning cleaning water mixed with air inside the ink supply pipe 72 and pushing out the cleaning water toward the drain channel 40, using only the ink supply pump 42, requires too much time, and imposes large load on the ink supply pump 42. In this embodiment, based on performing the third high-pressure air supply, it becomes possible to quickly drain cleaning water mixed with air, from the ink supply pipes 72, 70 and the main ink recovery pipe 104.

In order to allow the three-way switching solenoid valve 82 to be switched from the flow path providing fluid communication between the high-pressure air supply solenoid valve 84 and the ink supply pipe 72 (to the state notated as "Flow 2" in FIG. 6) to the flow path providing fluid communication between the connection port 46 and the ink supply pipe 72 (the state notated as "Flow 1" in FIG. 6), at a termination time point of the third high-pressure air supply in the 60-second cleaning sequence, the printing control device 200 operates to send a switching instruction to the solenoid valve driving circuit 212, thereby switching the three-way switching solenoid valve 82.

In order to allow the cleaning water supply solenoid valves 138, 140 to be opened at a specific time point after the elapse of 40 seconds and after termination of the third high-pressure air supply in the 60-second cleaning sequence, and then to continue the open state until a specific time point just after the elapse of 50 seconds, the printing control device 200 operates to send an instruction to the solenoid valve driving circuit 212, thereby opening the cleaning water supply solenoid valves 138, 140. In response to opening the cleaning water supply solenoid valves 138, 140, cleaning water from the non-illustrated cleaning water source is supplied to each of the auxiliary drain pipes 134, 136 through a corresponding one of the cleaning water supply solenoid valves 138, 140. After reaching a specific time after the elapse of 50 seconds, the cleaning water supply solenoid valves 138, 140 are switched from the open state to the closed state, and then continue the closed state until the termination time point of the 60-second cleaning sequence.

In order to allow the ink supply pump 42 to be reversely rotated from the stopped state at a specific time point after the elapse of 40 seconds and after termination of the third high-pressure air supply in the 60-second cleaning sequence, the printing control device 200 operates to send a reverse rotation instruction to the motor driving circuit 210, thereby reversely rotating the ink supply pump 42. Further, in order to allow the bypass solenoid valve 80 to be switched from the open state to the closed state at a specific time point after the elapse of 40 seconds and after termination of the third high-pressure air supply in the 60-second cleaning sequence, the printing control device 200 operates to send a closing instruction to the solenoid valve driving circuit 212, thereby closing the bypass solenoid valve 80.

During a period between a specific time point after the elapse of 40 seconds and a time point corresponding to the elapse of 50 seconds and after termination of the third high-pressure air supply in the 60-second cleaning sequence, the volume of air to be mixed with cleaning water sharply increases inside the ink supply pipes 72, 70 and the main ink recovery pipe 104. After the elapse of 50 seconds, a state appears in which residual cleaning water or cleaning water droplets adhere(s) on to the inner surface of each of the ink supply pipes 72, 70 and the main ink recovery pipe 104. At a time point after termination of the third high-pressure air supply, cleaning water existing inside the ink supply pipes 72, 70 becomes clean cleaning water containing almost no ink. The ink supply pump 42 being reversely rotated from the specific time point after the elapse of 40 seconds is almost not effective in transporting cleaning water. However, since the ink supply pump 42 is operated to continuously suction and push out the clean cleaning water, it is possible to cleanly wash the inside of the flexible pipe 160 of the ink supply pump 42 through the operation.

In order to allow the bypass solenoid valve 80 to be switched from the closed state to the open state at a time point just after the elapse of 50 seconds, and then to continue the open state until the termination time point of the 60-second cleaning sequence, the printing control device 200 operates to send an opening instruction to the solenoid valve driving circuit 212, thereby opening the bypass solenoid valve 80.

In order to allow the ink supply pump 42 to be stopped from the reverse rotation state at a specific time point after the elapse of 50 seconds, and then to continue the stopped state until the termination time point of the 60-second cleaning sequence, the printing control device 200 operates to send a stopping instruction to the motor driving circuit 210, thereby stopping the ink supply pump 42. Further, in order to allow the three-way switching solenoid valve 82 to be switched from the flow path providing fluid communication between the connection port 46 and the ink supply pipe 72 (the state notated as "Flow 1" in FIG. 6) to the flow path providing fluid communication between the high-pressure air supply solenoid valve 84 and the ink supply pipe 72 (to the state notated as "Flow 2" in FIG. 6), at a specific time point after the elapse of 50 seconds, and then to continue the switched state until the termination time point of the 60-second cleaning sequence, the printing control device 200 operates to send a switching instruction to the solenoid valve driving circuit 212, thereby switching the three-way switching solenoid valve 82.

In order to allow the high-pressure air supply solenoid valves 84, 110 to be switched from the closed state to the open state at approximately the same time point as that when the three-way switching solenoid valve 82 is switched to the state "Flow 2" in the 60-second cleaning sequence, and then to continue the open state until the termination time point of the 60-second cleaning sequence, the printing control device 200 operates to send an opening instruction to the solenoid valve driving circuit 212, thereby opening the high-pressure air supply solenoid valves 84, 110. In response to opening the high-pressure air supply solenoid valves 84, 110, high-pressure air from the high-pressure air compressor 220 is supplied to each of the ink supply pipe 72 and the main ink recovery pipe 104. Under the fourth high-pressure air supply in the 60-second cleaning sequence, cleaning water or cleaning water droplets remaining inside the ink supply pipe 72 is/are pushed out toward the ink supply pipe 70 via the bypass pipe 76. Cleaning water from the ink supply pipe 70 is drained into the drain channel 40 via the opening nozzle 74. Under the fourth high-pressure air supply in the 60-second cleaning sequence, cleaning water or cleaning water droplets remaining inside the main ink recovery pipe 104 is/are pushed out toward the opening nozzle 108 and drained into the drain channel 40 via the opening nozzle 108. During a period during which the fourth high-pressure air supply is performed, the ink recovery pump 44 is reversely rotated to suction cleaning water or cleaning water droplets remaining inside the coupling recovery pipe 106 and push out the suctioned cleaning water or cleaning water droplets to the main ink recovery pipe 104.

In order to cause the up-down movement motor in the injection nozzle moving motor group 224 to move the injection nozzles 149 to the raised position at a specific time point after the elapse of 50 seconds, and kept at the raised position until the termination time point of the 60-second cleaning sequence, the printing control device 200 operates to send a raising instruction to the motor driving circuit 210, thereby driving the up-down movement motor in the injection nozzle moving motor group 224.

When the elapsed time from the start of the 60-second cleaning sequence has reached 60 seconds, the timer 208 sends information indicative of the elapse of 60 seconds to the printing control device 200, and thus the printing control device 200 operates to stop the time measurement operation after setting the timer 208 to the initial state. The printing control device 200 also operates to terminate the execution of the 60-second cleaning sequence illustrated in FIG. 6.

(Operation of 120-Second Cleaning Sequence)

Next, operation to be performed when the operator manipulates the setting manipulation unit 206 to select the 120-second cleaning sequence will be described with reference to FIG. 7. A printing sequence and an ink recovery sequence related to the 120-second cleaning sequence are the same as the printing sequence and the ink recovery sequence illustrated in FIG. 6, and therefore description about the two sequence will be omitted.

When 60 seconds have elapsed from the start time point of the ink recovery sequence, the timer 208 sends information indicative of the elapse of 60 seconds, to the printing control device 200, and thus the printing control device 200 operates to start the time measurement operation after setting the timer 208 to the initial state corresponding to the elapse of 0 second. The printing control device 200 also operates to start to execute the 120-second cleaning sequence as shown in FIG. 7.

In the 120-second cleaning sequence, in a first-half cleaning period between a time point corresponding to the elapse of 0 second and a time point corresponding to the elapse of 60 seconds, an operation of recovering residual ink or ink droplets from the ink supply pipes 70, 72 and the main ink recovery pipe 104 and an operation of cleaning the anilox roll 24 and the ink reservoir 26 are mainly carried out. In a second-half cleaning period between the time point corresponding to the elapse of 60 seconds and a time point corresponding to the elapse of 120 seconds, an operation of cleaning pipes such as the ink supply pipes 70, 72 and the main ink recovery pipe 104 is mainly carried out.

In order to allow the anilox roll driving motor 222 to be rotated at a given high speed from the stopped state, while allowing the ink supply pump 42 to continue the stopped state, and allowing the ink recovery pump 44 to be stopped from the reversely rotated state, at a start time point of the 120-second cleaning sequence (elapsed time: 0 second), the printing control device 200 operates to send a control instruction to the motor driving circuit 210, thereby driving the anilox roll driving motor 222 and controlling driving of driving motors of the ink supply pump 42 and the ink recovery pump 44. The anilox roll driving motor 222 is driven such that the rotation at the given high speed is continued until a termination time point of the 120-second cleaning sequence (elapsed time: 120 seconds). Each of the driving motors of the ink supply pump 42 and the ink recovery pump 44 continues the stopped state until a specific time point after the elapse of 60 seconds in the 120-second cleaning sequence.

At the start time point of the 120-second cleaning sequence, the printing control device 200 operates to send a lowering instruction for the up-down movement motor in the injection nozzle moving motor group 224, and a stopping instruction for the front-rear movement motor in the injection nozzle moving motor group 224, to the motor driving circuit 210, thereby driving these movement motors. According to the lowering instruction, the up-down movement motor is controlled to move the injection nozzles 149 to the lowered position, and the front-rear movement motor is controlled to cause the injection nozzles 149 to be continuously stopped at the middle position CP. At the start time point of the 120-second cleaning sequence, the printing control device 200 operates to send a rearward movement instruction for the front-rear movement motor in the opening nozzle moving motor group 226, and a raising instruction for the up-down movement motor in the opening nozzle moving motor group 226, to the motor driving circuit 210, thereby driving these movement motors. According to the rearward movement instruction, the front-rear movement motor is controlled to cause the opening nozzles 74, 102, 108 to be continuously located at a position facing the upper opening of the ink can 38, and, according to the raising instruction, the up-down movement motor is controlled to cause the opening nozzles 74, 102, 108 to be continuously located at the raised position spaced apart upwardly from the ink can 38. The up-down movement motor in the injection nozzle moving motor group 224 keeps the injection nozzles 149 at the lowered position until a specific time point after the elapse of 80 seconds. The front-rear movement motor in the opening nozzle moving motor group 226 continuously keeps the opening nozzles 74, 102, 108 at the rearward position facing the upper opening of the ink can 38, until a specific time point just before the elapse of 60 seconds. The up-down movement motor in the opening nozzle moving motor group 226 continuously keeps the opening nozzles 74, 102, 108 at the raised position spaced apart upwardly from the ink can 38, until a specific time point after the elapse of 60 seconds.

At the start time point of the 120-second cleaning sequence, the printing control device 200 operates to send instructions to close solenoid valves consisting of the high-pressure air supply solenoid valve group 240, the bypass solenoid valve 80, the cleaning water supply solenoid group 242, and the injection nozzle solenoid valve 148, to the solenoid valve driving circuit 212, thereby closing a part of the solenoid valves and continuing the closed state of the remaining solenoid valves. At the start time point of the 120-second cleaning sequence, the printing control device 200 operates to send an instruction to switch to the flow path providing fluid communication between the high-pressure air supply solenoid valve 84 and the ink supply pipe 72 (the state notated as "Flow 2" in FIG. 7), to the solenoid valve driving circuit 212, thereby causing the three-way switching solenoid valve 82 to continue the switched state notated as "Flow 2". In order to allow the coupling port valves 142, 144 to be opened and allow the coupling port valves 124, 126, 128, 130 to be closed, at the start time point of the 120-second cleaning sequence, the printing control device 200 operates to send an instruction to open the coupling port valves 142, 144, and an instruction to close the coupling port valves 124, 126, 128, 130, to the air cylinder driving circuit 214, thereby controlling actuation of each air cylinder in the coupling port valve air cylinder group 244 for selectively opening and closing the coupling port valves. The three-way switching solenoid valve 82 continues the switched state notated as "Flow 2", until the time point corresponding to the elapse of 60 seconds. The cleaning water supply solenoid valves 112, 114, 116, 118, 120, 122 continue the closed state until a specific time point after the elapse of 60 seconds, and the coupling port valves 142, 144 continue the open state until the time point corresponding to the elapse of 60 seconds. The coupling port valves 126, 130 continue the closed state until a specific time point after the elapse of 60 seconds, and the coupling port valves 124, 128 continue the closed state until a time point corresponding to the elapse of 100 seconds.

In order to allow the injection nozzle solenoid valve 152 to be opened, and cause the front-rear movement motor in the injection nozzle moving motor group 224 to move the injection nozzles 149 forwardly toward the front machine frame 20, at a specific time point between a time point corresponding to the elapse of 0 second and a time point corresponding to the elapse of 10 seconds, the printing control device 200 operates to send an instruction to open the injection nozzle solenoid valve 152, to the solenoid valve driving circuit 212, and send a forward movement instruction for the front-rear movement motor in the injection nozzle moving motor group 224, to the motor driving circuit 210, thereby opening the injection nozzle solenoid valve 152 and moving the injection nozzles 149 forwardly. As a result of opening the injection nozzle solenoid valve 152, cleaning water is injected from the injection nozzles 149 being moved forwardly, toward the ink reservoir 26. In response to start of the injection of cleaning water, cleaning of the anilox roll 24 and the ink reservoir 26 is started. The injection nozzle solenoid valve 152 repeats, a large number of times, an open state in which it is opened to inject cleaning water for a given time period, and a closed state in which it is closed to stop the injection for a given time period, until a time point corresponding to the elapse of 80 seconds, and then continue the closed state until the termination time point of the 120-second cleaning sequence (elapsed time: 120 seconds). In this embodiment, the given time period for the injection is set to a value sufficiently greater than the given time period for the injection stop.

In order to allow the cleaning water supply solenoid valves 138, 140 to be opened at a time point between the time point corresponding to the elapse of 0 second and the time point corresponding to the elapse of 10 seconds and after the injection nozzle solenoid valve 152 is opened, and then to continue the open state until the time point corresponding to the elapse of 10 seconds, the printing control device 200 operates to send an opening instruction to the solenoid valve driving circuit 212, thereby opening the cleaning water supply solenoid valves 138, 140. In response to opening the cleaning water supply solenoid valves 138, 140, cleaning water supplied from the non-illustrated cleaning water source is supplied to each of the auxiliary drain pipes 134,136 through a corresponding one of the cleaning water supply solenoid valves 138, 140. In this embodiment, at a time point when the cleaning water supply solenoid valves 138, 140 are opened, cleaning water injected from the injection nozzles 149 to the ink reservoir 26 in response to opening the injection nozzle solenoid valve 152 for the first time after start of the 120-second cleaning sequence is in a state in which it has not yet flowed from the coupling ports 60, 62 into the auxiliary drain pipes 134, 136. As with the 60-second cleaning sequence, before cleaning water mixed with ink adhering on the ink reservoir 26 flows into the auxiliary drain pipes 134, 136 through the coupling ports 60, 62, clean cleaning water is supplied to each of the auxiliary drain pipes 134, 136 in response to opening the cleaning water supply solenoid valves 138, 140. Therefore, the inner surface of each of the auxiliary drain pipes 134, 136 is coated with the clean cleaning water, so that it is possible to reduce a situation where cleaning water mixed with ink adheres onto the inner surface of each of the auxiliary drain pipes 134, 136.

In order to cause the front-rear movement motor in the injection nozzle moving motor group 224 to switch the movement of the injection nozzles 149 from the forward movement to a rearward movement toward the rear machine frame 22, at a time point just before the elapse of 10 seconds, the printing control device 200 operates to send a rearward movement instruction for the front-rear movement motor in the injection nozzle moving motor group 224, to the motor driving circuit 210, thereby moving the injection nozzles 149 rearwardly. The front-rear directional reciprocating movement of the injection nozzles 149 is repeated until a specific time point after the elapse of 80 seconds, and, after the elapse of 80 seconds, the injection nozzles 149 is stopped at the middle position CP.

Cleaning water injected from the injection nozzles 149 to the ink reservoir 26 during the period between the start of the injection of cleaning water from the injection nozzles 149 and the time point corresponding to the elapse of 10 seconds in the 120-second cleaning sequence flows out into the cleaning pan 36 via the coupling port 60, 62 and the auxiliary drain pipes 134, 136 in response to opening the coupling port valves 142, 144. Further, cleaning water supplied through the cleaning water supply solenoid valves 138, 140 in response to opening the cleaning water supply solenoid valves 138, 140 also flows out into the cleaning water pan 36 via the auxiliary drain pipes 134, 136. Cleaning water pooled in the cleaning water pan 36 is drained into the drain channel 40 via the main drain pipe 132 and the opening nozzle 137. During a period during which the injection nozzle solenoid valve 152 is opened, the coupling port valves 124, 126, 128, 130 are kept in the closed state, and thus the coupling ports 48, 50, 52, 54 are closed. Thus, cleaning water pooled in the ink reservoir 26 flows out only through the auxiliary drain pipes 134, 136 but does not flow out through the auxiliary ink recovery pipes 90, 92, 94, 96.

In order to allow the bypass solenoid valve 80 to be opened at a specific time point after the elapse of 30 seconds, the printing control device 200 operates to send an opening instruction to the solenoid valve driving circuit 212, thereby opening the bypass solenoid valve 80. The open state of the bypass solenoid valve 80 is continued until a time point corresponding to the elapse of 40 seconds. Under the open state of the bypass solenoid valve 80, the bypass pipe 76 allows residual ink or ink droplets in the ink supply pipe 72 to flow toward the ink supply pipe 70 while bypassing the ink supply pump 42.

In order to allow the high-pressure air supply solenoid valves 84, 110 to be switched from the closed state to the open state, for a given time period in a period after the bypass solenoid valve 80 is opened and between a time point corresponding to the elapse of 30 seconds and the time point corresponding to the elapse of 40 seconds, in the 120-second cleaning sequence, the printing control device 200 operates to send an opening instruction to the solenoid valve driving circuit 212, thereby opening the high-pressure air supply solenoid valves 84, 110. In response to opening the high-pressure air supply solenoid valves 84, 110, high-pressure air from the high-pressure air compressor 220 is supplied to the ink supply pipe 72 through the high-pressure air supply solenoid valve 84 and the three-way switching solenoid valve 82, and also supplied to the main ink recovery pipe 104 through the high-pressure air supply solenoid valve 110. Under the first high-pressure air supply in the 120-second cleaning sequence, ink or ink droplets still remaining on the inner surface of the ink supply pipe 72 is/are pushed out toward the ink supply pipe 70 via the bypass pipe 76 and recovered into the ink can 38 via the ink supply passage 70 and the opening nozzle 74. Further, under the first high-pressure air supply in the 120-second cleaning sequence, ink or ink droplets still remaining on the inner surface of the main ink recovery pipe 104 is/are pushed out toward the opening nozzle 108 and recovered into the ink can 38 via the opening nozzle 108.

In order to allow the bypass solenoid valve 80 to be opened at a specific time point after the elapse of 50 seconds, the printing control device 200 operates to send an opening instruction to the solenoid valve driving circuit 212, thereby opening the bypass solenoid valve 80. The open state of the bypass solenoid valve 80 is continued until the time point corresponding to the elapse of 60 seconds.

In order to allow the high-pressure air supply solenoid valves 84, 110 to be switched from the closed state to the open state, for a given time period in a period after the bypass solenoid valve 80 is opened and between the time point corresponding to the elapse of 50 seconds and the time point corresponding to the elapse of 60 seconds, in the 120-second cleaning sequence, the printing control device 200 operates to send an opening instruction to the solenoid valve driving circuit 212, thereby opening the high-pressure air supply solenoid valves 84, 110. In response to opening the high-pressure air supply solenoid valves 84, 110, high-pressure air from the high-pressure air compressor 220 is supplied to the ink supply pipe 72 through the high-pressure air supply solenoid valve 84 and the three-way switching solenoid valve 82, and also supplied to the main ink recovery pipe 104 through the high-pressure air supply solenoid valve 110. Under the second high-pressure air supply in the 120-second cleaning sequence, ink or ink droplets still slightly remaining on the inner surface of the ink supply pipe 72 is/are pushed out toward the ink supply pipe 70 via the bypass pipe 76 and recovered into the ink can 38 via the ink supply passage 70 and the opening nozzle 74. Further, under the second high-pressure air supply in the 120-second cleaning sequence, ink or ink droplets slightly remaining on the inner surface of the main ink recovery pipe 104 is/are pushed out toward the opening nozzle 108 and recovered into the ink can 38 via the opening nozzle 108.

In order to cause the front-rear movement motor in the opening nozzle moving motor group 226 to move the opening nozzles 74, 102, 108 from the rearward position to the forward position facing the drain channel 40, at a specific time point just before the elapse of 60 seconds, the printing control device 200 operates to send a control instruction to the motor driving circuit 210, thereby driving the front-rear movement motor in the opening nozzle moving motor group 226. The opening nozzles 74, 102, 108 are kept at the forward position until the termination time point of the 120-second cleaning sequence (the elapsed time: 120 seconds).

In order to allow the three-way switching solenoid valve 82 to be switched from the flow path providing fluid communication between the high-pressure air supply solenoid valve 84 and the ink supply pipe 72 (to the state notated as "Flow 2" in FIG. 6) to the flow path providing fluid communication between the coupling port 46 and the ink supply pipe 72 (to the state notated as "Flow 1" in FIG. 6), at the time point corresponding to the elapse of 60 seconds, the printing control device 200 operates to send a switching instruction to the solenoid valve driving circuit 212, thereby switching the three-way switching solenoid valve 82. As a result of switching the three-way switching solenoid valve 82 to the state "Flow 1", cleaning water pooled in the ink reservoir 26 is allowed to flow into the ink supply pipe 72 via the coupling port 46.

In order to allow the coupling port valve 142, 144 to be switched from open state to the closed state at the time point corresponding to the elapse of 60 seconds, the printing control device 200 operates to send an instruction to close the coupling port valve 142, 144, to the air cylinder driving circuit 214, thereby controlling actuation of each air cylinder in the coupling port valve air cylinder group 244 for selectively opening and closing the coupling port valves. Under the closed state of the coupling port valve 142, 144, cleaning water pooled in the ink reservoir 26 is stopped from flowing out through the coupling port valve 142, 144.

In order to allow the ink supply pump 42 and the ink recovery pump 44 to be reversely rotated from the stopped state, and cause the up-down movement motor in the opening nozzle moving motor group 226 to move the opening nozzles 74, 102, 108 to the lowered position, at a specific time point after the elapse of 60 seconds, the printing control device 200 operates to send an instruction to reversely rotate the ink supply pump 42 and the ink recovery pump 44, and a lowering instruction for the up-down movement motor in the opening nozzle moving motor group 226, to the motor driving circuit 210, thereby driving the driving motors of these pumps and the up-down movement motor in the opening nozzle moving motor group 226. According to the lowering instruction, the up-down movement motor is controlled to move the opening nozzles 74, 102, 108 down to the lowered position close to the drain channel 40. As a result of the movement of the opening nozzles 74, 102, 108 to the lowered position, it becomes possible to reliably drain cleaning water into the drain channel 40 even when a large amount of cleaning water is drained from the opening nozzles 74, 102, 108 at once. The up-down movement motor in the opening nozzle moving motor group 226 keeps the opening nozzles 74, 102, 108 at the lowered position until the termination time point of the 120-second cleaning sequence.

After the three-way switching solenoid valve 82 is switched to the state "Flow 1", the ink supply pump 42 is reversely rotated at the specific time point after the elapse of 60 seconds. Thus, cleaning water pooled in the ink reservoir 26 flows out to the ink supply pipe 72 through the coupling port 46 and the three-way switching solenoid valve 82, and cleaning water from the ink supply pipe 72 is suctioned and pushed out toward the ink supply pipe 70 by the ink supply pump 42. Cleaning water from the ink supply pipe 70 is drained into the drain channel 40 via the opening nozzle 74.

During a period between the time point corresponding to the elapse of 60 seconds, and the time point corresponding to the elapse of 80 seconds, i.e., a time point when injection of cleaning water from the injection valves 149 is terminated, cleaning water mixed with ink adhering on the ink reservoir 26 is filled inside the ink supply pipes 72, 70. Thus, the ink supply pump 42 can push out the cleaning water from the ink supply pipe 72 to the ink supply pipe 70 without large load. Further, during the period between the time point corresponding to the elapse of 60 seconds and the time point corresponding to the elapse of 80 seconds, the ink supply pump 42 is operated to continuously suction and push out the cleaning water. This operation makes it possible to wash away ink remaining inside the flexible pipe 160 of the ink supply pump 42.

In order to allow the coupling port valves 126, 130 to be switched from the closed state to the open state, at a specific time point after the elapse of 60 seconds, the printing control device 200 operates to send an opening instruction to the air cylinder driving circuit 214, thereby actuating the air cylinders for selectively opening and closing the coupling port valves 126, 130. The coupling port valves 126, 130 continue the open state until a time point corresponding to the elapse of 70 seconds. Under the open state of the coupling port valves 126, 130, cleaning water pooled in the ink reservoir 26 flows into the ink pans 32, 34 via the short auxiliary ink recovery pipes 94, 96. Cleaning water pooled in the ink pan 32 is drained into the drain channel 40 via the front ink recovery pipe 86 and the opening nozzle 102. Cleaning water pooled in the ink pan 34 is suctioned into the ink recovery pump 44 via the coupling recovery pipe 106, and pushed out from the ink recovery pump 44 toward the main ink recovery pipe 1, along with the reverse rotation of the ink recovery pump 44. Cleaning water from the ink recovery pipe 104 is drained into the drain channel 40 via the opening nozzle 108. During the period between the time point corresponding to the elapse of 60 seconds, and the time point corresponding to the elapse of 80 seconds, i.e., the time point when injection of cleaning water from the injection valves 149 is terminated, cleaning water mixed with ink adhering on the ink reservoir 26 is filled inside the coupling recovery pipe 106 and the main ink recovery pipe 104.

In order to allow the cleaning water supply solenoid valves 112, 114, 116, 118, 120, 122, 138, 140 to be switched from the closed state to the open state at the same time, at a specific time point after the elapse of 60 seconds, the printing control device 200 operates to send an opening instruction to the solenoid valve driving circuit 212, thereby opening these cleaning water supply solenoid valves. The cleaning water supply solenoid valves 138, 140 continue the open state until the time point corresponding to the elapse of 70 seconds. The cleaning water supply solenoid valves 112, 118 continue the open state until a specific time point after the elapse of 70 seconds. The cleaning water supply solenoid valves 114, 116, 120, 122 continue the open state until a specific time point after the elapse of 70 seconds. Under the open state of the cleaning water supply solenoid valves 112, 114, 116, cleaning water from the non-illustrated cleaning water supply source flows into the ink pan 32 via the auxiliary ink recovery pipes 90, 92 and the surplus ink recovery pipe 98. Under the open state of the cleaning water supply solenoid valves 118, 120, 122, cleaning water from the non-illustrated cleaning water supply source flows into the ink pan 34 via the auxiliary ink recovery pipes 92, 96 and the surplus ink recovery pipe 100. Under the open state of the cleaning water supply solenoid valves 138, 140, cleaning water from the non-illustrated cleaning water supply source flows into the cleaning water pan 36 via the auxiliary drain pipes 134, 136. Under the supply of clean cleaning water from the non-illustrated cleaning water supply source, each of the auxiliary ink recovery pipes 90, 92, 94, 96 and the auxiliary drain pipes 134, 136 is washed and cleaned.

In order to allow the cleaning water supply solenoid valves 114, 116, 120, 122 to be switched from the closed state to the open state, at the time point corresponding to the elapse of 80 seconds, the printing control device 200 operates to send an opening instruction to the solenoid valve driving circuit 212, thereby opening the cleaning water supply solenoid valves 114, 116, 120, 122. The cleaning water supply solenoid valves 114, 116, 120, 122 continue the open state until a time point corresponding to the elapse of 90 seconds. The cleaning water supply solenoid valves 114, 116, 120, 122 are switched from the open state to the closed state at the time point corresponding to the elapse of 90 seconds, and then continue the closed state until the termination time point of the 120-second cleaning sequence. Under the open state of the cleaning water supply solenoid valves 114, 116, cleaning water from the non-illustrated cleaning water supply source flows into the ink pan 32 via the short auxiliary ink recovery pipe 94 and the surplus ink recovery pipe 98. Under the open state of the cleaning water supply solenoid valves 120, 122, cleaning water from the non-illustrated cleaning water supply source flows into the ink pan 34 via the short auxiliary ink recovery pipe 96 and the surplus ink recovery pipe 100. Under the supply of clean cleaning water from the non-illustrated cleaning water supply source, each of the short auxiliary ink recovery pipes 94, 96, the ink pans 32, 34, the front ink recovery pipe 86, the coupling recovery pipe 106, the ink recovery pump 44, the main ink recovery pipe 104, and the opening nozzles 102, 108 is washed and cleaned.

At a specific time point after the elapse of 80 seconds, the printing control device 200 operates to send a raising instruction for the up-down movement motor in the injection nozzle moving motor group 224, to the motor driving circuit 210, thereby driving this up-down movement motor. According to the raising instruction, the up-down movement motor is controlled to move the injection nozzles 149 to the raised position. The injection nozzles 149 are kept at the raised position until the termination time point of the 120-second cleaning sequence.

In order to allow the ink recovery pump 44 to be stopped from the reverse rotation state at a specific time point after the elapse of 80 seconds, the printing control device 200 operates to send a stopping instruction to the motor driving circuit 210, thereby stopping the driving motor of the ink recovery pump 44. The ink recovery pump 44 continues the stopped state until a specific time point after the elapse of 90 seconds. At the specific time point after the elapse of 90 seconds, the ink recovery pump 44 is switched from the stopped state to the reverse rotation state, and then continues the reverse rotation state until the termination time point of the 120-second cleaning sequence.

In the 120-second cleaning sequence, from the time point when injection of cleaning water from the injection nozzles 149 is stopped, i.e., the time point corresponding to the elapse of 80 seconds, the inside of each of the ink supply pipes 72, 70 and the main ink recovery pipe 104 changes from a state in which it is filled only with cleaning water to a state in which air starts to be mixed with cleaning water. The volume of air to be mixed with cleaning water gradually increases, and, at the time point corresponding to the elapse of 100 seconds, a state appears in which a large volume of air exists inside each of the ink supply pipes 72, 70 and the main ink recovery pipe 104, and cleaning water or cleaning water droplets slightly adhere(s) and remain(s) on the inner surface of the pipe. The ink supply pump 42 continues the reverse rotation state even after the elapse of 80 seconds and until a specific time point after the elapse of 100 seconds. The ink supply pump 42 being reversely rotated is almost not effective in transporting cleaning water. However, since the ink supply pump 42 is operated to continuously suction and push out the clean cleaning water mixed with no ink, it is possible to cleanly wash the inside of the flexible pipe 160 of the ink supply pump 42 through the operation.

In order to allow the three-way switching solenoid valve 82 to be switched from the flow path providing fluid communication between the connection port 46 and the ink supply pipe 72 (the state notated as "Flow 1" in FIG. 6) to the flow path providing fluid communication between the high-pressure air supply solenoid valve 84 and the ink supply pipe 72 (to the state notated as "Flow 2" in FIG. 6), at the time point corresponding to the elapse of 100 seconds, and then to continue the switched state until the termination time point of the 120-second cleaning sequence, the printing control device 200 operates to send a switching instruction to the solenoid valve driving circuit 212, thereby switching the three-way switching solenoid valve 82.

In order to allow the coupling port valves 124, 126, 128, 130, 142, 144 to be switched from the closed position to the open position at the same time at the time point corresponding to the elapse of 100 seconds, the printing control device 200 operates to send an opening instruction to the air cylinder driving circuit 214, thereby actuating the air cylinders each for selectively opening and closing a respective one of these coupling port valves. In response to opening the coupling port valves 124, 126, 128, 130, 142, 144, the coupling ports 48, 50, 52, 54, 60, 62 are opened at the same time. As a result of opening the coupling ports 48, 52, cleaning water pooled in the ink reservoir 26 flows into the ink pan 32 via the auxiliary recovery pipes 90, 94, and then cleaning water pooled in the ink pan 32 is drained into the drain channel 40 via the front ink recovery pipe 86 and the opening nozzle 102, under the cleaning water's own weight. As a result of opening the coupling ports 50, 54, cleaning water pooled in the ink reservoir 26 flows into the ink pan 34 via the auxiliary recovery pipes 92, 96, and then cleaning water pooled in the ink pan 34 is suctioned via the coupling recovery pipe 106 and pushed out toward the main ink recovery pipe 104, along with the reverse rotation of the ink recovery pump 44. Cleaning water from the main ink recovery pipe 104 is drained into the drain channel 40 via the opening nozzle 108. As a result of opening the coupling ports 60, 62, cleaning water pooled in the ink reservoir 26 flows into the cleaning water pan 36 via the auxiliary drain pipes 134, 136, and then cleaning water pooled in the cleaning water pan 36 is drained into the drain channel 40 via the main drain pipe 132 and the opening nozzle 137. The coupling port valves 126, 130 continue the open state until a time point corresponding to the elapse of 110 seconds, and are switched from the open state to the closed state at the time point corresponding to the elapse of 110 seconds. Then, they continue the closed state until the termination time point of the 120-second cleaning sequence. The coupling port valves 124, 128 continue the open state until a specific time point after the elapse of 110 seconds, and are switched from the open state to the closed state at this specific time point. Then, they continue the closed state until the termination time point of the 120-second cleaning sequence. The coupling port valves 142, 144 continue the open state until the termination time point of the 120-second cleaning sequence.

In order to allow the cleaning water supply solenoid valves 112, 118 to be switched from the closed state to the open state at a specific time point after the elapse of 100 seconds, and then to continue the open state for a given time period, the printing control device 200 operates to send an opening instruction to the solenoid valve driving circuit 212, thereby opening the cleaning water supply solenoid valves 112, 118. Under the open state of the cleaning water supply solenoid valve 112, cleaning water from the non-illustrated cleaning water supply source flows into the ink pan 32 via the long auxiliary ink recovery pipe 90. Under the open state of the cleaning water supply solenoid valve 118, cleaning water from the non-illustrated cleaning water supply source flows into the ink pan 34 via the long auxiliary ink recovery pipe 92. Under the supply of clean cleaning water from the non-illustrated cleaning water supply source, each of the long auxiliary ink recovery pipes 90, 92, the ink pans 32, 34, the front ink recovery pipe 104, and the opening nozzles 102, 108 is washed and cleaned. The cleaning water supply solenoid valves 112, 118 are switched from the open state to the closed state at a time point corresponding to the elapse of a given time period, and continue the closed state until the termination time point of the 120-second cleaning sequence.

In order to allow the ink supply pump 42 to be stopped from the reverse rotation state at the time point corresponding to the elapse of 100 seconds, and then to continue the stopped state until the termination time point of the 120-second cleaning sequence, the printing control device 200 operates to send a stopping instruction to the motor driving circuit 210, thereby stopping the ink supply pump 42. Further, in order to allow the bypass solenoid valve 80 to be switched from the closed state to the open state at a specific time point after the elapse of 100 seconds, and then to continue the open state until the termination time point of the 120-second cleaning sequence, the printing control device 200 operates to send an opening instruction to the solenoid valve driving circuit 212, thereby opening the bypass solenoid valve 80.

In order to allow the high-pressure air supply solenoid valves 84, 110 to be switched from the closed state to the open state at a specific time point after the elapse of 100 seconds, and then to continue the open state until the time point corresponding to the elapse of 110 seconds, the printing control device 200 operates to send an opening instruction to the solenoid valve driving circuit 212, thereby opening the high-pressure air supply solenoid valves 84, 110. Under the open state of the high-pressure air supply solenoid valves 84, 110, high-pressure air from the high-pressure compressor 220 is supplied to each of the ink supply pipe 72 and the main ink recovery pipe 104. Under the third high-pressure air supply in the 120-second cleaning sequence, cleaning water or cleaning water droplets remaining inside the ink supply pipe 72 is/are pushed out to the ink supply pipe 70 via the bypass pipe 76. Cleaning water from the ink supply pipe 70 is drained into the drain channel 40 via the opening nozzle 74. Under the third high-pressure air supply in the 120-second cleaning sequence, cleaning water or cleaning water droplets remaining inside the main ink recovery pipe 104 is/are pushed out toward the opening nozzle 108, and drained into the drain channel 40 via the opening nozzle 108. During a period during which the third high-pressure air supply is performed, the ink recovery pump 44 is reversely rotated to suction cleaning water slightly remaining in the ink pan 34 via the coupling recovery pipe 106 and push out the suctioned cleaning water to the main ink recovery pipe 104.

At a time point when the third high-pressure air supply is started in the 120-second cleaning sequence, i.e., at the time point after the elapse of 100 seconds, the inside of each of the ink supply pipe 72 and the main ink recovery pipe 104 is in a state in which a large volume of air and a small amount of cleaning water are mixed together therein. Thus, there is difficulty in suctioning cleaning water mixed with air inside the ink supply pipe 72 and pushing out the cleaning water toward the drain channel 40, using only the ink supply pump 42, because large load is imposed on the ink supply pump 42. In this embodiment, based on performing the third high-pressure air supply, it becomes possible to quickly drain cleaning water mixed with a large volume of air, from the ink supply pipes 72, 70 and the main ink recovery pipe 104.

In order to allow the cleaning water supply solenoid valves 138, 140 to be switched from the closed state to the open state at the time point corresponding to the elapse of 110 seconds, and then to continue the open state for a given time period, the printing control device 200 operates to send an opening instruction to the solenoid valve driving circuit 212, thereby opening the cleaning water supply solenoid valves 138, 140. In response to opening the cleaning water supply solenoid valves 138, 140, cleaning water from the non-illustrated cleaning water supply source is supplied to the auxiliary drain pipes 134, 136 through the cleaning water supply solenoid valves 138, 140 to wash and clean each of the auxiliary drain pipes 134, 136, the cleaning water pan 36, the main drain pipe 132 and the opening nozzle 137. After the elapse of the given time period, the cleaning water supply solenoid valves 138, 140 are switched from the open state to closed state, and then continue the closed state until the termination time point of the 120-second cleaning sequence.

In order to allow the high-pressure air supply solenoid valves 84, 110 to be switched from the closed state to the open state at a specific time point after the elapse of 110 seconds, and then to continue the open state until the termination time point of the 120-second cleaning sequence, the printing control device 200 operates to send an opening instruction to the solenoid valve driving circuit 212, thereby opening the high-pressure air supply solenoid valves 84, 110. In response to opening the high-pressure air supply solenoid valves 84, 110, high-pressure air from the high-pressure compressor 220 is supplied to each of the ink supply pipe 72 and the main ink recovery pipe 104. Under the fourth high-pressure air supply in the 120-second cleaning sequence, cleaning water or cleaning water droplets remaining inside the ink supply pipe 72 is/are pushed out to the ink supply pipe 70 via the bypass pipe 76. Cleaning water from the ink supply pipe 70 is drained into the drain channel 40 via the opening nozzle 74. Under the fourth high-pressure air supply in the 120-second cleaning sequence, cleaning water or cleaning water droplets remaining inside the main ink recovery pipe 104 is/are pushed out toward the opening nozzle 108, and drained into the drain channel 40 via the opening nozzle 108. During a period during which the fourth high-pressure air supply is performed, the ink recovery pump 44 is reversely rotated to suction cleaning water or cleaning water droplets remaining inside the coupling recovery pipe 106 and push out the suctioned cleaning water to the main ink recovery pipe 104.

When the elapsed time from the start of the 120-second cleaning sequence has reached 120 seconds, the timer 208 sends information indicative of the elapse of 120 seconds to the printing control device 200, and thus the printing control device 200 operates to stop the time measurement operation after setting the timer 208 to the initial state. The printing control device 200 also operates to terminate the execution of the 120-second cleaning sequence illustrated in FIG. 7.

[Effect of Embodiment]

In this embodiment, the main ink recovery pipe 104 elongatedly extends from the rear machine frame 22 to the front machine frame 20 in the front-rear direction, and the ink supply pipe 72 also elongatedly extends from the middle position CP to the front machine frame 20 in the front-rear direction. In an ink recovery direction along which ink is recovered from the ink reservoir 26 and the ink pan 34 toward the ink can 38, high-pressure air is supplied from an upstreammost-side portion of the main ink recovery pipe 104 coupled to the ink recovery pump 44, toward the downstream-side ink can 38, and also supplied from an upstreammost-side portion of the ink supply pipe 72 coupled to the three-way switching solenoid valve 82 disposed close to the coupling port 46, toward the downstream-side bypass pipe 76 via the high-pressure air supply solenoid valve 84. This makes it possible to push out ink or ink droplets remaining on the inner surface of each of the main ink recovery pipe 104 and the ink supply pipe 72, toward the ink can 38, to quickly recover the residual ink over the entire length of the pipe.

Generally, with a view to preventing large load from being imposed on an ink supply pump when suctioning ink from an ink can to supply the ink, the ink pump is disposed at a position close to the ink can, in many cases. In this embodiment, the ink supply pump 42 is disposed at a position close to the ink can 38 as shown in FIG. 2. The ink supply pump 42 is also used for recovering ink from the ink reservoir 26 toward the ink can 38 by being reversely rotated. In the ink recovery direction along which ink is recovered from the ink reservoir 26 and the ink pan 34 toward the ink can 38, the ink supply pump 42 is coupled to the ink supply pipe 72 at a position downstream of the high-pressure air supply solenoid valve 84. In a situation where residual ink or ink droplets mixed with air is/are recovered, even if the ink supply pump 42 is reversely rotated, the resulting suction force is small, so that it is impossible to sufficiently suction residual ink or ink droplets remaining on the inner surface of the relatively long ink supply pipe 72 coupled to the upstream side of the ink supply pump 42. Therefore, in this embodiment, when recovering residual ink or ink droplets in the ink supply pipe 72, the ink supply pump 42 is stopped during a period between the time point just before the elapse of 50 seconds in the ink recovery sequence illustrated in FIG. 6 and the time point corresponding to the elapse of 30 seconds in the 60-second cleaning sequence. During the period during which the ink supply pump 42 is stopped, residual ink or ink droplets in the ink supply pipe 72 is/are recovered via the bypass pipe 76. This allows the ink supply pump 42 to be used for both supply of ink to the ink reservoir 26 and recovery of ink from the ink reservoir 26, and makes it possible to, when recovering residual ink or ink droplets from the ink supply pipe 72, quickly recover residual ink or ink droplets via the bypass pipe 76 based on the high-pressure air, while preventing large load from being imposed on the ink supply pump 42.

In this embodiment, in the ink recovery direction along which ink is recovered from the ink reservoir 26 toward the ink can 38 via the ink pan 34, the ink recovery pump 44 is coupled to the main ink recovery pipe 104 at a position upstream of the high-pressure air supply solenoid valve 110. When high-pressure air is suppled during the period between the specific time point after the elapse of 50 seconds and the time point just before the elapse of 60 seconds in the ink recovery sequence illustrated in FIG. 6, to recover residual ink or ink droplets mixed with air, the ink recover pump 44 continues the reverse rotation state in the same manner as when recovering ink mixed with no air from the ink reservoir 26. The ink recovery pump 44 is disposed at a position close to the ink pan 34, and coupled to the ink pan 34 via the relatively short coupling recovery pipe 106. This allows the ink recovery pump 44 to suction ink remaining in the ink pan 34 disposed at a position close thereto, without large load, and push out the suctioned ink to the main ink recovery pipe 104.

In this embodiment, in the 60-second cleaning sequence illustrated in FIG. 6 and the 120-second cleaning sequence illustrated in FIG. 7, cleaning water is injected from the injection nozzles 149 to the ink reservoir 26. Cleaning water injected to the ink reservoir 26 is drained into the drain channel 40 via the auxiliary drain pipes 134, 136, the cleaning water pan 36, and the main drain pipe 132. During the period during which cleaning water is injected from the injection nozzles 149 to the ink reservoir 26, high-pressure air is supplied to the ink supply pipe 72 and the main ink recovery pipe 104. This makes it possible to, in parallel with the cleaning operation of cleaning the anilox roll 24 and the ink reservoir 26 by the injection of cleaning water from the injection nozzles 149, reliably recover ink or ink droplets remaining in the ink supply pipe 72 and the main ink recovery pipe 104 by high-pressure air, while taking a relatively long time period which is equivalent to a time period during which cleaning water is injected from the injection nozzles 149 to the ink reservoir 26.

In this embodiment, in the ink recovery sequence illustrated in FIGS. 6 and 7, high-pressure air is supplied to the ink supply pipe 72 and the main ink recovery pipe 104 once for a given short time period between the specific time point after the elapse of 50 seconds and the time point just before the elapse of 60 seconds, to recover ink or ink droplets remaining on the inner surface of each of the ink supply pipe 72 and the main ink recovery pipe 104. After termination of the ink recovery sequence, during the period between the time point corresponding to the elapse of 0 second and the time point corresponding to the elapse of 30 seconds in the 60-second cleaning sequence illustrated in FIG. 6, or during the period between the time point corresponding to the elapse of 0 second and the time point corresponding to the elapse of 60 seconds in the 120-second cleaning sequence illustrated in FIG. 7, high-pressure air is intermittently supplied to the ink supply pipe 72 and the main ink recovery pipe 104 twice, to recover ink or ink droplets remaining on the inner surface of each of the ink supply pipe 72 and the main ink recovery pipe 104. As above, the supply of high-pressure air is performed in each of the ink recovery sequence and the cleaning sequence in a divided manner. This makes it possible to early start the cleaning sequence and thus shorten a time period for order change, as compared with a case where the supply of high-pressure air is performed only in the ink recovery sequence in a concentrated manner.

In this embodiment, in the 60-second cleaning sequence illustrated in FIG. 6 or the 120-second cleaning sequence illustrated in FIG. 7, cleaning water is injected from the injection nozzles 149 to the ink reservoir 26. At the time point after termination of the injection of cleaning water from the injection nozzles 149 and after the elapse of 40 seconds in the 60-second cleaning sequence or after the elapse of 100 seconds in the 129-second cleaning sequence, high-pressure air is supplied to the ink supply pipe 72 and the main ink recovery pipe 104. This makes it possible to quickly drain cleaning water remaining in the ink supply pipe 72 and the main ink recovery pipe 104.

In this embodiment, in the ink recovery direction along which ink is recovered from the ink reservoir 26 toward the ink can 38 via the ink pan 34, the ink recovery pump 44 composed of a tubing pump is disposed upstream of the high-pressure air supply solenoid valve 110. In this case, the flexible pipe of the ink recovery pump 44 is periodically compressed to restrict a situation where, when high-pressure air is supplied to the main ink recovery pipe 10 through the high-pressure air supply solenoid valve 110, the supplied high-pressure air flows toward the coupling recovery pipe 106. This makes it possible to reliably supply high-pressure air to the main ink recovery pipe 104.

In this embodiment, when supplying high-pressure air to the ink supply pipe 72 through the high-pressure air supply solenoid valve 84, the fluid communication between the ink supply pipe 72 and the coupling port 46 is completely shut off by the three-way switching solenoid valve 82. This makes it possible to completely restrict a situation where, when high-pressure air is supplied to the ink supply pipe 72 through the high-pressure air supply solenoid valve 84, the supplied high-pressure air flows out toward the coupling port 36, and reliably supply high-pressure air to the ink supply pipe 72.

In this embodiment, the front ink recovery pipe 86 is a relatively short pipe coupling the ink pan 32 fixed to the front machine frame 20 and the ink can 38 disposed at a position close to the front machine frame 20 together. The total amount of ink or ink droplets remaining on the inner surface of the front ink recovery pipe 86 is relatively small, because the front ink recovery pipe 86 is relatively short. Thus, the front ink recovery pipe 86 is configured to be devoid of means to recover residual ink or ink droplets based on high-pressure air. This makes it possible to contribute to simplifying the configuration of the corrugated paperboard sheet printing machine 1.

In this embodiment, through manipulation of the setting manipulation unit 206, a worker can select one of the 60-second cleaning sequence illustrated in FIG. 6 and the 120-second cleaning sequence illustrated in FIG. 7. This makes it possible to selectively execute the two cleaning sequences having different cleaning time periods, depending on situations such as the state of adhesion of ink on the anilox roll 24, and the type of ink used.

In this embodiment, according to the reverse rotation of the ink supply pump 42, ink is recovered from the ink reservoir 26 via the coupling port 46. In the ink recovery direction along which ink is recovered from the ink reservoir 26 via the coupling port 46, the rising slope portion 78 of the ink supply pipe 72 is disposed at a position immediately downstream of the coupling port 46. The three-way switching solenoid valve 82 is disposed at a position downstream of and close to the top of the rising slope portion 78. The ink supply pump 42 is stopped at the time point just before the elapse of 50 seconds in the 60-second cleaning sequence illustrated in FIG. 6. Thus, at the time point when the ink supply pump 42 is stopped, ink existing between the coupling port 46 and the rising slope portion 78 cannot rise to the top of the rising slope portion 78. This makes it possible to prevent ink from newly flowing in the ink supply pipe 72, without providing any special opening-closing device. In a case in which an opening-closing device for selectively opening and closing the coupling port 46 is provided, in place of the rising slope portion 78, a configuration can be contemplated in which, when the three-way switching solenoid valve 82 is switched to the state notated as "Flow 2", the opening-closing device for selectively opening and closing the coupling port 46 is closed in conjunction with this switching of the three-way switching solenoid valve 82. However, this configuration involves a problem that ink pools between the coupling port 46 and the three-way switching solenoid valve 82. In view of this, in this embodiment, the rising slope portion 78 is provided. Thus, when the three-way switching solenoid valve 82 is switched to the state notated as "Flow 2", it becomes possible to prevent the situation where ink pools between the coupling port 46 and the three-way switching solenoid valve 82.

In the present invention, the up-down movement motor for selectively moving the opening nozzles 74, 102, 108 upwardly and downwardly, in the opening nozzle moving motor group 226, is driven to allow the opening nozzles 74, 102, 108 to be located at the raised position during the period between the specific time point before the elapse of 50 seconds in the ink recovery sequence illustrated in FIG. 6, and the specific time point before the elapse of 40 seconds in the 60-second cleaning sequence or the specific time point before the elapse of 70 seconds in the 120-second cleaning sequence illustrated in FIG. 7. Thus, when high-pressure air is supplied to the ink supply pipe 72 and the main ink recovery pipe 104, the distal ends of the opening nozzles 74, 102, 108 are located above an ink level in the ink can 38. This makes it possible to suppress a situation where high-pressure air flowing out from the ink supply pipe 72 and the main ink recovery pipe 104 via the opening nozzles 74, 108 causes scattering of ink inside the ink can 38.

<Correspondence Relationship in Configuration>

Each of the corrugated paperboard sheet printing machine 1, the printing plate 14 and the anilox roll 24 is one example of a respective one of "printing machine", "printing plate" and "ink transfer roll" in the appended claims. The front machine frame 20 and the rear machine frame 22 are one example of "pair of machine frames" in the appended claims. The front-rear direction in FIG. 2 is one example of "rotational axis direction of the ink transfer roll" in the appended claims. Each of the ink reservoir 26 and the ink can 38 is one example of a respective one of "ink reservoir" and "ink container" in the appended claims. The ink supply pipes 70, 72 are one example of "ink supply pipe" in the appended claims. The ink pan 34 is one example of "ink pool" in the appended claims. The main ink recovery pipe 104 is one example of "ink recovery pipe" in the appended claims. The ink recovery direction along which ink is recovered from the ink reservoir 26 toward the ink can 38 via the ink pan 34 is one example of "ink recovery direction" in the appended claims. The ink recovery pump 44 composed of a tubing pump is one example of "first restriction device" in the appended claims, and is one example of "first tubing pump" in the appended claims. The high-pressure air compressor 220 is one example of "high-pressure air generation part" in the appended claims. The high-pressure air supply solenoid valve 110 is one example of "first coupling part" in the appended claims, and is one example of "opening-closing device" in the appended claims. The printing control device 200 for controlling the opening-closing operation of the high-pressure air supply solenoid valve 110, and the solenoid valve driving circuit 212, are one example of "first high-pressure air control device" in the appended claims, and is one example of "opening-closing control part" in the appended claims. The middle position CP is one example of "roll middle position" in the appended claims. A portion of the main ink recovery pipe 104 coupled to the ink recovery pump 44 is one example of "inflow port of the ink recovery pipe" in the appended claims, and a portion of the main ink recovery pipe 104 coupled to the opening nozzle 108 is one example of "outflow port of the ink recovery pipe" in the appended claims. The flexible tube 160 is one example of "flexible tube" in the appended claims, and the rotor 162 and the pressing rollers 164A, 164B are one example of "rotor" in the appended claims. The three-way switching solenoid valve 82 is one example of the second restriction device in the appended claims, and is one example of "path switching device" in the appended claims. The high-pressure air supply solenoid valve 84 is one example of "second coupling part" in the appended claims. The printing control device 200 for controlling the opening-closing operation of the high-pressure air supply solenoid valve 84 and the three-way switching solenoid valve 82, and the solenoid valve driving circuit 212, are one example of "second high-pressure air control device" in the appended claims, and is one example of "switching control part" in the appended claims. A portion of the ink supply pipe 72 coupled to the coupling port 46 is one example of "supply port of the ink supply pipe" in the appended claims. The ink supply pump 42 composed of a tubing pump is one example of "second restriction device" in the appended claims. The bypass pipe 76 is one example of "bypass path" in the appended claims. The bypass solenoid valve 80 is one example of "bypass opening-closing device" in the appended claims. The injection unit 148 is one example of "cleaning water supply unit" in the appended claims. The main drain pipe 132 and the auxiliary drain pipes 134, 136 are one example of "drain pipe" in the appended claims. Each of the printing sequence and the ink recovery sequence illustrated in FIG. 6 is one example of a respective one of "printing step" and "ink recovery step" in the appended claims. The 60-second cleaning sequence illustrated in FIG. 6 and the 120-second cleaning sequence illustrated in FIG. 7 are one example of "cleaning step" in the appended claims. The cleaning operation during the period between the time point corresponding to the elapse of 0 second and the time point corresponding to the elapse of 30 second in the 60-second cleaning sequence illustrated in FIG. 6 and the cleaning operation during the period between the time point corresponding to the elapse of 0 second and the time point corresponding to the elapse of 60 second in the 120-second cleaning sequence illustrated in FIG. 7 are one example of "first cleaning step" in the appended claims. The cleaning operation during the period between the time point corresponding to the elapse of 30 seconds and the time point corresponding to the elapse of 60 second in the 60-second cleaning sequence illustrated in FIG. 6 and the cleaning operation during the period between the time point corresponding to the elapse of 60 seconds and the time point corresponding to the elapse of 120 second in the 120-second cleaning sequence illustrated in FIG. 7 are one example of "second cleaning step" in the appended claims.

<Modifications>

It should be understood that the present invention is not limited to the above embodiment, but various changes and modifications may be made therein without departing from the spirit and scope thereof as set forth in appended claims. Some examples of the modifications will be described below.

(1) In the above embodiment, in the ink recovery direction along which ink is recovered from the ink reservoir 26 toward the ink can 38 via the ink pan 34, the ink recovery pump 44 composed of a tubing pump is disposed upstream of the high-pressure air supply solenoid valve 110. However, the present invention is not limited to this arrangement. For example, a configuration may be employed in which a three-way switching solenoid valve similar to the three-way switching solenoid valve 82 is coupled to the coupling recovery pipe 106 at a position upstream of the ink recovery pump 44 in the ink recovery direction, and the high-pressure air supply solenoid valve 110 is coupled to this three-way switching solenoid valve in a similar manner to the high-pressure air supply solenoid valve 84, wherein a bypass pipe bypassing the he ink recovery pump 44 and a bypass solenoid valve for selectively opening and closing this bypass pipe are additionally provided.

(2) In the above embodiment, in the ink recovery sequence illustrated in FIGS. 6 and 7, high-pressure air is supplied to the ink supply pipe 72 and the main ink recovery pipe 104 once for the short time period between the specific time point after the elapse of 50 seconds and the time point just before the elapse of 60 seconds, to recover ink or ink droplets remaining on the inner surface of each of the ink supply pipe 72 and the main ink recovery pipe 104. After termination of the ink recovery sequence, during the period between the time point corresponding to the elapse of 0 second and the time point corresponding to the elapse of 30 seconds in the 60-second cleaning sequence illustrated in FIG. 6, or during the period between the time point corresponding to the elapse of 0 second and the time point corresponding to the elapse of 60 seconds in the 120-second cleaning sequence illustrated in FIG. 7, high-pressure air is intermittently supplied to the ink supply pipe 72 and the main ink recovery pipe 104 twice, to recover ink or ink droplets remaining on the inner surface of each of the ink supply pipe 72 and the main ink recovery pipe 104. However, the timing, the duration and the number of times of the supply of high-pressure air to the ink supply pipe 72 and the main ink recovery pipe 104 are not particularly limited. The timing of the supply of high-pressure air may be determined depending on the state of ink remaining in the ink supply pipe and the main ink recovery pipe, as long as it is a timing after start of the ink recovery sequence. The timing of the supply of high-pressure air may be determined to concentrate in the ink recovery sequence, or may be determined to concentrate in the cleaning sequence.

(3) The above embodiment employs the configuration in which, in the 60-second cleaning sequence illustrated in FIG. 6, at the time point corresponding to the elapse of 50 seconds, ink remaining in the ink supply pipe 72 and the main ink recovery pipe 104 decreases with respect to air, and, after the elapse of 50 second, high-pressure air is supplied to the ink supply pipe 72 and the main ink recovery pipe 104 for the first time. However, the present invention is not limited to this configuration. Alternatively, for example, a configuration may be employed in which at a specific time point between the time point corresponding to the elapse of 30 seconds and the time point corresponding to the elapse of 50 seconds in the ink recovery sequence illustrated in FIG. 6, high-pressure air is supplied to the ink supply pipe 72 and the main ink recovery pipe 104 for the first time. In the ink recovery sequence, from the time point corresponding to the elapse of 30 seconds, a state appears in which ink and air start to be mixed together in the ink supply pipe 72 and the main ink recovery pipe 104, and each of the ink supply pump 42 and the ink recovery pump 44 becomes failing to sufficiently transport ink nixed with air. Therefore, in this modification, after the state appears in which ink and air start to be mixed together, recovery of ink mixed with air is carried out based on the supply of high-pressure air and the reverse rotation of the ink supply pump 42 and the ink recovery pump 44.

(4) The above embodiment employs the configuration in which, in the ink recovery sequence and the cleaning sequence, high-pressure air is supplied to both the ink supply pipe 72 and the main ink recovery pipe 104. However, the present invention is not limited to this configuration. For example, a configuration may be employed in which high-pressure air is supplied to only the main ink recovery pipe 104 which is longest in the corrugated paperboard sheet printing machine 1. In this modification, a component for supplying high-pressure air to the ink supply pipe 72, such as an opening-closing device and a pipe can be omitted, so that it becomes possible to simplify the configuration of the corrugated paperboard sheet printing machine 1. On the other hand, although the corrugated paperboard sheet printing machine 1 according to the above embodiment is configured such that ink or ink droplets remaining on the inner surface of the front ink recovery pipe 86 is recovered into the ink can 38 under the ink's own weight, a configuration may be employed in which residual ink or ink droplets in the front ink recovery pipe 86 is/are also recovered based on high-pressure air so as to thoroughly perform the ink recovery.

(5) As shown in FIG. 2, the above embodiment employs the configuration in which the ink recovery pump 44 is disposed at a position rearward of the rear machine frame 22, and the ink can 38 is disposed at a position forward of the front machine frame 20, wherein the main ink recovery pipe 104 elongatedly extends from a position rearward of the rearward machine frame 22 to a position forward of the front machine frame 20. However, the present invention is not limited to this configuration. In a case where, in the corrugated paperboard sheet printing machine 1, there is a sufficient lower space below the cleaning pan 36, the above arrangement may be changed such that at least one of the ink recovery pump 44 and the ink can 38 is disposed in the lower space. In this modification, a configuration may be employed in which the inflow port and the outflow port of the main ink recovery pipe 104 are disposed in the interspace region between the front machine frame 20 and the rear machine frame 22.

(6) The above embodiment employs the configuration in which the single high-pressure compressor 220 is coupled to each of the ink supply pipe 72 and the main ink recovery pipe 104 via a corresponding one of the high-pressure air supply solenoid valve 84 and the high-pressure air supply solenoid valves 84, 110. However, the present invention is not limited to this configuration. For example, a configuration may be employed in which two high-pressure compressors are coupled, respectively, to the ink supply pipe 72 and the main ink recovery pipe 104, and the printing control device 200 controls the actuation and stop of the two high-pressure compressors, individually, thereby controlling the supply and stop of high-pressure air to the ink supply pipe 72 and the main ink recovery pipe 104, individually. In this modification, a coupling pipe coupling one of the high-pressure air compressors directly to the main ink recovery pipe 104 is equivalent to "first coupling part" in the appended claims, and a coupling pipe coupling the other high-pressure air compressor directly to the ink supply pipe 72 is equivalent to "second coupling part" in the appended claims.

(7) The above embodiment employs the configuration in which the single high-pressure compressor 220 supplies high-pressure air to each of the ink supply pipe 72 and the main ink recovery pipe 104 at the same pressure. However, the present invention is not limited to this configuration. For example, in a configuration equipped with two high-pressure compressors, the pressures of high-pressure air to be generated by the two high-pressure compressors may be set to different values, depending on the pipe configuration of each of the ink supply pipe 72 and the main ink recovery pipe 104. The pressure of high-pressure air is determined while taking into account the pipe configuration (dimensions, etc.) such as a pipe diameter and a pipe length, the viscosity of ink used, environmental conditions such as temperature and humidity during printing, and conditions of high-pressure supply operation. A configuration may be employed in which through manipulation of the setting manipulation unit 206, a worker is allowed to adjust the pressure of high-pressure air to be generated by each of one or more high-pressure air compressors.

(8) The above embodiment employs the configuration in which the ink supply pump 42 is normally rotated so as to supply ink to the ink reservoir 26, and reversely rotated so as to recover ink from the ink reservoir 26 and drain cleaning water from the ink reservoir 26 in the cleaning sequence. However, the present invention is not limited to this configuration. For example, a configuration may be employed in which the ink supply pump 42 is used only for supplying ink to the ink reservoir 26 but not used for the recovery of ink and the draining of cleaning water.

(9) the above embodiment, the cleaning water pan 36, the main drain pipe 132 and the pair of auxiliary drain pipes 134, 136 are provided to drain cleaning water. However, the present invention is not limited to this configuration. For example, a configuration may be employed in which the cleaning water pan 36, the main drain pipe 132 and the pair of auxiliary drain pipes 134, 136 are omitted, wherein, after supplying high-pressure air to the ink supply pipe 72 and the main ink recovery pipe 104 to recover residual ink or ink droplets, cleaning water is injected to the ink reservoir 26 from the injection nozzles 149, and cleaning water injected to the ink reservoir 26 is drained into the drain channel 40 via the auxiliary ink recovery pipes 90, 92, 94, 96, the ink pans 32, 34, the front ink recovery pipe 86 and the main ink recovery pipe 104.

(10) The above embodiment employs the configuration in which the first high-pressure air supply and the second air supply are intermittently performed during the period between the time point corresponding to the elapse of 10 seconds and the time point corresponding to the elapse of 30 seconds in the 60-second cleaning sequence illustrated in FIG. 6, or during the period between the time point corresponding to the elapse of 30 seconds and the time point corresponding to the elapse of 60 seconds in the 120-second cleaning sequence illustrated in FIG. 7. However, the present invention is not limited to this configuration. For example, a configuration may be employed in which supply of high-pressure air is performed only once for a long continuous duration, or supply of high-pressure air is intermittently performed three times or more each for a short duration.

(11) The above embodiment employs the configuration in which, in the 120-second cleaning sequence, the ink recovery pump 44 is continuously stopped until the time point after the elapse of 60 seconds from the time point corresponding to the elapse of 0 second. However, the present invention is not limited to this configuration. For example, a configuration may be employed in which, in the 120-second cleaning sequence, the ink recovery pump 44 is stopped only during a period between the time point corresponding to the elapse of 0 second and the time point corresponding to the elapse of 10 second, and then continuously reversely during a period between the time point corresponding to the elapse of 10 seconds and a specific time point after the elapse of 80 seconds. In this modification, during a period between the time point corresponding to the elapse of 0 second and a specific time point after the elapse of 60 seconds (during the period during which the coupling port valve 130 for the short auxiliary ink recovery pipe 96 is continuously closed), the ink recovery pump 44 is reversely rotated, so that ink remaining in the ink pan 34 is suctioned via the coupling recovery pipe 106 and pushed out toward the main ink recovery pipe 104.

(12) In the above embodiment, in the 60-second cleaning sequence, the time point when the opening operation of the injection nozzle solenoid valve 152 is started is set to a time point earlier than a time point when the first opening operation of the cleaning water supply solenoid valves 138, 140 for the auxiliary drain pipes 134, 136 is started, and in the 120-second cleaning sequence, the time point when the opening operation of the injection nozzle solenoid valve 152 is started is also set to a time point earlier than a time point when the first opening operation of the cleaning water supply solenoid valves 138, 140 is started. However, the setting of the time point of the opening operation of the cleaning water supply solenoid valves 138, 140 is not limited to the setting in the above embodiment. For example, the time point when the first opening operation of the cleaning water supply solenoid valves 138, 140 is started may be set to a time point identical to or earlier than the time point when the opening operation of the injection nozzle solenoid valve 152 is started, in the 60-second cleaning sequence or in the 120-second cleaning sequence.

What is claimed is:

1. A printing machine comprising:

a printing plate;

an ink transfer roll rotatable to transfer ink to the printing plate;

a pair of machine frames arranged in spaced-apart relation in a rotational axis direction of the ink transfer roll, wherein the ink transfer roll is disposed in an interspace region between the machine frames;

an ink reservoir formed along the ink transfer roll so as to apply the ink onto the ink transfer roll;

an ink supply pipe for supplying the ink from an ink container to the ink reservoir; and an ink recovery pipe for recovering the ink from the ink reservoir, or from an ink pool for temporarily pooling the ink received from the ink reservoir, in an ink recovery direction directed toward the ink container;

wherein the printing machine further comprises:

a first restriction device for restricting a fluid communication state of the ink recovery pipe;

a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply;

wherein:

the ink recovery pipe comprises: an inflow port for allowing the ink from the ink reservoir or the ink pool to flow in the ink recovery pipe therethrough, the inflow port being disposed at a position closer to one of the pair of machine frames than a roll middle position in the rotational axis direction of the ink transfer roll; and an outflow port for allowing the ink in the ink recovery pipe to flow out toward the ink container therethrough, the outflow port being disposed at a position closer to the other of the pair of machine frames than the roll middle position in the rotational axis direction of the ink transfer roll;

the first restriction device is disposed at a disposition position of the inflow port of the ink recovery pipe, or a position downstream of the inflow port in the ink recovery direction;

the first coupling part is coupled to the ink recovery pipe at a position downstream of the first restriction device in the ink recovery direction; and the first high-pressure air control device is configured to stop the supply of the high-pressure air to the ink recovery pipe through the first coupling part, while the ink is supplied to the ink reservoir via the ink supply pipe, and to supply the high-pressure air to the ink recovery pipe through the first coupling part, after start of an ink recovery operation of recovering the ink, via the ink recovery pipe, from the ink reservoir after completion of the supply of the ink thereto, or from the ink reservoir after completion of the supply of the ink thereto and the ink pool.

2. The printing machine according to claim 1, wherein the first high-pressure air control device is configured to supply the high-pressure air to the ink recovery pipe through the first coupling part, after an inside of the ink recovery pipe is changed from an ink filled state to an ink-air mixed state in a process after the start of the ink recovery operation of recovering the ink, via the ink recovery pipe, from the ink reservoir after the completion of the supply of the ink thereto, or from the ink reservoir after the completion of the supply of the ink thereto and the ink pool.

3. The printing machine according to claim 1, wherein the first restriction device comprises a first tubing pump coupled to the ink recovery pipe and configured to transport the ink in the ink recovery pipe, wherein the first tubing pump comprises a flexible tube coupled to the ink recovery pipe, and a rotor rotatable to compress the tube, wherein the fluid communication of the ink recovery pipe is shut off in a portion of the tube compressed by the rotor.

4. The printing machine according to claim 3, wherein:

the first tubing pump is disposed on a first machine frame which is one of the pair of machine frames;

the outflow port of the ink recovery pipe is disposed in a region adjacent to a second machine frame which is the other of the pair of machine frames and outside the interspace region between the pair of machine frames;

the ink recovery pipe has a pipe portion extending from the first tubing pump to the outflow port; and the first coupling part is coupled to the ink recovery pipe at a position downstream of the first tubing pump in the ink recovery direction and closer to the first machine frame than the roll middle position in the rotational axis direction of the ink transfer roll.

5. The printing machine according to claim 1, wherein:

the first coupling part comprises an opening-closing device;

the first high-pressure air control device comprises an opening-closing control part to control an opening-closing operation of the opening-closing device; and the opening-closing control part is configured to control the opening-closing device to be placed in a closed state, thereby stopping the supply of the high-pressure air to the ink recovery pipe through the first coupling part, and to control the opening-closing device to be placed in an open state, thereby supplying the high-pressure air to the ink recovery pipe through the first coupling part.

6. The printing machine according to claim 1, which further comprises:

a second restriction device for restricting a fluid communication state of the ink supply pipe;

a second coupling part for coupling a high-pressure air generation part for generating high-pressure air, with the ink supply pipe; and a second high-pressure air control device for controlling supply of the high-pressure air to the ink supply pipe through the second coupling part, and stop of the supply;

wherein:

the ink supply pipe is configured to be used for recovering the ink from the ink reservoir toward the ink container; and the second high-pressure air control device is configured to stop the supply of the high-pressure air to the ink supply pipe through the second coupling part, while the ink is recovered from the ink reservoir via the ink supply pipe, and to supply the high-pressure air to the ink supply pipe through the second coupling part, after completion of an operation of recovering the ink from the ink reservoir via the ink supply pipe.

7. The printing machine according to claim 6, wherein:

the second restriction device comprises a path switching device coupled to the ink supply pipe, wherein the path switching device is operable to switch a path between a first path providing fluid communication between the ink reservoir and the ink supply pipe, and a second path providing fluid communication between the second coupling part and the ink supply pipe;

the second high-pressure air control device comprises a switching control part to control a state of the path switching device between a first state in which the second path is closed and the first path is opened, and a second state in which the first path is closed and the second path is opened; and the switching control part is configured to control the state of the path switching device to be switched to the first state, thereby stopping the supply of the high-pressure air to the ink supply pipe through the second coupling part, and to control the state of the path switching device to be switched to the second state, thereby supplying the high-pressure air to the ink supply pipe through the second coupling part.

8. The printing machine according to claim 6, wherein the ink supply pipe has a supply port for supplying the ink to the ink reservoir therethrough, the supply port disposed at the roll middle position in the rotational axis direction of the ink transfer roll, or a position adjacent to the roll middle position, and wherein the printing machine further comprises:

a second tubing pump disposed at a position closer to the other of the pair of machine frames than the supply port of the ink supply pipe, the second tubing pump configured to be selectively rotatable in normal and reverse directions, and coupled to the ink supply pipe to transport the ink in the ink supply pipe;

a bypass path coupled to the ink supply pipe while bypassing the second tubing pump; and a bypass opening-closing device configured to selectively open and close the bypass path;

wherein:

the second coupling part is coupled to the ink supply pipe at a position between the supply port of the ink supply pipe and the second tubing pump;

the second high-pressure air control device is configured to, while the ink is recovered from the ink reservoir via the ink supply pipe, control rotation of the second tubing pump to be set to a rotational direction for recovering ink, and control the bypass opening-closing device to close the bypass path, so as to stop the supply of the high-pressure air to the ink supply pipe through the second coupling part; and the second high-pressure air control device is configured to, after completion of the operation of recovering the ink from the ink reservoir via the ink supply pipe, stop the rotation of the second tubing pump, and control the bypass opening-closing device to open the bypass path, so as to supply the high-pressure air to the ink supply pipe through the second coupling part.

9. A printing machine comprising:

a printing plate;

an ink transfer roll rotatable to transfer ink to the printing plate;

a pair of machine frames arranged in spaced-apart relation in a rotational axis direction of the ink transfer roll, wherein the ink transfer roll is disposed in an interspace region between the machine frames;

an ink reservoir formed along the ink transfer roll so as to apply the ink onto the ink transfer roll;

an ink supply pipe for supplying the ink from an ink container to the ink reservoir;

an ink recovery pipe for recovering the ink from the ink reservoir, or from an ink pool for temporarily pooling the ink received from the ink reservoir, in an ink recovery direction directed toward the ink container;

a cleaning water supply unit for supplying cleaning water to the ink reservoir; and a drain pipe for draining the cleaning water in the ink reservoir;

wherein the printing machine is configured to sequentially carry out a printing step of supplying the ink to the ink reservoir to perform printing, an ink recovery step of, after completion of the printing step, recovering the ink from the ink reservoir or from the ink reservoir and the ink pool, and a cleaning step of cleaning the ink reservoir by supplying the cleaning water to the ink reservoir and draining the cleaning water via the drain pipe;

wherein the printing machine further comprises:

a first restriction device for restricting a fluid communication state of the ink recovery pipe;

a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply;

wherein:

the ink recovery pipe comprises: an inflow port for allowing the ink from the ink reservoir or the ink pool to flow in the ink recovery pipe therethrough, the inflow port disposed at a position closer to one of the pair of machine frames than a roll middle position in the rotational axis direction of the ink transfer roll; and an outflow port for allowing the ink in the ink recovery pipe to flow out toward the ink container therethrough, the outflow port being disposed at a position closer to the other of the pair of machine frames than the roll middle position in the rotational axis direction of the ink transfer roll;

the first restriction device is disposed at a disposition position of the inflow port of the ink recovery pipe, or a position downstream of the inflow port in the ink recovery direction;

the first coupling part is coupled to the ink recovery pipe at a position downstream of the first restriction device in the ink recovery direction; and the first high-pressure air control device is configured to, in the printing step, stop the supply of the high-pressure air to the ink recovery pipe through the first coupling part, and, while at least the cleaning step is carried out after completion of the printing step, supply the high-pressure air to the ink recovery pipe through the first coupling part, so as to recover the ink in the ink recovery pipe.

10. The printing machine according to claim 9, which further comprises:

a second restriction device for restricting a fluid communication state of the ink supply pipe;

a second coupling part for coupling a high-pressure air generation part for generating high-pressure air, with the ink supply pipe; and a second high-pressure air control device for controlling supply of the high-pressure air to the ink supply pipe through the second coupling part, and stop of the supply;

wherein:

the ink supply pipe is configured to be used for recovering the ink from the ink reservoir toward the ink container, and the second high-pressure air control device is configured to, in the printing step, stop the supply of the high-pressure air to the ink supply pipe through the second coupling part, and, while at least the cleaning step is carried out after the completion of the printing step, supply the high-pressure air to the ink supply pipe through the second coupling part, so as to recover ink in the ink supply pipe.

11. A printing machine comprising:

a printing plate;

an ink transfer roll rotatable to transfer ink to the printing plate;

a pair of machine frames arranged in spaced-apart relation in a rotational axis direction of the ink transfer roll, wherein the ink transfer roll is disposed in an interspace region between the machine frames;

an ink reservoir formed along the ink transfer roll so as to apply the ink onto the ink transfer roll;

an ink supply pipe for supplying the ink from an ink container to the ink reservoir;

an ink recovery pipe for recovering the ink from the ink reservoir, or from an ink pool for temporarily pooling the ink received from the ink reservoir, in an ink recovery direction directed toward the ink container;

a cleaning water supply unit for supplying cleaning water to the ink reservoir; and a drain pipe for draining the cleaning water in the ink reservoir;

wherein the printing machine is configured to sequentially carry out a printing step of supplying the ink to the ink reservoir to perform printing, an ink recovery step of, after completion of the printing step, recovering the ink from the ink reservoir or from the ink reservoir and the ink pool, a first cleaning step of cleaning the ink reservoir by supplying the cleaning water to the ink reservoir and draining the cleaning water from the ink reservoir via the drain pipe, and a second cleaning step of cleaning the ink supply pipe and the ink recovery pipe by supplying the cleaning water to the ink supply pipe and the ink recovery pipe and draining the cleaning water from the ink supply pipe and the ink recovery pipe;

wherein the printing machine further comprises:

a first restriction device for restricting a fluid communication state of the ink recovery pipe;

a first coupling part for coupling a high-pressure air generation part for generating high-pressure air, with the ink recovery pipe; and a first high-pressure air control device for controlling supply of the high-pressure air to the ink recovery pipe through the first coupling part, and stop of the supply;

wherein:

the ink recovery pipe comprises: an inflow port for allowing the ink from the ink reservoir or the ink pool to flow in the ink recovery pipe therethrough, the inflow port disposed at a position closer to one of the pair of machine frames than a roll middle position in the rotational axis direction of the ink transfer roll; and an outflow port for allowing the ink in the ink recovery pipe to flow out toward the ink container therethrough, the outflow port being disposed at a position closer to the other of the pair of machine frames than the roll middle position in the rotational axis direction of the ink transfer roll;

the first restriction device is disposed at a disposition position of the inflow port of the ink recovery pipe, or a position downstream of the inflow port in the ink recovery direction;

the first coupling part is coupled to the ink recovery pipe at a position downstream of the first restriction device in the ink recovery direction; and the first high-pressure air control device is configured to, in the printing step, stop the supply of the high-pressure air to the ink recovery pipe through the first coupling part, and, while at least the first cleaning step and the second cleaning step are carried out in a process from completion of the printing step to completion of the second cleaning step, supply the high-pressure air to the ink recovery pipe through the first coupling part, so as to recover the ink in the ink recovery pipe and drain the cleaning water in the ink recovery pipe.

* * * * *